US008343697B2

(12) United States Patent
Kanazawa et al.

(10) Patent No.: US 8,343,697 B2
(45) Date of Patent: Jan. 1, 2013

(54) ELECTROPHOTOGRAPHIC PHOTOCONDUCTOR AND IMAGE FORMING APPARATUS PROVIDED WITH THE SAME

(75) Inventors: Tomoko Kanazawa, Osaka (JP); Hiroshi Sugimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 706 days.

(21) Appl. No.: 12/422,636

(22) Filed: Apr. 13, 2009

(65) Prior Publication Data

US 2009/0257777 A1 Oct. 15, 2009

(30) Foreign Application Priority Data

Apr. 15, 2008 (JP) ..... 2008-105903
Sep. 26, 2008 (JP) ..... 2008-248349

(51) Int. Cl.
*G03G 15/00* (2006.01)

(52) U.S. Cl. ..... 430/57.1; 430/58.05; 430/58.35; 430/58.75; 399/121

(58) Field of Classification Search ..... 430/57.1, 430/58.05, 58.35, 58.75; 399/121
See application file for complete search history.

(56) References Cited

U.S. PATENT DOCUMENTS

2007/0105031 A1* 5/2007 Fukushima et al. ..... 430/58.65

FOREIGN PATENT DOCUMENTS

| | | | |
|---|---|---|---|
| JP | 5-158258 | A | 6/1993 |
| JP | 07-128884 | | 5/1995 |
| JP | 2000-242056 | | 9/2000 |
| JP | 2000-242057 | | 9/2000 |
| JP | 2000-330303 | | 11/2000 |
| JP | 2004-012718 | | 1/2004 |
| JP | 2004-317944 | | 11/2004 |
| JP | 2004-361536 | A | 12/2004 |
| JP | 2005141031 | * | 6/2005 |
| JP | 2007-272175 | A | 10/2007 |

OTHER PUBLICATIONS

Machine English language translation of JP 05158258, Jun. 1993.*
Absract of JP 2005141031, Jun. 2005.*
Machine English language translation of JP 2005141031, Jun. 2005.*

* cited by examiner

*Primary Examiner* — Hoa V Le
(74) *Attorney, Agent, or Firm* — Nixon & Vanderhye P.C.

(57) ABSTRACT

An electrophotographic photoconductor containing at least a charge generation material and a charge transport material on a conductive support, the electrophotographic photoconductor comprising a diamine compound represented by the formula (1), and also a polyarylate resin having a structural unit represented by the following formula (I).

(1)

(I)

12 Claims, 2 Drawing Sheets

ELECTROPHOTOGRAPHIC PHOTOCONDUCTOR AND IMAGE FORMING APPARATUS PROVIDED WITH THE SAME

CROSS-REFERENCE TO RELATED APPLICATION

This application is related to Japanese Patent Application Nos. 2008-105903 filed on 15 Apr. 2008 and 2008-248349 filed on 26 Sep. 2008, whose priorities are claimed under 35 USC §119, and the disclosures of which are incorporated by reference in its entirety.

BACKGROUND OF THE INVENTION

1. Field of the Invention

The present invention relates to an electrophotographic photoconductor used for electrophotographic type image formation and to an image forming apparatus provided therewith.

Particularly, the present invention relates to an electrophotographic photoconductor used for electrophotographic type image formation and particularly, for full-color image formation or multicolor image formation, for example, a color printer and to an image forming apparatus provided with the electrophotographic photoconductor.

More particularly, the present invention relates to a tandem system image forming apparatus provided with plural photographic photoconductors and plural developing units each receiving a developer having a different color.

2. Description of Related Art

Electrophotographic type image forming apparatuses such as copying machines, printers and facsimile machines are generally provided with a "electrophotographic photoconductor" (hereinafter, also referred to simply as "photoconductor"), a charging means, an exposure means, an electrostatic latent image formation means, a developing means, a transfer means and a fixing means and further, a means for recovering a toner left unremoved on the surface of the photoconductor after the transfer action of the transfer means.

Usually, the above photoconductor has a structure in a photosensitive layer containing a photoconductive material on a conductive substrate made of a conductive material.

Also, examples of the above photoconductor include inorganic photoconductors such as a selenium-based photoconductor using, for example, amorphous selenium (a-Se) or amorphous arsenic selenium (a-AsSe) as the photosensitive layer; a zinc oxide-based photoconductor using zinc oxide (ZnO) or cadmium sulfide-based photoconductor using cadmium sulfide (CdS) as the photosensitive layer; and an amorphous silicon-based photoconductor (a-Si) using amorphous silicon (a-Si photoconductor) as the photosensitive layer, and photoconductors (hereinafter also referred to as organic photoconductor) using organic photoconductive materials, that is, organic photoconductors (abbreviation: OPC).

These organic photoconductors have many advantages in the points of, for example, toxicity, manufacturing cost and freedom of material designing though they have some non-negligible problems concerning sensitivity, durability and stability to environments.

Moreover, the organic photoconductors have the characteristics that they can be formed using an easy and inexpensive method represented by, for example, the dip coating method and therefore, stand the mainstream in the field of photoconductors at present.

As the structure of such an organic photoconductor, a variety of structures are proposed which include a monolayer structure formed by dispersing both a charge generation material and a charge transport material (also referred to as "charge transfer layer") in a binding resin (also referred to as "binder resin") on the conductive substrate made of conductive materials and a laminate structure in which a charge generation layer obtained by dispersing a charge generation material in a binding resin and a charge transport layer obtained by dispersing a charge transport material in a binding resin on the conductive substrate in this order or a reverse two-layer type laminate structure obtained by laminating these layers in inverse order.

Particularly, the performance of the organic photoconductor has been significantly improved with development of a separated function type photoconductor in which a charge generation function and a charge transport function are assigned to separate materials.

Specifically, the separated function type photoconductor has, besides the above advantages, the advantages that the materials constituting the photosensitive layer can be selected from a wide range of materials, so that a photoconductor having desired characteristics can be manufactured relatively easily.

The function separation type photoconductors include a laminate type and a monolayer type.

The laminate function separation type photoconductor is provided with a laminate type photosensitive layer constituted by laminating a charge generation layer containing a charge generation material carrying a charge generation function and a charge transport layer containing a charge transport material carrying a charge transport function.

The charge generation layer and the charge transport layer are usually formed by dispersing a charge generation material and a charge transport material each in a binder resin which is a binder.

The monolayer function separation type photoconductor is, on the other hand, provided with a monolayer type photosensitive layer obtained by dispersing a charge generation material and charge transport material together with a binding resin.

Also, in an electrophotographic device, the above charging, exposing, developing, transfer, cleaning and static elimination operations are repeated in various environments.

It is therefore demanded of the photoconductor to have high sensitivity and high light responsibility and besides, to be superior in environmental stability, electric stability and durability to mechanically external force (scratch resistance).

Specifically, the photoconductor needs to have high scratch resistance which is a resistance to the abrasion of the surface layer which is caused by the sliding friction of a cleaning member and the like.

In the meantime, when a full-color image or a multicolor image is formed by using an electrophotographic process, plural developing units each having a different color toner are provided in the apparatus and the formed toner images are made to be overlapped on each other to thereby form a color image or a multicolor image. In recent years, a tandem system image forming apparatus in which plural photoconductors corresponding to each toner color are arranged in a line has come to be used to raise printing speed.

In the tandem system image forming apparatus, plural component color images corresponding to a full-color image or multicolor image information are each formed on each photoconductor and laminated sequentially on recording paper, and transferred to the recording paper to output an image formation product in which the full-color image or multicolor image is synthesized and reproduced. Such a tandem system image forming apparatus is useful as a full-color forming apparatus, a multicolor image forming apparatus or an image forming apparatus capable of forming both full-color and multicolor images.

The tandem system image forming apparatus capable of forming a full-color or multicolor image has a structure which generally includes four developing units for receiving cyan, magenta, yellow and black colors respectively, and four photoconductors consisting of a cyan photoconductor used to form a cyan-color image, a magenta photoconductor used to form a magenta-color image, a yellow photoconductor used to form a yellow-color image and a black photoconductor used to form a black-color image. In an image forming apparatus, not only full-color images or multicolor images but also monochromatic images such as white and black images are frequently formed. Therefore, the practical control of operation is changed according to the image formation mode designated by users to limit the abrasion of a photoconductor.

For example, when the color image output mode is designated by a user, the position of each photoconductor for cyan, magenta, yellow and black colors is adjusted to the working position in contact with the transfer and handler belt and each photoconductor is driven with rotation to perform a charge action, an exposure action and a developing action for the photoconductor, thereby transferring a toner image formed on the photoconductor to recording paper. A full-color image is thus formed on the recording paper by these operations.

Also, when a white and black image output mode is designated, first, a releasing mechanism is driven to make each photoconductor for cyan, magenta and yellow colors apart from the transfer conveyer belt and then made to stop its rotation. Furthermore, the charge action, exposure action and developing action for each photoconductor are stopped. In this state, only the black photoconductor is driven with rotation to perform a charge action, an exposure action and a developing action for the black photoconductor to transfer the black toner image formed on the black photoconductor to the recording paper. A white and black image is thus formed on the recording paper by these operations.

As mentioned above, when a white and black image output mode is designated, photoconductors other than a black photoconductor is made to be apart from the transfer conveyer belt and is made to stop its rotation, whereby the abrasive actions of a cleaning blade, recording paper, transfer conveyer belt and the like on photoconductors unnecessary when the white and black image output mode is designated can be limited.

This action control is more effective when the frequency of formation of a full-color image is higher than that of formation of a white and black image. However, in an image forming apparatus used actually, the frequency of formation of a white and black image is higher than that of formation of a full-color image, and therefore, the rate of abrasion is relatively higher in the case of the black photoconductor than in the case of other color photoconductors. In usual, the characteristics of a photoconductor largely depend on a reduction in film thickness and are more deteriorated along with a reduction in film thickness. Therefore, when the rate of abrasion of the black photoconductor is higher than that of other color photoconductors, the black photoconductor is deteriorated at a higher rate than other color photoconductors. Therefore, there is the problem that a full-color image is unevenly colored with an increase in the number of copies.

The problem of this color unevenness can be solved by exchanging the deteriorated black photoconductor for a new one. However, when only the deteriorated black photoconductor is replaced with a new one, a color balance between a toner image formed using the exchanged black photoconductor and a toner image formed using other color photoconductors is upset, so that no full-color image having high quality can be obtained.

Therefore, when the black photoconductor is deteriorated, it is necessary to replace all other non-deteriorated color photoconductors with new ones. In other words, each workable time of four photoconductors to be used for formation of each color image is controlled by the available time of the black photoconductor having the highest frequency of use, which is a large waste of time and money, leading to high running costs.

In order to limit an increase in running costs, it is necessary to prolong the life of the black photoconductor which determines the life of the device so that the black photoconductor can be used for the same period of time as other color photoconductors. For this, for example, such technology have been proposed that the film thickness of the photosensitive layer of the black photoconductor is made to be higher than that of each photosensitive layer of other color photoconductors (see Publication of JP-A 2000-242056) and that only the black photoconductor is designed to have a larger diameter (see Publication of JP-A 2000-242057).

When, similarly to the image forming apparatuses of Patent Documents 1 and 2, only the black photoconductor is designed to have a different structure to prolong its life so as to be able to use the black photoconductor for the same period of time as other color photoconductors, it is necessary that the means such as the charging means, exposure means, and transfer means used for the black photoconductor have structures different from those used to form other color images similarly to the case of using an $\alpha$-Si photoconductor or an amorphous silicon carbon ($\alpha$-SiC)-based photoconductor, showing that these technologies of Documents 1 and 2 have poor productivity and are increased in production costs.

Particularly, if the film thickness of the photosensitive layer or charge transport layer of the black photoconductor is increased as described in the technology of Publication of JP-A 2000-242056, this gives rise to problems that the black photoconductor is deteriorated in chargeability and resolving power. Also, if the diameter of the black photoconductor is increased as described in Publication of JP-A 2000-242057, this gives rise to a problem that the size of the apparatus body is large.

In order to prolong the available time of the four photoconductors used so as to form each color image, not only the black photoconductor is designed to prolong its life and to use the black photoconductor for the same period of time as other color photoconductors but also it is necessary to prolong each life of all photoconductors including the black photoconductor. Therefore, all photoconductors including the black photoconductor need to have high mechanical durability and be resistant to abrasion, that is, to have the surface layer having high mechanical durability.

With regard to the technology for improving the mechanical durability of the surface layer of the photoconductor, there is, for example, such a proposal that a copolymer polycarbonate resin is compounded in the surface layer of a photoconductor (see Publication of JP-A 2000-330303).

In the meantime, in a general electrophotographic type image forming apparatus, many photoconductors are not a little affected adversely by ozone generated from the apparatus and NOx generated from, for example, a charging device.

As regard to the influences of ozone and NOx, these harmful materials cause particularly under the circumstance of high temperature and high relative humidity, a reduction in charged potential, a rise in residual potential and a reduction in surface resistance, a deterioration in resolution and a significant deterioration in the qualities of an output image, with the result that there is the case where the life of the photoconductor is shortened.

Also, when the image forming apparatus is allowed to stand for a long period of time under a low-humidity environment, there is the case where color unevenness is caused when the apparatus is started after it is allowed to stand. This poses the problem that ozone and NOx are left collectively only just under the charging device of the photoconductor when the image forming apparatus is stopped and therefore, the surface potential of this part is dropped, resulting in lowered image density.

Also, in the case of a photoconductor having low mechanical durability, that is, a photoconductor having an easily peelable surface layer, the film is peeled off before the damages caused by ozone and NOx are accumulated and therefore, the above problems are scarcely tangible. However, if the mechanical durability is heightened, the surface layer is not abraded that much and therefore, the damages caused by ozone and NOx are easily accumulated and become more conspicuous.

Also, the fluidity of gases around the photoconductor is impaired in current apparatuses designed for space saving and therefore, ozone and NOx are easily collected, which is the reason why it is desired to solve these problems.

Also, the aforementioned problem that color unevenness arises when the apparatus is started after it is allowed to stand under a low-humidity environment is serious particularly in a tandem system color machine.

Specifically, in the tandem system, plural component color images corresponding to a full-color image or multicolor image information are each formed on each photoconductor and laminated sequentially on recording paper, and transferred to the recording paper to output an image formation product in which the full-color image or multicolor image is synthesized or reproduced. Therefore, when a part decreased in density arises partly in each photoconductor, this brings about a difference in the position where color unevenness occurs in every color, causing the possibility of formation of a very unbalanced image, which is fatal to a color image forming apparatus.

In order to solve these problems, it is effective to add additives such as an antioxidant. It is considered to be effective to increase the amount of these additives in particular the tandem system color machine for higher effects of these additives.

However, if the amount of the additive is increased, this brings about a reduction in density in long-term use because of a rise in residual potential in repeat use.

In light of this, it is desired to use an additive having an excellent effect even in a small amount to prevent a reduction in density in long-term use.

The above Publication of JP-A 2000-330303, also from this point of view, is not a measures taken to solve these problems even if it contributes to an improvement in mechanical durability.

In the use of an additive in a color image forming apparatus, it is proposed to use a phenol-based or thioether-based antioxidant containing a sulfur atom in a combination of a specified charge generation material and a charge transport material (see Publication of JP-A 2004-12718). However, these methods are also unsatisfactory and a tandem system color image forming apparatus is desired to be improved in mechanical durability and to provide a stable image quality for a long period by using additives having excellent effect even if the amount of these additives is small.

Also, the durability of an electrophotographic photoconductor can be improved by using a polyarylate resin. However, resins deteriorated by oxidation and substances stuck to the surface are insufficiently removed, which is a cause of reduction in surface resistance of the photoconductor, giving rise to the so-called image deletion which is a phenomenon that an image is blurred as if it is deleted a flowing image particularly under a high-temperature and high-humidity condition in the same manner as in the case where a protective layer is contained or a filler is contained in the surface of the photoconductor.

A method in which an antioxidant is added in the charge transport layer is adopted as the measures taken to prevent this image deletion. However, there is a problem that the addition of an excess amount of the antioxidant causes a reduction in sensitivity by repeated operations. In order to improve these problems, the temperatures of a photoconductor support and a charge transport layer coating solution are controlled to thereby increase the adhesion between the charge generation layer and the charge transport layer to thereby improve charge injection efficiency (Publication of JP-A 2004-317944). However, this improvement is not said to be sufficient and a more excellent antioxidant is desired.

Specifically, the above-mentioned conventional art have failed to provide a photoconductor having sufficient effect of oxidation-resistant gases and a color tandem image forming apparatus. Also, the addition of such an antioxidant allows a harmful effect to still remain, so that it provides practically unsatisfactory characteristics, bringing about deteriorations in the electrophotographic characteristics such as a reduction in sensitivity and a rise in residual potential.

Therefore, a proposal of a novel material which is improved in resistance to oxidizing gas and is free from harmful effects on the electrophotographic characteristics and an image forming apparatus using that material are expected.

SUMMARY OF THE INVENTION

It is an object of the present invention to provide an electrophotographic photoconductor which is superior in mechanical/electrical durability, does not produce abnormal images such as color unevenness in a long-term repeated use, can output a stable image for a long time and has high durability and also to provide a white and black or color image forming apparatus provided with the photoconductor.

The inventors of the present invention have made earnest studies as to an improvement in the mechanical durability and oxidizing gas resistance of a photoconductor and, as a result, found that a photoconductor which has significantly high resistance to gases, provides stable high quality images and is also improved in mechanical durability for a long period of time is obtained by formulating a specified diamine compound and a specified polyarylate resin in a photosensitive layer and by using the photoconductor in a white and black or color image forming apparatus and also, that a white-black or color image forming apparatus having the above characteristics is obtained by using the photoconductor, to complete the present invention.

According to the invention, there is thus provided that an electrophotographic photoconductor containing at least a charge generation material and a charge transport material on a conductive support, the electrophotographic photoconductor being formed by laminating a monolayer type photosensitive layer containing the charge generation material and the charge transport material or a laminate type photosensitive layer in which a charge generation layer containing the charge generation material and a charge transport layer containing the charge transport material are laminated in this order on the conductive support;

the photoconductor comprising a diamine compound represented by the formula (1):

(1)

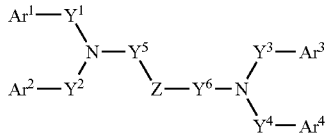

wherein $Ar^1$, $Ar^2$, $Ar^3$ and $Ar^4$ each independently represent an aryl or cycloalkyl group or monovalent heterocyclic group which may have substituent(s); $Y^1$, $Y^2$, $Y^3$, $Y^4$, $Y^5$ and $Y^6$ each independently represent a straight-chain alkylene group which may have substituent(s); Z is represented by i) —$Ar^5$—, ii) —$Ar^5$—$Ar^6$— or iii) —$Ar^5$—W—$Ar^6$— wherein $Ar^5$ and $Ar^6$ each independently represent an arylene group or a divalent heterocyclic residue which may have substituent(s); and W represents an oxygen atom, a sulfur atom or a straight or branched chain or cyclic alkylene group which may have substituent(s);

and also a polyarylate resin having a structural unit represented by the following formula (1):

(I)

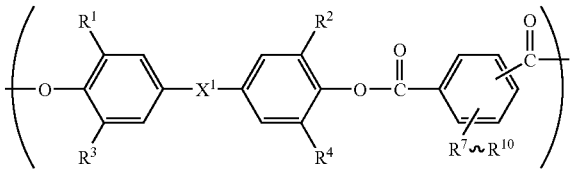

wherein $X^1$ represents a connecting group or —$CR^5R^6$ wherein $R^5$ and $R^6$ each independently represent a hydrogen atom, a halogen atom or an alkyl or aryl group which may have substituent(s) or $R^5$ and $R^6$ may be combined together with the carbon atom with which these groups are connected to form a cyclic structure;

$R^1$, $R^2$, $R^3$ and $R^4$ each independently represent a hydrogen atom, a halogen atom or an alkyl or aryl group which may have substituent(s); and $R^7$, $R^8$, $R^9$ and $R^{10}$ each independently represent a hydrogen atom, a halogen atom or an alkyl or aryl group which may have substituent(s).

According to the invention, there is also provided that an image forming apparatus comprising: the electrophotographic photoconductor; a charging means that charges the electrophotographic photoconductor; an exposure means that exposes the charged photographic photoconductor; a developing means that develops the electrostatic latent image formed by the exposure and a transfer means that transfers the electrostatic latent image to a transfer material.

According to the invention, there is further provided that the image forming apparatus, comprising plural electrophotographic photoconductors used separately for white-black use and for color use, a charge means that separately charges the surface of the plural photoconductors, an exposure means that separately exposes the charged electrophotographic photoconductors, plural developing means that receive developers having colors different from each other and separately develop the electrostatic latent images formed on the surface of the electrophotographic photoconductors by the exposure and a transfer means that separately transfers the visible images formed on the electrophotographic photoconductors to a recording medium, wherein the electrophotographic photoconductor is produced by laminating either a monolayer type photosensitive layer containing a charge generation material and a charge transport material or a laminate type photosensitive layer obtained by laminating a charge generation layer containing a charge generation material and a charge transport layer containing a charge transport material in this order, on a conductive support, the image forming apparatus using the electrophotographic photoconductor as claimed in any one of Claims 1 to 12 as the electrophotographic photoconductor consisting of the monolayer type photosensitive layer or laminate type photosensitive layer.

Also, the present invention provides an image forming apparatus comprising the above photographic photoconductor, a charging means that charges the electrophotographic photoconductor, an exposure means that exposes the above charged electrophotographic photoconductor, a developing means that develops an electrostatic latent image formed by the exposure and a transfer means that transfers the electrostatic latent image to a transfer material.

The present invention can provide a photoconductor which is superior in mechanical/electrical durability, does not produce abnormal images such as color unevenness in a long-term repeated use, can output a stable image for a long time and has high durability and also to provide a color image forming apparatus provided with the photoconductor.

Specifically, the electrophotographic photoconductor and image forming apparatus according to the present invention can avoid poor images which are made more tangible and caused by oxidizing gases to an improve mechanical durability and to correspond to a color image forming apparatus designed for space saving by formulating a specified diamine compound superior in resistance to oxidizing gases.

Therefore, an image which is free from defective images and has high qualities can be stably formed for a long period under various environments in the image forming apparatus according to the present invention.

PREFERRED EMBODIMENT OF THE INVENTION

Figure 1:
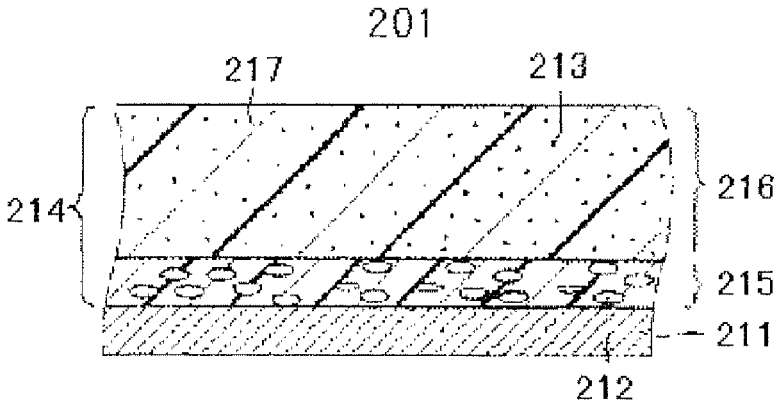
FIG. 1 is a typical sectional view showing the structure of an essential part of a laminate type photoconductor according to the present invention.

The present invention relates to an electrophotographic photoconductor comprising a diamine compound represented by the formula (1):

(1)

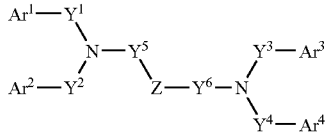

wherein $Ar^1$, $Ar^2$, $Ar^3$ and $Ar^4$ each independently represent an aryl, cycloalkyl or monovalent heterocyclic group which may have substituent(s); $Y^1$, $Y^2$, $Y^3$, $Y^4$, $Y^5$ and $Y^6$ each independently represent a straight chain alkylene group which may have substituent(s); Z is represented by i) —$Ar^5$—, ii) —$Ar^5$—$Ar^6$— or iii) —$Ar^5$—W—$Ar^6$ wherein $Ar^5$ and $Ar^6$ each independently represent an arylene group or divalent heterocyclic residue which may have substituent(s); and W represents an oxygen atom, a sulfur atom or a straight or branched chain or cyclic alkylene group which may have substituent(s).

Among the diamine compounds represented by the formula (1), diamine compounds represented by the formula (1) in which $Y^1$, $Y^2$, $Y^3$, $Y^4$, $Y^5$ and $Y^6$ each are a chain alkylene group, that is, diamine compounds represented by the following sub-formula (2) are preferable from the viewpoints of chemical stability against decomposition and denaturing, availability of raw materials, production easiness, high yield and production cost:

(2)

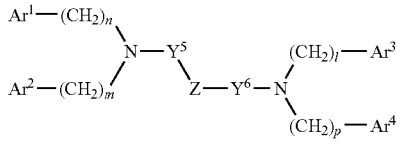

wherein $Ar^1$, $Ar^2$, $Ar^3$, $Ar^4$, $Y^5$, $Y^6$ and Z are the same as those defined in the formula (1); l, m, n and p, which may be the same or different, denote an integer from 1 to 3.

Moreover, the diamine compounds represented by the formula (1) in which $Y^1$, $Y^2$, $Y^3$, $Y^4$, $Y^5$ and $Y^6$ each are a chain methylene group, that is, diamine compounds represented by the following sub-formula (3) are more preferable:

(3)

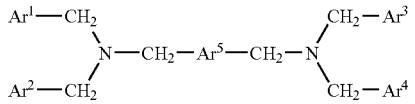

wherein $Ar^1$, $Ar^2$, $Ar^3$, $Ar^4$ and $Ar^5$ are the same as those defined in the formula (1).

Each substituent in the formula (1) and sub-formulae (2) and (3) will be explained below.

Examples of the aryl group represented by $Ar^1$, $Ar^2$, $Ar^3$ or $Ar^4$ which may have substituent(s) include aryl groups which may be substituted with an alkyl group having 1 to 4 carbon atoms, alkoxy group having 1 to 4 carbon atoms, dialkylamino group having 2 to 6 carbon atoms or halogen atom.

Specific examples of the aryl group include phenyl group, tolyl group, xylyl group, methoxyphenyl group, methylmethoxyphenyl group, t-butylphenyl group, 4-diethylaminophenyl group, 4-chlorophenyl group, 4-fluorophenyl group, naphthyl group and methoxynaphthyl group. Among these groups, the phenyl group, tolyl group, methoxyphenyl group and naphthyl group are more preferable.

Examples of the cycloalkyl group represented by $Ar^1$, $Ar^2$, $Ar^3$ and $Ar^4$ which may have substituent(s) include cycloalkyl groups which may be substituted with an alkyl group having 1 to 4 carbon atoms.

Specific examples of the cycloalkyl group include cyclohexyl group, cyclopentyl group and 4,4-dimethylcyclohexyl group. Among these groups, the cyclohexyl group is more preferable.

Examples of the monovalent heterocyclic residue represented by $Ar^1$, $Ar^2$, $Ar^3$ or $Ar^4$ which may have substituent(s) include tetrahydrofuryl group, tetramethyltetrahydrofuryl group and further, monovalent heterocyclic residues which may be substituted with an alkyl group having 1 to 4 carbon atoms.

Specific examples of the monovalent heterocyclic residue include furyl group, 4-methylfuryl group, benzofuryl group and benzothiophenyl group. Among these groups, the furyl group and benzofuryl group are more preferable.

Examples of the chain alkylene group represented by $Y^1$, $Y^2$, $Y^3$, $Y^4$, $Y^5$ or $Y^6$ which may have substituent(s) include alkylene groups which may be substituted with an alkyl group having 1 to 4 carbon atoms.

Specific examples of the chain alkylene group include methylene group, ethylene group, propylene group and 2,2-dimethylpropylene group. Among these groups, the methylene group and ethylene group are more preferable.

Examples of the arylene group represented by $Ar^5$ or $Ar^6$ which may have substituent(s) in Z include arylene groups which may be substituted with an alkyl group having 1 to 4 carbon atoms or an alkoxy group having 1 to 4 carbon atoms.

Specific examples of the arylene group include p-phenylene group, m-phenylene group, methyl-p-phenylene group, methoxy-p-phenylene group, 1,4-naphthylene group, benzoxazolene group and biphenylilene group. Among these groups, the p-phenylene group, m-phenylene group, methyl-p-phenylene group, methoxy-p-phenylene group and 1,4-naphthylene group are preferable and a p-phenylene group and 1,4-naphthylene group are even more preferable.

Examples of the divalent heterocyclic residue represented by $Ar^5$ or $Ar^6$ which may have substituent(s) in Z include 1,4-furandiyl group, 1,4-thiophenediyl group, 2,5-benzofurandiyl group, 2,5-benzoxazolediyl group and N-ethylcarbazole-3,6-diyl group.

Examples of the cyclic alkylene group represented by W which may have substituent(s) in Z include cycloalkylidene groups which may be substituted with an alkyl group having 1 to 4 carbon atoms.

Specific examples of the cyclic alkylene group include cyclohexylidenyl group, 4,4-dimethylcyclohexylidenyl group and cyclopentylidenyl group. Among these groups, the cycloalkylinyl group is more preferable.

Examples of the chain or branched alkylene group which may have substituent(s) include alkylene groups which may be substituted with an alkyl group having 1 to 4 carbon atoms.

Specific examples of the alkylene group include methylene group, ethylene group, propylene group and 2,2-dimethylpropylene group. Among these groups, the methylene group and ethylene group are more preferable.

More specifically, examples of the diamine compound include diamine-based compounds represented by the above formula (1), sub-formula (2) or sub-formula (3) in which;

the above $Ar^1$, $Ar^2$, $Ar^3$ or $Ar^4$ each independently represent a group selected from the group consisting of groups represented by the following formula:

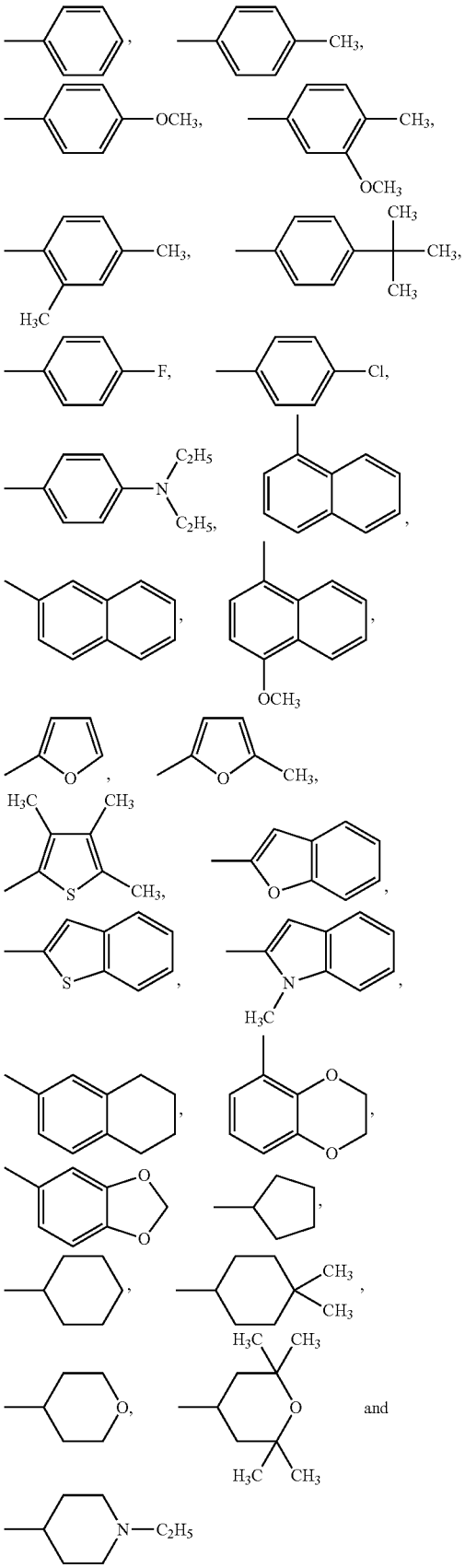

the above $Ar^5$ or $Ar^6$ represents a substituent selected from the group consisting of groups represented by the following formula:

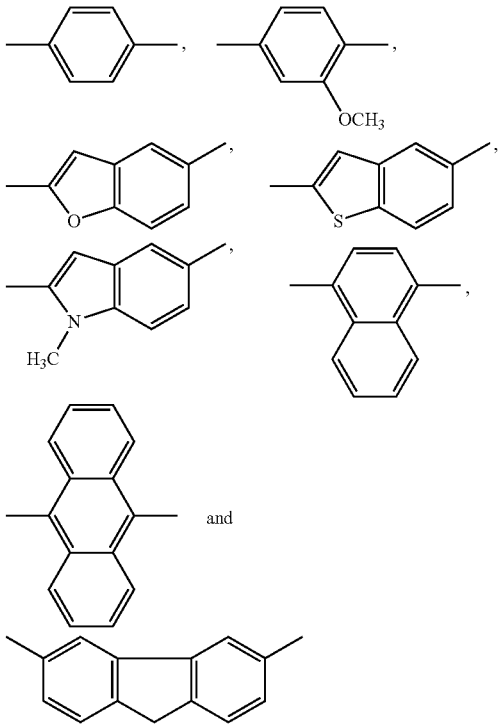

the above W is an oxygen atom or a sulfur atom, or a divalent group selected from the group consisting of methylene, ethylene, trimethylene, 2,2-dimethyltrimethylene, 1,1-cyclopentylene, 1,1-cyclohexylene, 1,4-cyclohexylene, 4,4-dimethylcyclohexylene, 2,2-difluorotrimethylene and 2,2-ditrifluoromethyltrimethylene groups; and the above $Y^1$, $Y^2$, $Y^3$, $Y^4$, $Y^5$ and $Y^6$ each independently represent a divalent group selected from the group consisting of a methylene, ethylene, trimethylene and 2,2-dimethyltrimethylene groups.

Also, the present invention is characterized by the feature that the above electrophotographic photoconductor contains, as the binder resin, a polyarylate resin having a structural unit represented by the following formula:

(I)

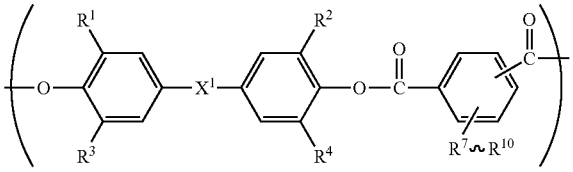

wherein, $X^1$ represents a connecting group or —$CR^5R^6$— wherein $R^5$ and $R^6$ each independently represent a hydrogen atom, a halogen atom or an alkyl or aryl group which may have substituent(s) or $R^5$ and $R^6$ may be combined together with the carbon atom with which these groups are connected to form a cyclic structure;

$R^1$, $R^2$, $R^3$ and $R^4$ each independently represent a hydrogen atom, a halogen atom or an alkyl or aryl group which may have substituent(s); and $R^7$, $R^8$, $R^9$ and $R^{10}$ each independently represent a hydrogen atom, a halogen atom or an alkyl or aryl group which may have substituent(s).

In the present invention, the term "connecting group" means that the benzene rings on each side of $X^1$ are connected directly with each other. In the formula (I), Specific examples of the above structural unit represented by the formula (I) in which $X^1$ is a connecting group include structural units represented by the structural formulae (1-20) shown in the table below.

Specific examples of $R^5$ and $R^6$ include, besides a hydrogen atom, halogen atoms such as a fluorine atom and chlorine atom, lower alkyl groups such as methyl, trifluoromethyl, isopropyl and butyl, and aryl groups such as phenyl, tolyl, α-naphthyl and β-naphthyl.

Specific examples of the cyclic structure formed by a combination of $R^5$ and $R^6$ together with the carbon atom with which $R^5$ and $R^6$ are connected may include cycloalkylidene groups such as cyclohexylidene and cyclopentylidene, fluorenylidene groups and divalent groups obtained by eliminating two hydrocarbon atoms connected with the cyclic carbon atoms of a monocyclic or polycyclic hydrocarbon such as a 1,2,3,4-tetrahydro-2-naphthylidene group.

Also, $R^1$, $R^2$, $R^3$ and $R^4$ in the formula (1) each independently represent a hydrogen atom, a halogen atom, or a lower alkyl group or aryl group which may have substituent(s).

Specific examples of $R^1$, $R^2$, $R^3$ and $R^4$ may include, besides a hydrogen atom, halogen atoms such as a fluorine atom and chlorine atom, lower alkyl groups such as methyl, trifluoromethyl, isopropyl and butyl and aryl groups such as phenyl, tolyl, α-naphthyl and β-naphthyl.

Also, $R^7$, $R^8$, $R^9$ and $R^{10}$ in the formula (I) each independently represent a hydrogen atom, a halogen atom, or a lower alkyl or aryl group which may have substituent(s).

Specific examples of $R^7$, $R^8$, $R^9$ and $R^{10}$ may include, besides a hydrogen atom, halogen atoms such as a fluorine atom and chlorine atom, alkyl groups such as methyl, trifluoromethyl, isopropyl and butyl and aryl groups such as phenyl, α-naphthyl and β-naphthyl.

More specifically, examples of the polyarylate resin having a structural unit represented by the formula (I) include polyarylate resins each having a structural unit represented by the formula (I) in which $X^1$ represents a connecting group or —$CR^5R^6$— wherein $R^5$ and $R^6$ each independently represent a hydrogen atom, a halogen atom or a lower alkyl or aryl group which may have substituent(s) or $R^5$ and $R^6$ may be combined together with the carbon atom with which these groups are connected to form a cyclic structure;

$R^1$, $R^2$, $R^3$ and $R^4$ each independently represent a hydrogen atom, a halogen atom or a lower alkyl or aryl group which may have substituent(s); and $R^7$, $R^8$, $R^9$ and $R^{10}$ each independently represent a hydrogen atom, a halogen atom or an alkyl or aryl group which may have substituent(s).

Even more specifically, examples of the polyarylate resin having a structural unit represented by the formula (I) include polyarylate resins each having a structural unit represented by the formula (I) in which $X^1$ represents a connecting group or —$CR^5R^6$— wherein $R^5$ and $R^6$ each independently represent a hydrogen atom, or a methyl, trifluoromethyl, phenyl or p-tolyl group, or $R^5$ and $R^6$ may be combined together with the carbon atom with which these groups are connected to form 1,1-cyclohexylene or 5,6,7,8-tetrahydro-6-naphthylidene group;

$R^1$, $R^2$, $R^3$ and $R^4$ each independently represent a hydrogen atom, a fluorine atom, a chlorine atom, or a methyl, ethyl, trifluoromethyl, phenyl or p-tolyl group; and $R^7$, $R^8$, $R^9$ and $R^{10}$ each independently represent a hydrogen atom, a fluorine atom, a chlorine atom, or a methyl, ethyl or trifluoromethyl group.

Also, the present invention is characterized by the feature that the above photosensitive layer when the above electrophotographic photoconductor includes the above monolayer type photosensitive layer or the above charge transfer layer when the above electrophotographic photoconductor includes the above laminate type photosensitive layer contains an enamine compound represented by the following formula (4) as the charge transport material:

(4)

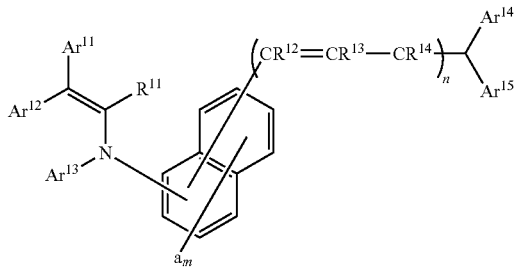

wherein, $Ar^{11}$ and $Ar^{12}$ each independently represent an aryl or heterocyclic group which may have substituent(s); $Ar^{13}$ represents an aryl, heterocyclic, aralkyl or alkyl group; $Ar^{14}$ and $Ar^{15}$ each independently represent a hydrogen atom or an aryl, heterocyclic, aralkyl or alkyl group which may have substituent(s), provided that $Ar^{14}$ and $Ar^{15}$ are not a hydrogen atom at the same time and may be combined together with the carbon atom with which they are connected to form a cyclic structure including an atom or an atomic group; "a" represents a hydrogen atom, a halogen atom, or an alkyl, alkoxy, dialkylamino or aryl group which may have substituent(s); "m" denotes an integer from 1 to 6, provided that when "m" is 2 or more, plural "a(s)", which may the same or different, may be combined together with the carbon atom with which they are connected to form a cyclic structure; $R^{11}$ represents a hydrogen atom, a halogen atom or an alkyl group which may have substituent(s); $R^{12}$, $R^{13}$ and $R^{14}$ each independently represent a hydrogen atom or an alkyl, aryl, heterocyclic or aralkyl group which may have substituent(s); "n" denotes an integer from 0 to 3, plural $R^{12}$s may be the same or different and plural $R^{13}$s may be the same or different when "n" is 2 or 3, provided that $Ar^{13}$ represents a heterocyclic group which may have substituent(s) when "n" is 0.

More specifically, the charge transport material in the photoconductor of the present invention more preferably contains the enamine compound represented by the formula (4) in which the following partial structure represented by the following formula:

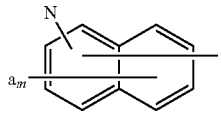

is a substituent selected from the group consisting of substituents represented by the following formulae:

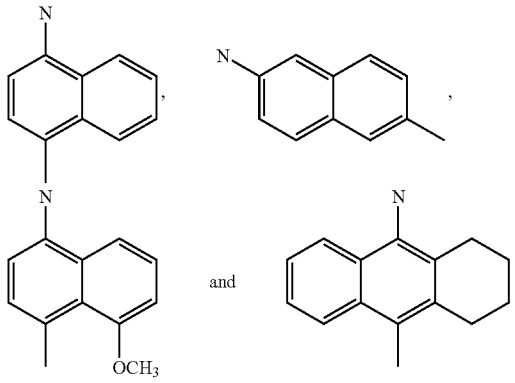

the, $Ar^{11}$, $Ar^{12}$, $Ar^{13}$, $Ar^{14}$ and $Ar^{15}$ each independently represent a group selected from a hydrogen atom and a methyl, phenyl, 3-methylphenyl, 4-methylphenyl and 4-methoxyphenyl groups;

$R^{11}$, $R^{12}$, $R^{13}$ and $R^{14}$ represent a hydrogen atom; and n is 1.

The enamine-based compound represented by the formula (4) has the characteristics that it has a high charging potential, is highly sensitive and exhibits satisfactory response ability and is not deteriorated in these electric properties even in repeated use because it has excellent charge mobility and is also superior in abrasion resistance.

The above enamine compound may be synthesized by, for example, the method described in the publication of JP-A 2004-151666.

Specific examples of the above diamine compound are shown in the following tables. In the following Tables 1-1 to 1-6, the substituents are represented by the following abbreviations:

-Me-: Methylene group;

-Et-: Ethylene group;

-Tr-: Trimethylene group; and

-Dm-: 2,2-dimethyltrimethylene group.

TABLE 1-1

(1)

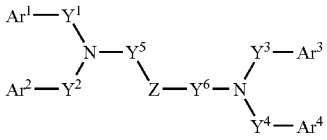

| No | $Ar^1$ | $Ar^2$ | $Ar^3$ | $Ar^4$ |
|---|---|---|---|---|
| 1 | | | | |
| 2 | | | | |
| 3 | $CH_3$ | $CH_3$ | $CH_3$ | $CH_3$ |
| 4 | $OCH_3$ | $OCH_3$ | $OCH_3$ | $OCH_3$ |
| 5 | | | $CH_3$ | $CH_3$ |
| 6 | | $OCH_3$ | | $OCH_3$ |
| 7 | $CH_3$, $OCH_3$ | $CH_3$, $OCH_3$ | $CH_3$, $OCH_3$ | $CH_3$, $OCH_3$ |

TABLE 1-1-continued
| | | | | |
|---|---|---|---|---|
| 8 | 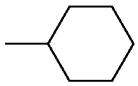 | 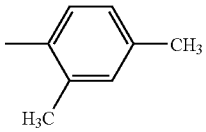 | 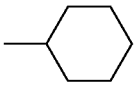 | 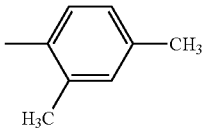 |
| 9 | 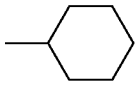 | 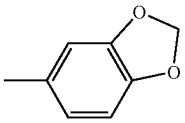 | 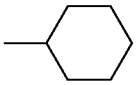 | 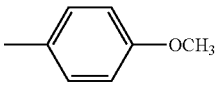 |
| 10 | 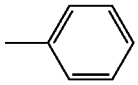 | 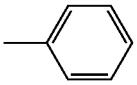 | 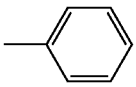 | 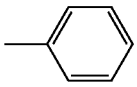 |
| | | | | | | | Z | | |
|---|---|---|---|---|---|---|---|---|---|
| No | $Y^1$ | $Y^2$ | $Y^3$ | $Y^4$ | $Y^5$ | $Y^6$ | $Ar^5$ | $Ar^6$ | W |
| 1 | —Me— | —Me— | —Me— | —Me— | —Me— | —Me— | 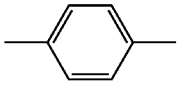 | 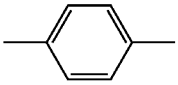 | — |
| 2 | —Me— | —Me— | —Me— | —Me— | —Me— | —Me— | 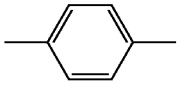 | — | — |
| 3 | —Me— | —Me— | —Me— | —Me— | —Me— | —Me— | 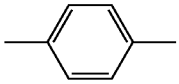 | 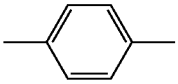 | — |
| 4 | —Me— | —Me— | —Me— | —Me— | —Me— | —Me— | 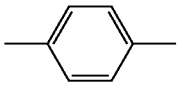 | 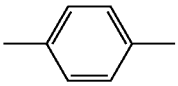 | — |
| 5 | —Me— | —Me— | —Et— | —Et— | —Me— | —Me— | 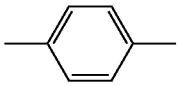 | 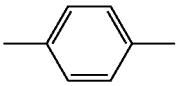 | — |
| 6 | —Me— | —Me— | —Me— | —Me— | —Me— | —Me— | 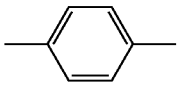 | 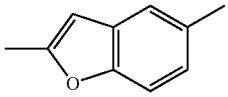 | — |
| 7 | —Et— | —Et— | —Me— | —Me— | —Me— | —Me— | 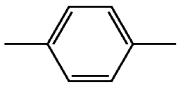 | 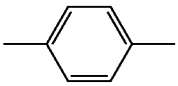 | — |
| 8 | —Me— | —Me— | —Me— | —Me— | —Me— | —Me— | 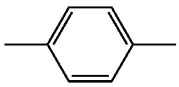 | 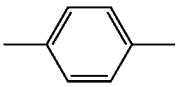 | — |
| 9 | —Me— | —Me— | —Me— | —Me— | —Me— | —Me— | 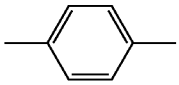 | 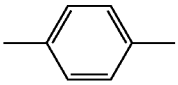 | — |
| 10 | —Me— | —Me— | —Me— | —Me— | —Me— | —Me— | 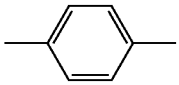 | 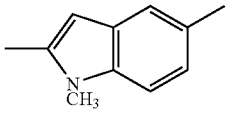 | — |

TABLE 1-2
| No | $Ar^1$ | $Ar^2$ | $Ar^3$ | $Ar^4$ |
|---|---|---|---|---|
| 11 | 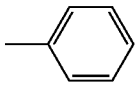 | 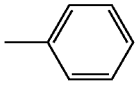 | 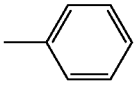 | 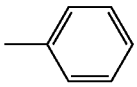 |
| 12 | 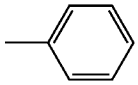 | 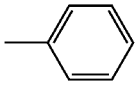 | 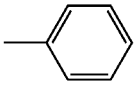 | 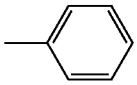 |
| 13 | 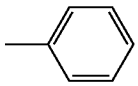 | 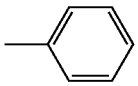 | 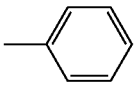 | 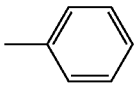 |
| 14 | 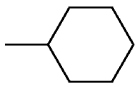 | 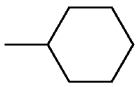 | 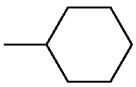 | 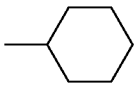 |
| 15 | 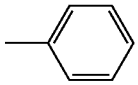 | 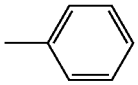 | 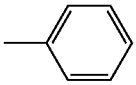 | 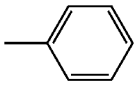 |
| 16 | 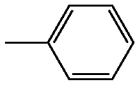 | 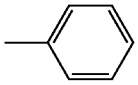 | 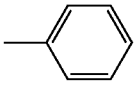 | 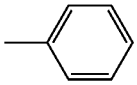 |
| 17 | 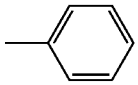 | 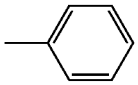 | 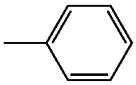 | 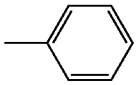 |
| 18 | 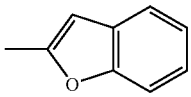 | 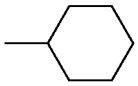 | 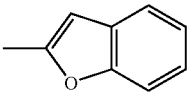 | 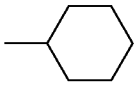 |
| 19 | 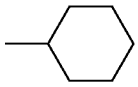 | 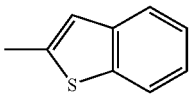 | 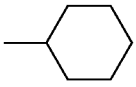 | 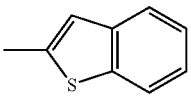 |
| 20 | 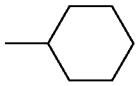 | 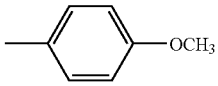 | 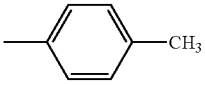 | 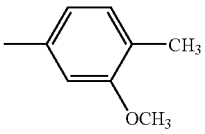 |
| No | $Y^1$ | $Y^2$ | $Y^3$ | $Y^4$ | $Y^5$ | $Y^6$ | Z | | |
|---|---|---|---|---|---|---|---|---|---|
| | | | | | | | $Ar^5$ | $Ar^6$ | W |
| 11 | —Me— | —Me— | —Me— | —Me— | —Me— | —Me— | 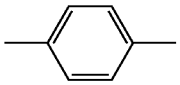 | 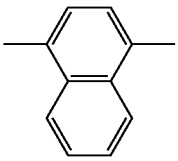 | — |
| 12 | —Me— | —Me— | —Me— | —Me— | —Me— | —Me— | 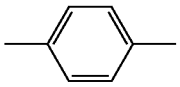 | 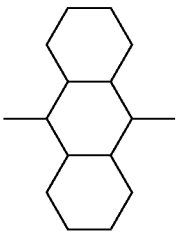 | — |

TABLE 1-2-continued

| | | | | | | | | | |
|---|---|---|---|---|---|---|---|---|---|
| 13 | —Me— | —Me— | —Me— | —Me— | —Me— | —Me— | | | — |
| 14 | —Me— | —Me— | —Me— | —Me— | —Me— | —Me— | | | — |
| 15 | —Me— | —Me— | —Me— | —Me— | —Me— | —Me— | | $OCH_3$ | — |
| 16 | —Me— | —Me— | —Me— | —Me— | —Me— | —Me— | | S | — |
| 17 | —Me— | —Me— | —Me— | —Me— | —Me— | —Me— | | N $CH_3$ | — |
| 18 | —Me— | —Me— | —Me— | —Me— | —Me— | —Me— | | | — |
| 19 | —Me— | —Me— | —Me— | —Me— | —Me— | —Me— | | | — |
| 20 | —Me— | —Me— | —Me— | —Me— | —Me— | —Me— | | | — |

TABLE 1-3

| No | $Ar^1$ | $Ar^2$ | $Ar^3$ | $Ar^4$ |
|---|---|---|---|---|
| 21 | O | O | O | O |
| 22 | | | | |
| 23 | | | | |
| 24 | | | | |
| 25 | | | | |

TABLE 1-3-continued
| | | | | |
|---|---|---|---|---|
| 26 | 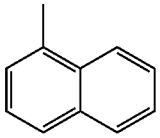 | 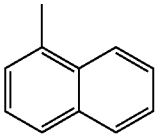 | 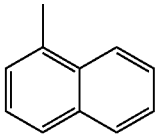 | 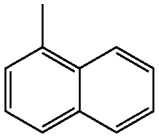 |
| 27 | 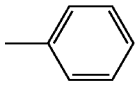 | 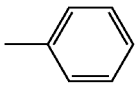 | 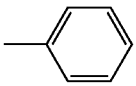 | 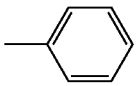 |
| 28 | 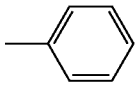 | 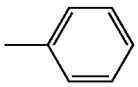 | 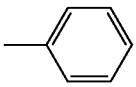 | 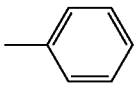 |
| 29 | 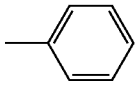 | 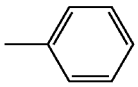 | 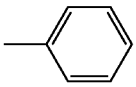 | 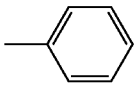 |
| 30 | 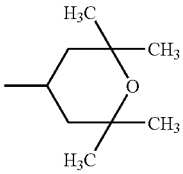 | 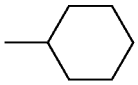 | 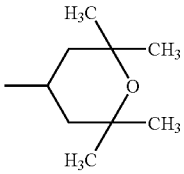 | 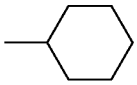 |
| | | | | | | | Z | | |
|---|---|---|---|---|---|---|---|---|---|
| No | $Y^1$ | $Y^2$ | $Y^3$ | $Y^4$ | $Y^5$ | $Y^6$ | $Ar^5$ | $Ar^6$ | W |
| 21 | —Me— | —Me— | —Me— | —Me— | —Me— | —Me— | 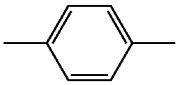 | 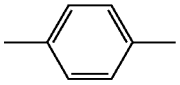 | — |
| 22 | —Me— | —Et— | —Me— | —Et— | —Me— | —Me— | 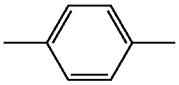 | 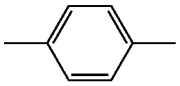 | — |
| 23 | —Me— | —Et— | —Me— | —Et— | —Et— | —Et— | 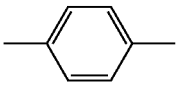 | 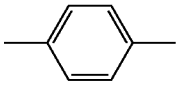 | — |
| 24 | —Me— | —Et— | —Me— | -Dm- | —Me— | —Me— | 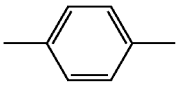 | 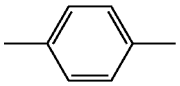 | — |
| 25 | —Me— | —Me— | —Me— | —Me— | —Et— | —Et— | 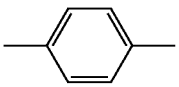 | 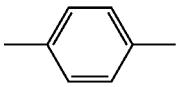 | — |
| 26 | —Me— | —Me— | —Me— | —Me— | —Me— | —Me— | 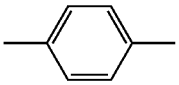 | 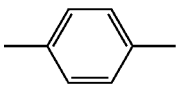 | — |
| 27 | -Dm- | —Me— | —Me— | —Me— | —Me— | —Me— | 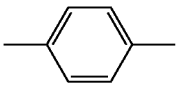 | 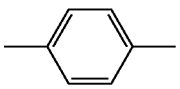 | — |
| 28 | -Dm- | —Me— | -Dm- | —Me— | —Me— | —Me— | 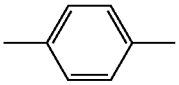 | 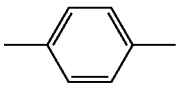 | — |
| 29 | —Et— | —Et— | —Et— | —Et— | —Et— | —Et— | 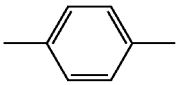 | 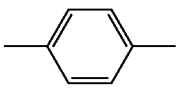 | — |

TABLE 1-3-continued
| | | | | | | | | | |
|---|---|---|---|---|---|---|---|---|---|
| 30 | —Et— | —Et— | —Me— | —Me— | —Et— | —Et— | 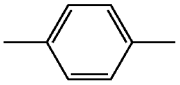 | 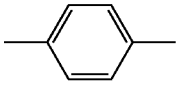 | — |
TABLE 1-4
| No | $Ar^1$ | $Ar^2$ | $Ar^3$ | $Ar^4$ | $Y^1$ | $Y^2$ |
|---|---|---|---|---|---|---|
| 31 | 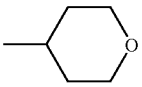 | 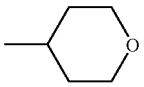 | 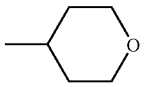 | 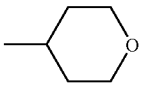 | -Me- | -Me- |
| 32 | 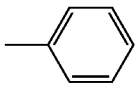 | 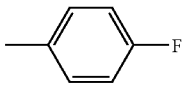 | 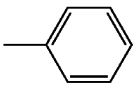 | 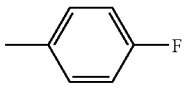 | -Me- | -Me- |
| 33 | 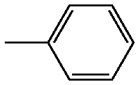 | 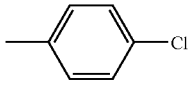 | 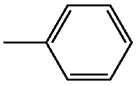 | 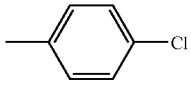 | -Me- | -Me- |
| 34 | 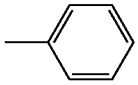 | 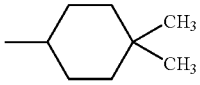 | 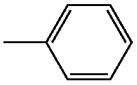 | 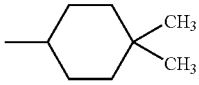 | -Me- | -Me- |
| 35 | 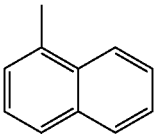 | 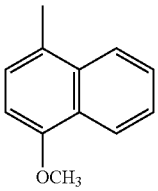 | 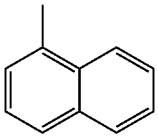 | 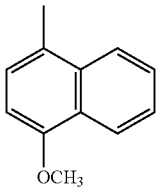 | -Me- | -Me- |
| 36 | 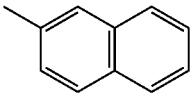 | 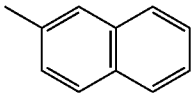 | 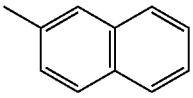 | 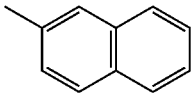 | -Me- | -Me- |
| 37 | 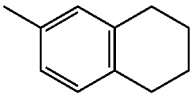 | 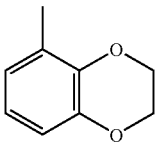 | 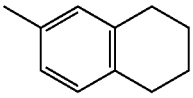 | 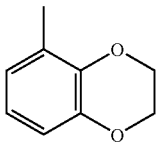 | -Me- | -Me- |
| 38 | 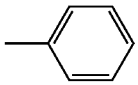 | 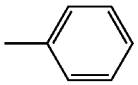 | 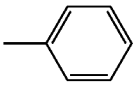 | 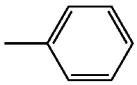 | -Me- | -Me- |
| 39 | 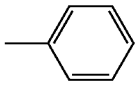 | 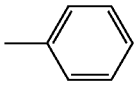 | 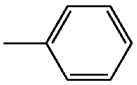 | 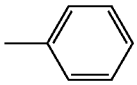 | -Me- | -Me- |
| 40 | 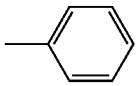 | 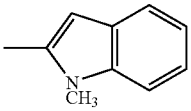 | 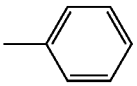 | 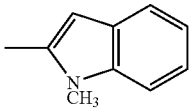 | -Me- | -Me- |
| | | | | | Z | | |
|---|---|---|---|---|---|---|---|
| No | $Y^3$ | $Y^4$ | $Y^5$ | $Y^6$ | $Ar^5$ | $Ar^6$ | W |
| 31 | -Me- | -Me- | -Me- | -Me- | 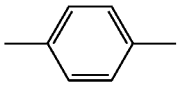 | 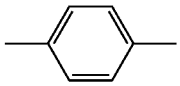 | — |

TABLE 1-4-continued
| | | | | | | | |
|---|---|---|---|---|---|---|---|
| 32 | -Me- | -Me- | -Me- | -Me- | 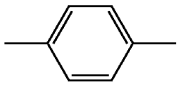 | 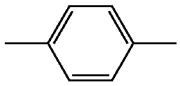 | — |
| 33 | -Me- | -Me- | -Me- | -Me- | 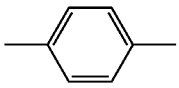 | 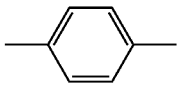 | — |
| 34 | -Me- | -Me- | -Me- | -Me- | 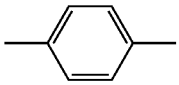 | 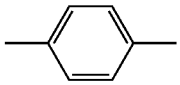 | — |
| 35 | -Me- | -Me- | -Me- | -Me- | 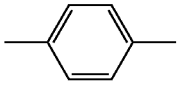 | 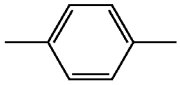 | — |
| 36 | -Me- | -Me- | -Me- | -Me- | 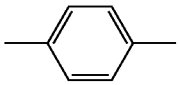 | 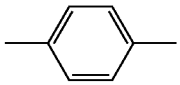 | — |
| 37 | -Me- | -Me- | -Me- | -Me- | 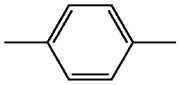 | 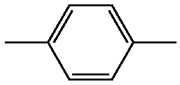 | — |
| 38 | -Me- | -Me- | -Me- | -Me- | 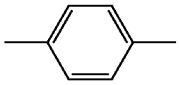 | 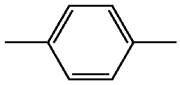 | O |
| 39 | -Me- | -Me- | -Me- | -Me- | 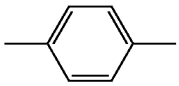 | 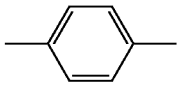 | 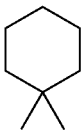 |
| 40 | -Me- | -Me- | -Me- | -Me- | 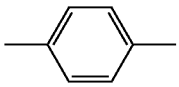 | 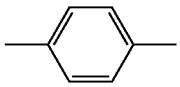 | 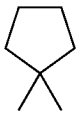 |
TABLE 1-5
| No | $Ar^1$ | $Ar^2$ | $Ar^3$ | $Ar^4$ | $Y^1$ | $Y^2$ |
|---|---|---|---|---|---|---|
| 41 | 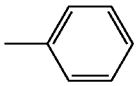 | 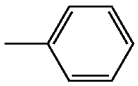 | 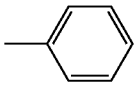 | 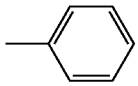 | -Me- | -Me- |
| 42 | 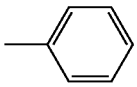 | 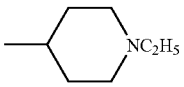 $NC_2H_5$ | 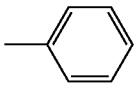 | 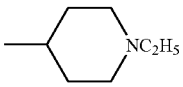 $NC_2H_5$ | -Me- | -Me- |
| 43 | 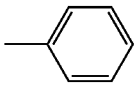 | 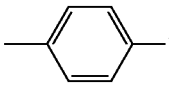 $N(C_2H_5)_2$ | 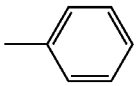 | 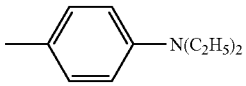 $N(C_2H_5)_2$ | -Me- | -Me- |
| 44 | 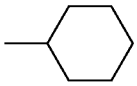 | 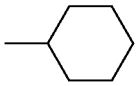 | 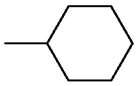 | 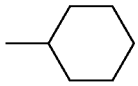 | -Me- | -Me- |
| 45 | 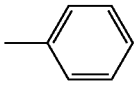 | 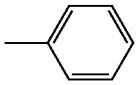 | 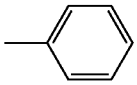 | 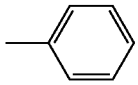 | -Dm- | -Me- |

TABLE 1-5-continued
| | | | | | | |
|---|---|---|---|---|---|---|
| 46 | 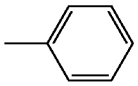 | 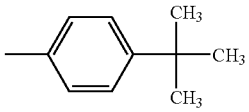 | 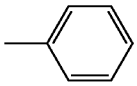 | 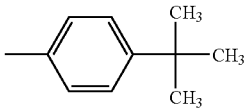 | -Dm- | -Me- |
| 47 | 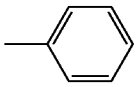 | 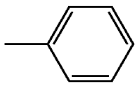 | 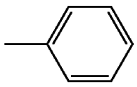 | 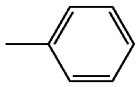 | -Et- | -Et- |
| 48 | 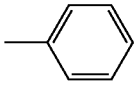 | 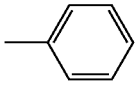 | 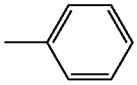 | 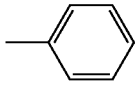 | -Et- | -Et- |
| 49 | 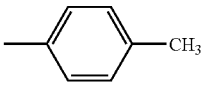 | 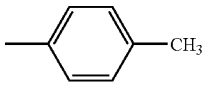 | 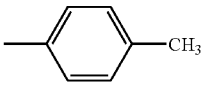 | 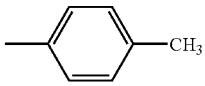 | -Me- | -Me- |
| 50 | 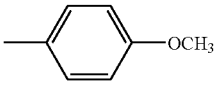 | 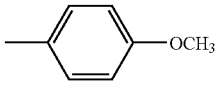 | 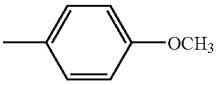 | 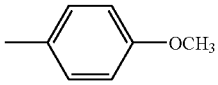 | -Me- | -Me- |
| | | | | | Z | | |
|---|---|---|---|---|---|---|---|
| No | $Y^3$ | $Y^4$ | $Y^5$ | $Y^6$ | $Ar^5$ | $Ar^6$ | W |
| 41 | -Me- | -Me- | -Me- | -Me- | 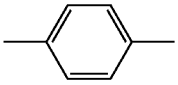 | 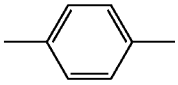 | -Et- |
| 42 | -Me- | -Me- | -Me- | -Me- | 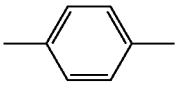 | 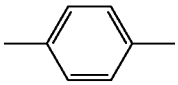 | -Et- |
| 43 | -Me- | -Me- | -Et- | -Et- | 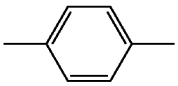 | 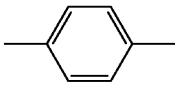 | S |
| 44 | -Me- | -Me- | -Me- | -Me- | 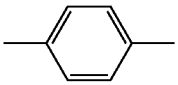 | 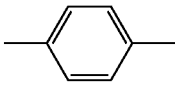 | 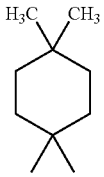 |
| 45 | -Me- | -Me- | -Me- | -Me- | 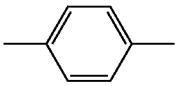 | 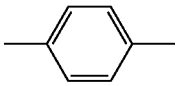 | 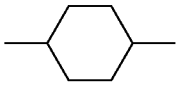 |
| 46 | -Dm- | -Me- | -Me- | -Me- | 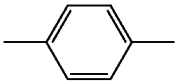 | 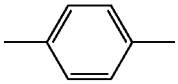 | -Et- |
| 47 | -Et- | -Et- | -Et- | -Et- | 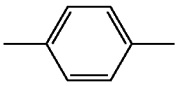 | 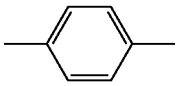 | -Et- |
| 48 | -Me- | -Me- | -Et- | -Et- | 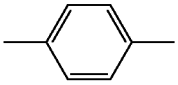 | 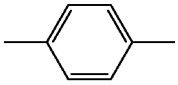 | -Et- |
| 49 | -Me- | -Me- | -Me- | -Me- | 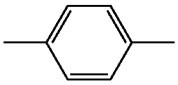 | 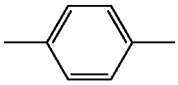 | -Me- |

TABLE 1-5-continued
| | | | | | | | |
|---|---|---|---|---|---|---|---|
| 50 | -Me- | -Me- | -Me- | -Me- | 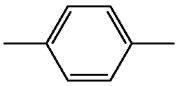 | 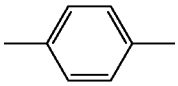 | 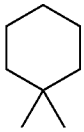 |
TABLE 1-6
| No | $Ar^1$ | $Ar^2$ | $Ar^3$ | $Ar^4$ | $Y^1$ | $Y^2$ |
|---|---|---|---|---|---|---|
| 51 | 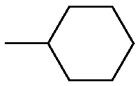 | 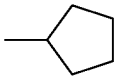 | 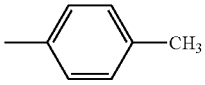 | 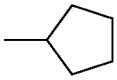 | -Me- | -Me- |
| 52 | 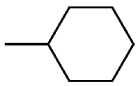 | 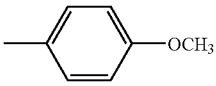 | 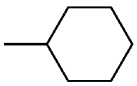 | 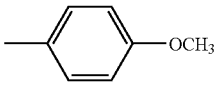 | -Me- | -Me- |
| 53 | 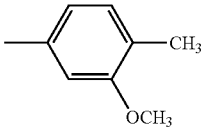 | 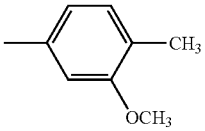 | 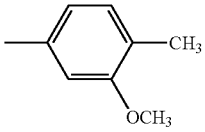 | 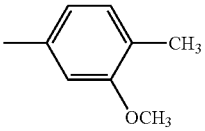 | -Me- | -Me- |
| 54 | 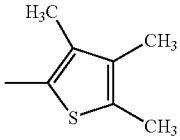 | 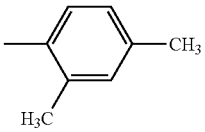 | 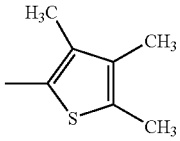 | 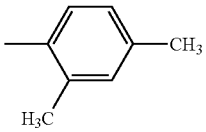 | -Me- | -Me- |
| 55 | 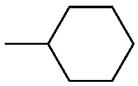 | 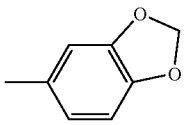 | 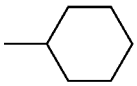 | 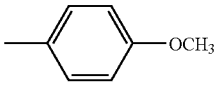 | -Me- | -Me- |
| 56 | 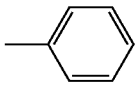 | 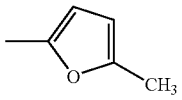 | 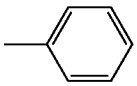 | 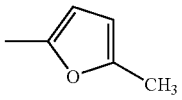 | -Me- | -Me- |
| 57 | 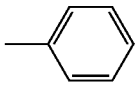 | 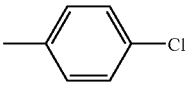 | 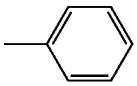 | 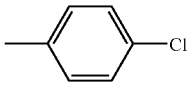 | -Me- | -Me- |
| 58 | 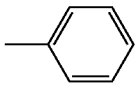 | 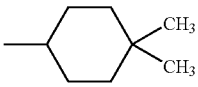 | 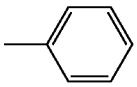 | 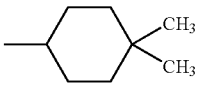 | -Me- | -Me- |
| 59 | 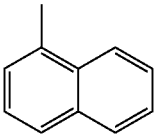 | 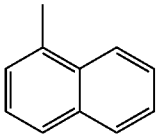 | 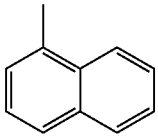 | 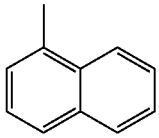 | -Me- | -Me- |
| 60 | 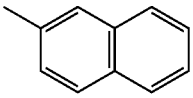 | 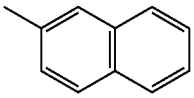 | 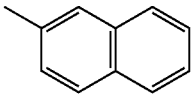 | 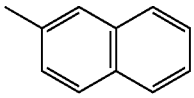 | -Me- | -Me- |
| 61 | 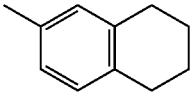 | 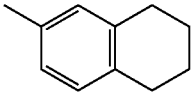 | 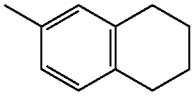 | 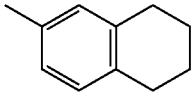 | -Me- | -Me- |

TABLE 1-6-continued
| No | $Y^3$ | $Y^4$ | $Y^5$ | $Y^6$ | Z | | |
|---|---|---|---|---|---|---|---|
| | | | | | $Ar^5$ | $Ar^6$ | W |
| 51 | -Me- | -Me- | -Me- | -Me- | 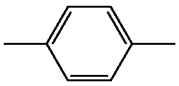 | 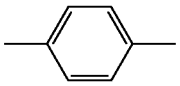 | 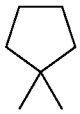 |
| 52 | -Me- | -Me- | -Me- | -Me- | 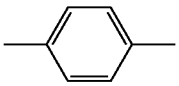 | 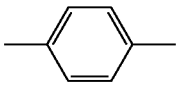 | -Dm- |
| 53 | -Me- | -Me- | -Me- | -Me- | 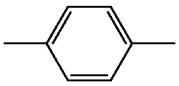 | 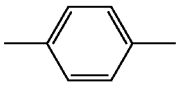 | -Et- |
| 54 | -Me- | -Me- | -Me- | -Me- | 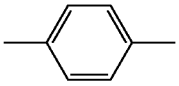 | 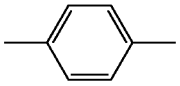 | -Tr- |
| 55 | -Me- | -Me- | -Me- | -Me- | 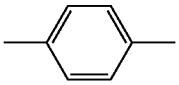 | 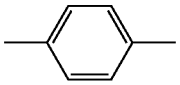 | -Et- |
| 56 | -Me- | -Me- | -Me- | -Me- | 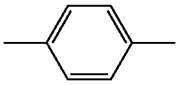 | 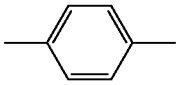 | 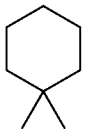 |
| 57 | -Me- | -Me- | -Me- | -Me- | 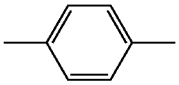 | 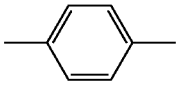 | -Et- |
| 58 | -Me- | -Me- | -Me- | -Me- | 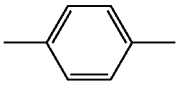 | 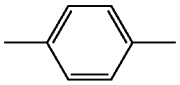 | -Dm- |
| 59 | -Me- | -Me- | -Me- | -Me- | 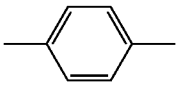 | 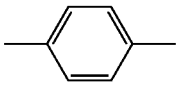 | —$CH_2CF_2CH_2$— |
| 60 | -Me- | -Me- | -Me- | -Me- | 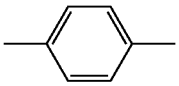 | 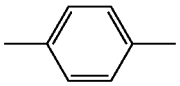 | —$CH_2C(CF_3)_2CH_2$— |
| 61 | -Me- | -Me- | -Me- | -Me- | 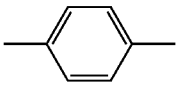 | 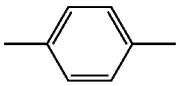 | -Et- |

Among the diamine compounds according to the present invention as shown in the above Tables 1-1 to 1-6, the exemplified compounds Nos. 1, 2, 4, 8, 14, 22, 29, 38, 50, 53 and 57 are preferable, the exemplified compounds Nos. 1 and 2 are more preferable and exemplified compound No. 2 is even more preferable from the viewpoint of effects.

The diamine compound according to the present invention may be produced using the method shown by the following reaction scheme.

Specifically, the above diamine compound having high purity may be produced simply in a high yield by heating in the presence of an organic amine base an amine compound represented by the following formula (6):

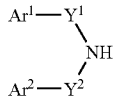

(6)

wherein $Ar^1$, $Ar^2$, $Y^1$ and $Y^2$ have the same meanings as those in the formula (1);

the amine compound represented by the following formula (7):

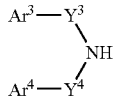

(7)

wherein $Ar^3$, $Ar^4$, $Y^3$ and $Y^4$ have the same meanings as those in the formula (1); and the dihalogen compound represented by the following formula (8):

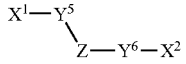

(8)

wherein $Y^5$, $Y^6$ and Z have the same meanings as those in the formula (1) and $X^1$ and $X^2$, which may be the same or different, each independently represent a halogen atom.

Examples of the halogen atom represented by $X^1$ or $X^2$ include chlorine atom, bromine atom and iodine atom. Among these atoms, a chlorine atom and bromine atom are preferable from the viewpoint of handling easiness and reactivity.

A specific reaction formula will be shown below.

(Reaction formula)

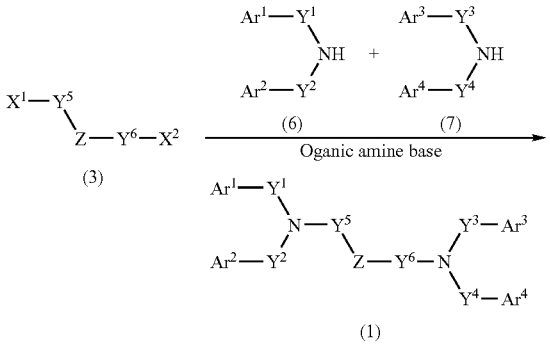

wherein, $Ar^1$, $Ar^2$, $Ar^3$, $Ar^4$, $Y^1$, $Y^2$, $Y^3$, $Y^4$, $Y^5$, $Y^6$ and Z have the same meanings as those defined in the formula (1); and $X^1$ and $X^2$ have the same meanings as those defined in the formula (8).

The reaction of the above reaction scheme may be undergone as follows.

The secondary amine compounds (6) and (7) and the dihalogen compound (8) are dissolved or dispersed in a solvent and an organic amine base is added to the solution, which is then heated with stirring. After the reaction is completed, the precipitate is separated by filtration and recrystallized from a solvent obtained using ethanol, methanol and ethyl acetate singly or in combinations of two or more. A target product with high purity can be obtained simply in a high yield.

Any solvent may be used as the above solvent without any particular limitation insofar as it is inert to the above reaction and can solve or disperse the above reaction substrate and organic amine base.

Specific examples of the solvent include aromatic hydrocarbons such as toluene and xylene; ethers such as diethyl ether, tetrahydrofuran, ethylene glycol dimethyl ether and 1,4-dioxane; amides such as N,N-dimethylformamide; and sulfoxides such as dimethylsulfoxide. These solvents may be used either singly or as a mixture of two or more.

There is no particular limitation to the amount of the solvent to be used and the amount enabling the reaction to proceed smoothly may be designed corresponding to the reaction condition such as the amount of the reaction substrate, reaction temperature and reaction time.

Examples of the organic amine base include N,N-diisopropylethylamine, N,N-dimethylaminopyridine and 1,4-diazabicycloundecene.

No particular limitation is imposed on the ratio of the secondary amine compounds (6) and (7) to the dihalogen compound (8).

When, for example, a symmetric compound is obtained, that is, when any one of the secondary amine compounds (6) and (7) is used, it is preferable to use the secondary amine compound in a ratio of 2.0 to 2.3 equivalents to one equivalent of the dihalogen compound (8) in consideration of reaction efficiency.

Also, when an asymmetric compound is obtained, that is, when both the secondary amine compounds (6) and (7) are used, it is preferable to use each secondary amine compound in a ratio of 1.0 to 1.2 equivalents, that is, in a total ratio of 2.0 to 2.4 equivalents, to one equivalent of the dihalogen compound (8).

Though no particular limitation is imposed on the ratio of the dihalogen compound (8) to the organic amine base, it is preferable to use the organic amine base in a ratio of 2.05 to 5.0 equivalents to one equivalent of the dihalogen compound (8) in consideration of reaction efficiency.

Also, no particular limitation is imposed on the heating temperature and reaction time. However, it is preferable to undergo the reaction at 60 to 120° C. for 2 to 8 hours though depending on the type of solvent to be used.

The diamine compound used in the present invention can impart oxydizing gas resistance such as ozone resistance and nitrogen oxide resistance to the photoconductor when it is contained in the charge transport layer. This reason is inferred to be that the diamine compound according to the present invention can trap oxidizing gases such as ozone, nitrogen oxides, chlorine oxide and sulfur oxide to thereby restrain the adsorption of these oxidizing gases to the charge generation material efficiently.

Therefore, a photoconductor containing the diamine compound according to the present invention in the charge transport layer of the photosensitive layer has excellent electrophotographic characteristics, is resistant to the influence of ozone and nitrogen oxide generated from the system, and has stable characteristics and imparts stable image quality even if it is used repeatedly, thereby making it possible to achieving very high durability.

Also, when the image forming apparatus is a tandem system color machine, active gases such as ozone and NOx when the photoconductor is charged tend to remain unremoved and therefore, image inferiors are easily caused. For this, an antioxidant is made to coexist, thereby being able to prevent the occurrence of image inferiors.

Therefore, the inventors of the present invention have found that a photoconductor can be provided which overcomes the drawback of the aforementioned tandem system color machine, is resistant to the influence of ozone and nitrogen oxides generated from the system and has stable characteristics and imparts stable image quality even if it is used repeatedly, thereby making it possible to achieve very high durability, by using a combination of the above diamine compound and polyarylate according to the present invention, to complete the present invention.

Specific examples of each substituent of the enamine compound represented by the following formula (4) and used in the present invention are shown in the following Table 2.

TABLE 2

(4)

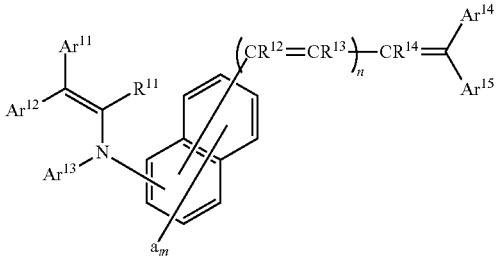

| Exemplified Compound No. | Ar11 | Ar12 | R11 | Ar13 | 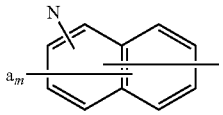 |
|---|---|---|---|---|---|
| 1 | 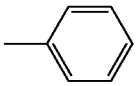 | 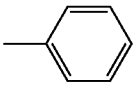 | H | 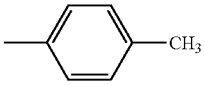 | 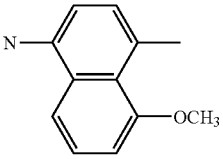 |
| 2 | 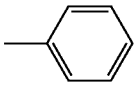 | 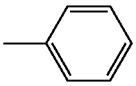 | H | 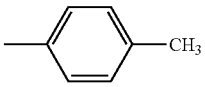 | 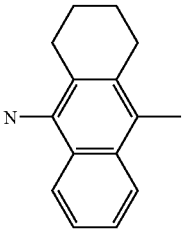 |
| 3 | 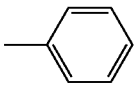 | 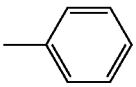 | H | 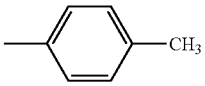 | 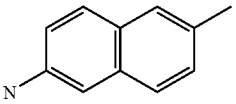 |
| 4 | 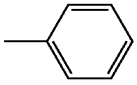 | 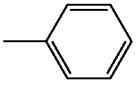 | H | 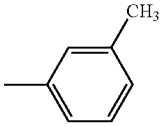 | 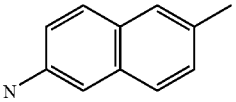 |
| 5 | 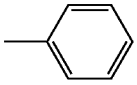 | 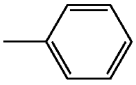 | H | 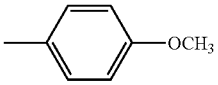 | 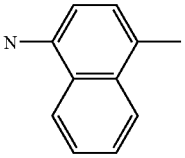 |

TABLE 2-continued

| | | | | | |
|---|---|---|---|---|---|
| 6 | | | H | $OCH_3$ | N |
| 7 | | | H | $OCH_3$ | N |

| Exemplified Compound No. | n | $-(CR^{12}=CR^{13})_n-$ | $R^{14}$ | $Ar^{14}$ | $Ar^{15}$ |
|---|---|---|---|---|---|
| 1 | 1 | CH=CH | H | H | |
| 2 | 1 | CH=CH | H | H | |
| 3 | 1 | CH=CH | H | H | |
| 4 | 1 | CH=CH | H | H | |
| 5 | 1 | CH=CH | H | H | |
| 6 | 1 | CH=CH | H | H | $CH_3$ |
| 7 | 1 | CH=CH | H | $-CH_3$ | $OCH_3$ |

The present invention will be explained in detail.

FIG. 1 is a partial sectional view typically showing the structure of an electrophotographic photoconductor 201 in a first embodiment according to the present invention. The electrophotographic photoconductor 201 (hereinafter abbreviated simply as "photoconductor") of this embodiment has a structure including a cylindrical conductive support 211 and a photosensitive layer 214 formed on the outside peripheral surface of the conductive support 211.

The photosensitive layer 214 has a laminate structure produced by laminating a charge generation layer 215 containing a charge generation material 212 which absorbs light to generate charges and a charge transport layer 216 containing a charge transport material 213 capable of accepting and transporting the charges generated in the charge generation material 212 and a binder resin 217 which binds the charge transport material 213 in this order on the outside peripheral surface of the conductive support 211.

In other words, the electrophotographic photoconductor 201 is a laminate type photoconductor.

Figure 2:
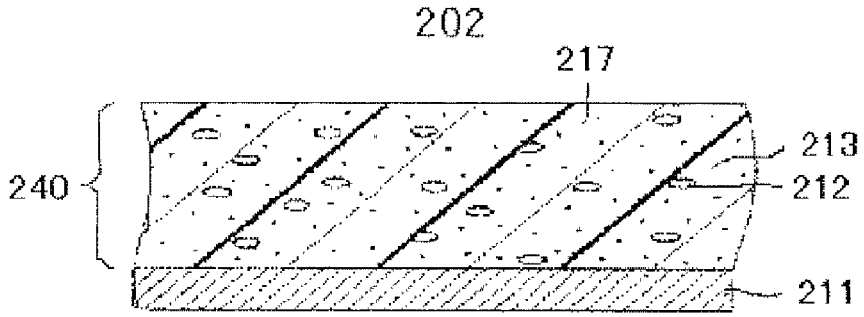
FIG. 2 is a typical sectional view showing the structure of an essential part of a monolayer type photoconductor according to the present invention.

FIG. 2 is a schematic sectional view typically showing the structure of an electrophotographic photoconductor 202 in a second embodiment according to the present invention. The electrophotographic photoconductor 202 of this embodiment is provided with a photosensitive layer 240 having a monolayer structure obtained by binding a charge generation material 212 and a charge transport material 213 by using a binder 217.

In other words, the electrophotographic photoconductor 202 is a monolayer type photoconductor.

Figure 3:
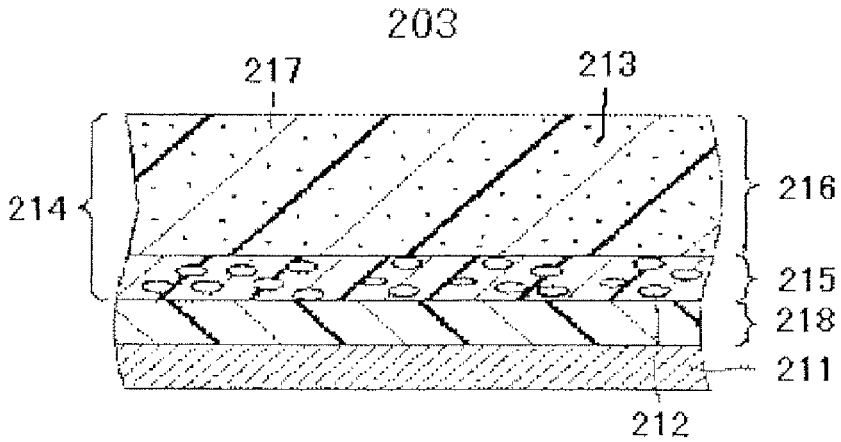
FIG. 3 is a typical sectional view showing the structure of an essential part of other laminate type photoconductor according to the present invention.

FIG. 3 is a schematic sectional view typically showing the structure of an electrophotographic photoconductor 203 in a third embodiment according to the present invention. The electrophotographic photoconductor 203 of this embodiment is characterized by the feature that in the structure of the photoconductor 201 of the first embodiment, an undercoat layer 218 is formed between the conductive support 211 and the charge generation layer 215.

Figure 4:
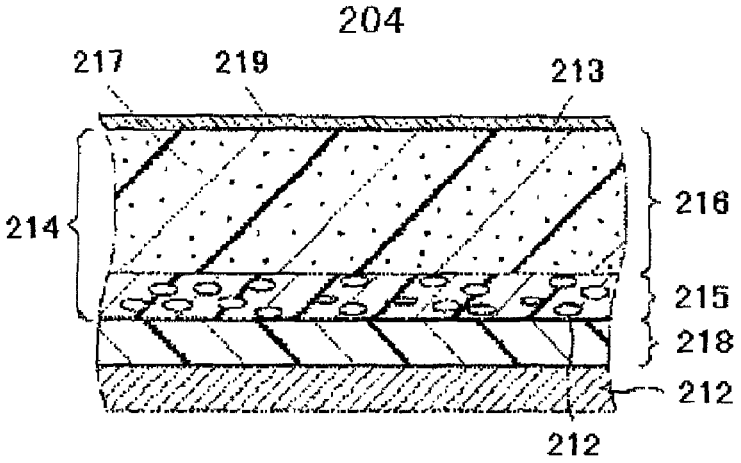
FIG. 4 is a typical sectional view showing the structure of an essential part of a photoconductor provided with a surface protective layer according to the present invention.

FIG. 4 is a schematic sectional view typically showing the structure of an electrophotographic photoconductor 204 in a fourth embodiment according to the present invention. The electrophotographic photoconductor 204 of this embodiment is characterized by the feature that in the structure of the photoconductor 201 of the above first embodiment, a surface protective layer 219 is further formed on the outside surface of the photosensitive layer 214. The surface protective layer 219 may be provided on the outside surface of the photosensitive layer 240 in the monolayer type photoconductor 202 in the second embodiment.

First Embodiment (Conductive Substrate)

The conductive substrate 211 serves as the electrode of the photoconductor, and also functions as the support member of other materials including charge generation layer 215 and the charge transport layer 216 in the case of, for example, a laminate type photoconductor. Also, the conductive substrate (conductive support) 211 and also functions as the support member of the photosensitive layer 240 in a monolayer type photosensitive layer.

Though the conductive substrate 211 preferably has a cylindrical shape, it is not limited to this shape and the conductive substrate 211 may have a columnar form, sheet form or endless belt form.

As the conductive material constituting the conductive substrate 211, for example, a single metal such as aluminum, copper, zinc, nickel or titanium or an alloy such as an aluminum alloy or stainless steel may be used. The conductive material is not limited to these metal materials and may use materials prepared by laminating a metal (aluminum, gold, silver, copper, zinc, nickel or titanium) foil, materials prepared by depositing a metal (aluminum, gold, silver, copper, zinc, nickel or titanium) material or materials prepared by depositing or applying a layer of a conductive compound such as a conductive polymer, tin oxide or indium oxide on the surface of a high-molecular material such as a polyethylene terephthalate, nylon or polystyrene, hard paper or glass. These conductive materials are processed into a prescribed form prior to use.

The surface of the conductive substrate 211 may be processed by anodic oxidation coating treatment, surface treatment using chemicals or hot water, coloring treatment or irregular reflection treatment including roughening of the surface according to the need to the extent that the image quality is not adversely affected. In an electrophotographic process, using a laser as the exposure light source, the wavelengths of the laser light are even. Therefore, there is the case where laser light reflected on the surface of the photoconductor and laser light reflected inside of the photoconductor interfere with each other and an interference fringe generated by the interference appears on an image, causing image defects. The surface of the conductive substrate 211 is subjected to the above treatments, making possible to prevent the image defects caused by the interference of the laser light having even wavelengths.

(Charge Generation Layer)

The charge generation layer 215 contains, as its major component, a charge generation material which absorbs light to generate charges. The major component means that it is contained in an amount enough to develop its major function.

Examples of effective materials as the charge generation material may include organic photoconductive materials, for example, azo-based pigments such as a monoazo-based pigment, bisazo-based pigment and trisazo-based pigment, indigo-based pigments such as indigo or thioindigo, perylene-based pigments such as peryleneimide or perylenic acid anhydride, polycyclic quinone-based pigments such as anthraquinone and pyrenequinone, phthalocyanine-based pigments such as metal phthalocyanine and metal-free phthalocyanine, triphenylmethane-based dyes typified by Methyl Violet, Crystal Violet, Night Blue and Victoria Blue, acridine-based dyes typified by Erythrocin, Rhodamine B, Rhodamine 3R, Acridine Orange and Flapeosine, thiazine-based dyes such as Methylene Blue and Methylene Green, oxazine-based dyes typified by Capri Blue and Meldola's Blue, organic photoconductive materials such as squalilium dyes, pyrylium salts and thiopyrylium salts, thioindigo-based dyes, bisbenzoimidazole-based dyes, quinacridone-based dyes, quinoline-based dyes, lake-based dyes, azo lake-based dyes, dioxazine-based dyes, azulenium-based dyes, triallylmethane-based dyes, xanthene-based dyes, cyanine-based dyes and triphenylmethane-based dyes, and inorganic photoconductive materials such as serene and amorphous silicon. These charge generation materials may be used either singly or in combinations of two or more.

Among the above charge generation materials, it is preferable to use oxotitanium phthalocyanine compounds represented by the following formula (5):

(5)

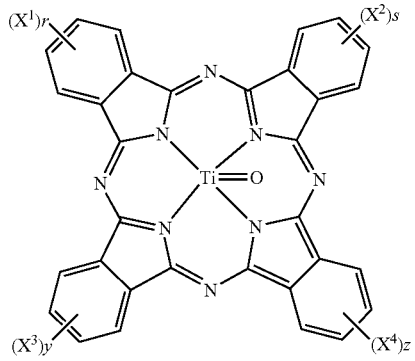

wherein $X^1$, $X^2$, $X^3$ and $X^4$ each independently represent a halogen atom, an alkyl or alkoxy group, and "r", "s", "y" and "z" each denote an integer from 0 to 4.

Examples of the halogen atom represented by $X^1$, $X^2$, $X^3$ or $X^4$ in the above formula (5) include fluorine, chlorine, bromine and iodine atom.

Examples of the alkyl group represented by $X^1$, $X^2$, $X^3$ or $X^4$ include $C_1$ to $C_4$ alkyl groups such as a methyl, ethyl, propyl, isopropyl, butyl, isobutyl or t-butyl group.

Examples of the alkoxy group represented by $X^1$, $X^2$, $X^3$ or $X^4$ include $C_1$ to $C_4$ alkoxy groups such as a methoxy, ethoxy, propoxy, isopropoxy, butoxy, isobutoxy or t-butoxy group.

The oxotitanium phthalocyanine compound represented by the formula (5) is the charge generation material 212. Therefore, the charge generation layer 215 using the compound absorbs light to thereby generate a large number of charges and can also efficiently inject into the charge transport material 213 contained in the charge transport layer 216 without accumulating the generated charges therein, with the result that the generated charges are transported smoothly to the surface of the photosensitive layer.

The oxotitanium phthalocyanine compound represented by the formula (5) can be produced by a known method such as a method described in Moser, Frank H and Arthur L. Thomas, "Phthalocyanine Compounds, Reinhold Publishing Corp., New York, 1963.

In the case of, for example, unsubstituted oxotitanium phthalocyanine represented by the formula (5) in which "r", "s", "y" and "z" are each 0 among oxotitanium phthalocyanines represented by the formula (5), phthalonitrile and titanium tetrachloride are melted under heating or reacted in a proper solvent in α-chloronaphthalene to thereby synthesize dichlorotitanium phthalocyanine, which is then hydrolyzed by a base or water to obtain the above unsubstituted oxotitanium phthalocyanine.

Also, isoindoline and titanium tetraalkoxide such as tetrabutoxytitanium may be reacted under heating in a proper solvent such as N-methylpyrrolidone to produce oxotitanium phthalocyanine.

Examples of optional components other than the charge generation material contained as the major component include sensitizing dyes, a binder resin, an antioxidant, a leveling agent and a plasticizer.

Examples of the sensitizing dyes include triphenylmethane-based dyes typified by Methyl Violet, Crystal Violet, Night Blue and Victoria Blue, acridine dyes typified by Erythrocin, Rhodamine B, Rhbdamine 3R, Acridine Orange and Flapeosine, thiazine dyes typified by Methylene Blue and Methylene Green, oxazine dyes typified by Capri Blue, Meldola's Blue, cyanine dyes, styryl dyes, pyrylium salt dyes and thiopyrylium salt dyes. The sensitizing dye is used in a ratio of preferably 10 parts by weight or less and more preferably 0.5 to 2.0 parts by weight based on 100 parts by weight of the charge generation material.

Examples of the method of forming the charge generation layer 215 include a method in which the above charge generation material is deposited under vacuum on the surface of the conductive substrate 211 and a method in which a charge generation layer coating solution obtained by dispersing the aforementioned charge generation material in a proper solvent is applied to the surface of the conductive substrate 211. Among these methods, a method is preferably used in which the charge generation material is dispersed in a binder resin solution obtained by mixing a binder resin in a solvent to prepare a charge generation layer coating solution, which is then applied to the surface of the conductive substrate 211. This method will be explained below.

Examples of the binder resin used in the charge generation layer 215 may include polyester resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinylbutyral resin, polyvinylformal resin and copolymer resins containing two or more repeat units constituting these resins.

Specific examples of the copolymer resin may include insulation resins such as vinyl chloride/vinyl acetate copolymer resins, vinyl chloride/vinyl acetate/maleic acid anhydride copolymer resins and acrylonitrile/styrene copolymer resins. The copolymer resin is not limited to these resins and resins used usually may be used as the binder resin. These resins may be used either singly or in combinations of two or more.

As the solvent for the charge generation layer coating solution, for example, halogenated hydrocarbons such as tetrachloropropane and dichloroethane, ketones such as acetone, isophorone, methyl ethyl ketone, acetophenone and cyclohexanone, esters such as ethyl acetate, methyl benzoate and butyl acetate, ethers such as tetrahydrofuran (THF), dioxane, dibenzyl ether, 1,2-dimethoxyethane and dioxane, aromatic hydrocarbons such as benzene, toluene, xylene, mesitylene, tetralin, diphenylmethane, dimethoxybenzene and dichlorobenzene, sulfur-containing solvents such as diphenyl sulfide, fluorine-based solvents such as hexafluoroisopropanol and aprotic polar solvents such as N,N-dimethylformamide and N,N-dimethylacetamide.

Also, a solvent obtained by mixing two or of these solvents may be used. Among these solvents, non-halogen-based organic solvents are preferably used taking into global environment into account.

In the charge generation layer 215 having a structure containing a charge generation material and a binder resin, the ratio W1/W2 of the weight W1 of the charge generation material to the weight W2 of the binder resin is preferably 10/100 or more and 200/100 or less.

When the ratio W1/W2 is less than 10/100, this is not preferable because the photoconductor is deteriorated in sensitivity.

Also, when the ratio W1/W2 exceeds 200/100, there is the case where not only the film strength of the charge generation layer 215 is deteriorated but also the dispersibility of the charge generation material is deteriorated, with the result that coarse materials are increased. Therefore, the surface charges on a part other than the part of which the surface charges are to be removed are decreased and there is therefore the case where image defects and particularly, the fogging called the "black point" phenomenon that toners are stuck, particularly, to the white background is increased. The ratio W1/W2 is preferably 50/100 or more and 150/100 or less.

The charge generation material may be milled in advance by a crusher before it is dispersed in the binder resin solution. Examples of the crusher used in the above milling treatment may include ball mill, sand mill, attritor, vibration mill and ultrasonic dispersing machine.

Examples of the dispersing machine used when the charge generation material is dispersed in the binder resin solution may include paint shaker, ball mill and sand mill. As to the dispersing condition at this time, it is preferable to select an appropriate condition so as to prevent the contamination with impurities caused by the abrasion of the members constituting the container and dispersing machine to be used.

Examples of the method of applying the charge generation coating solution may include the spraying method, bar coating method, roll coating method, blade method, ring method and dip coating method. A most appropriate method can be selected taking the properties and productivity of the coating operation into account.

Among these coating methods, the dip coating method is a method in which the substrate is dipped in a coating tank filled with the coating solution and then, pulled up at a constant speed or at a speed changed step by step. Such a dip coating method is frequently used when an electrophotographic photoconductor is produced because it is relatively simple and superior in productivity and costs. The apparatus may be provided with a coating solution dispersing apparatus typified by an ultrasonic generator to stabilize the dispersibility of the coating solution.

The film thickness of the charge generation layer 215 is preferably 0.05 μm or more and 5 μm or less and more preferably 0.1 μm or more and 1 μm or less. When the film thickness of the charge generation layer 215 is less than 0.05 μm, this is undesirable because the efficiency of photo absorption is lowered and there is therefore the case where the sensitivity of the photoconductor is deteriorated.

When the film thickness of the charge generation layer 215 exceeds 5 μm, this is undesirable because the transfer of charges inside of the charge generation layer 215 determines the step of removing the surface charges of the photosensitive layer, resulting in a deterioration in the sensitivity of the photoconductor.

(Charge Transport Layer)

The charge transport layer 216 is formed on the charge generation layer 215. The charge transport layer 216 may be constituted by compounding a charge generation material having the ability of accepting charges generated from the charge generation material contained in the charge generation layer 215 and the ability of transporting these charges, a binder resin and further an antioxidant. The binder resin is preferably contained in an amount of 30 to 80% by weight based on all of the charge transport layer. Besides the charge transport material, antioxidant and binder resin, a ultraviolet absorber, a leveling agent, a plasticizer, a filler and the like may be contained.

The charge transport layer in the photoconductor of the present invention is characterized by the feature that it contains an enamine-based compound represented by the above formula (4) as the charge transport material.

The enamine compound represented by the formula (4) has high charge mobility and is also superior in abrasive resistance and therefore the photoconductor of the present invention has high charging potential and high sensitivity, exhibits satisfactory responding ability and is not deteriorated in these electric characteristic even if it is used repeatedly.

Examples of the charge transport material used in the present invention other than the enamine-based compound represented by the formula (4) include carbazole derivatives, pyrene derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, enamine derivatives and benzidine derivatives.

Examples of polymers having groups derived from these compounds on their principal chains or side chains include poly-N-vinylcarbazole, poly-1-vinylpyrene, ethylcarbazole-formaldehyde resin, triphenylmethane polymer and poly-9-vinylanthracene and polysilane.

The charge transport material is not limited to these materials given as the examples, and when these materials are used, they may be used either singly or in combinations of two or more.

Also, it is preferable to add an antioxidant, an ultraviolet absorber and the like in the charge transport layer 216. The charge transport layer 216 can be thereby reduced in a deterioration caused by oxidizing gases such as ozone and nitrogen oxides.

Also, stability in coating solutions in forming each layer by application can be increased.

Also, the above diamine compound has excellent effects not only on the electric characteristics of the photoconductor but also on the long-term stability of the charge transport layer coating solution.

The ratio J/T by a weight J of the diamine compound according to the present invention to a weight T of the charge transport material preferably ranged between 0.01/100 or more and 20.0/100 or less, and more preferably 0.1/100 or more and 10.0/100 or less though no particular limitation to the ratio.

If the using ratio J/T of the diamine compound J to the charge transport material T according to the present invention is in the above range, the characteristics of the photoconductor are not adversely affected and therefore, the photoconductor is free from a deterioration in sensitivity and from a rise in residual potential in repeated use, making it possible to provide an electrophotographic photoconductor improved in ozone resistance and resistance to nitrogen oxides.

When the ratio J/T is less than 0.01/100, only insufficient resistance to oxidizing gases such as ozone and nitrogen oxides is obtained and there is therefore a fear as to a deterioration in image quality, a drop in charging potential and a deterioration in sensitivity in repeated use.

When the ratio J/T exceeds 20.0/100, on the other hand, the sensitivity and responding characteristics of the photoconductor are deteriorated and there is a fear as to a rise in residual potential in repeated use.

The diamine compound represented by the formula (1) may be used by mixing other antioxidants therewith to the extent that the electric characteristics are not impaired. Examples of the antioxidant include amine-based compounds, phenol-based compounds, hydroquinone-based compounds and tocopherol-based compounds. Among these compounds, hindered amine derivatives, hindered phenol derivatives or mixtures of these compounds are preferably used.

The total amount of these antioxidants to be used is preferably 0.01 parts by weight or more and 50 parts by weight or less and more preferably 0.1 to 10 parts by weight based on 100 parts by weight of a charge transport material. When the amount of the antioxidant is less than 0.01 parts by weight, this is undesirable because there is the case where only insufficient effects on an improvement in the stability of the coating solution and on an improvement in the durability of the photoconductor can be obtained. Also, when the amount of the antioxidant exceeds 50 parts by weight, this is undesirable because the characteristics of the photoconductor are adversely affected.

As the binder resin, those highly compatible with the charge transport material are selected. Specific examples of the binder resin may include vinyl polymer resins such as a polymethylmethacrylate resin, polystyrene resin and polyvinyl chloride resin and copolymer resins containing two or more of the repeat units constituting these resins, polycarbonate resins, polyester resins, polyester carbonate resins, polysulfone resins, phenoxy resins, epoxy resins, silicone resins, polyarylate resins, polyamide resins, polyether resins, polyurethane resins, polyacrylamide resins and phenol resins. Also, heatcurable resins obtained by partially crosslinking these resins are given as examples. These resins may be used either singly or in combinations of two or more. Among the above resins, a polystyrene resin, polycarbonate resin, polyarylate resin and polyphenylene oxide each have a volume resistance rate of 1013 Ω·cm or more, so that they are superior in electric insulation and also in electric properties such as potential characteristics and are therefore preferably used.

However, the photoconductor of the present invention is characterized by the feature that a polyarylate resin having a structural unit represented by the following formula (I) as the binder resin.

(I)

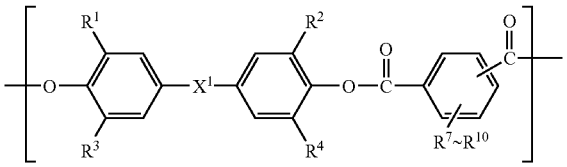

Specific examples of the structural unit represented by the above formula (I) are shown in the following tables. However, these structural units are only examples and the structural unit represented by the formula (I) are not limited to these examples.

TABLE 3-1
| | |
|---|---|
| Structual formula (1-1) | 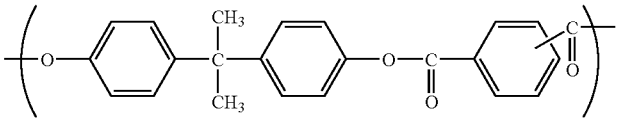 |
| Structual formula (1-2) | 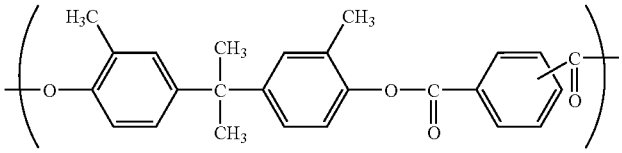 |
| Structual formula (1-3) | 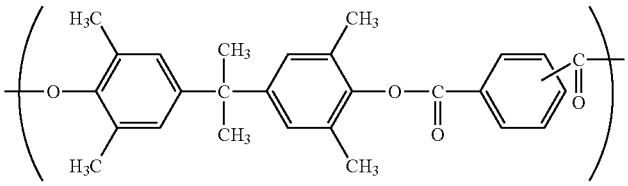 |
| Structual formula (1-4) | 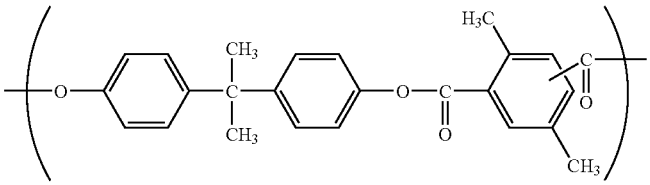 |
| Structual formula (1-5) | 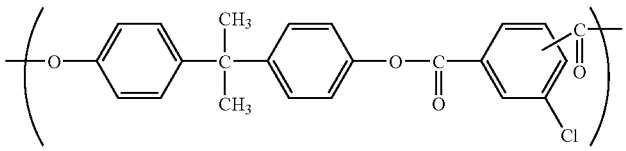 |
TABLE 3-2
| | |
|---|---|
| Structual formula (1-6) | 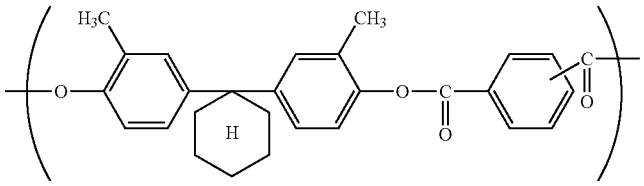 |
| Structual formula (1-7) | 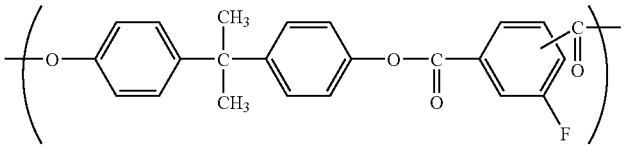 |
| Structual formula (1-8) | 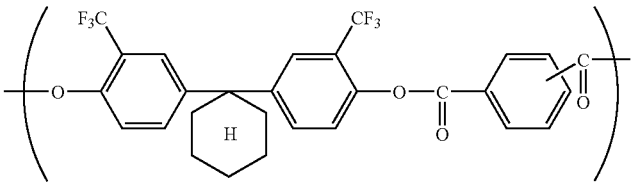 |

TABLE 3-2-continued
| | |
|---|---|
| Structual formula (1-9) | 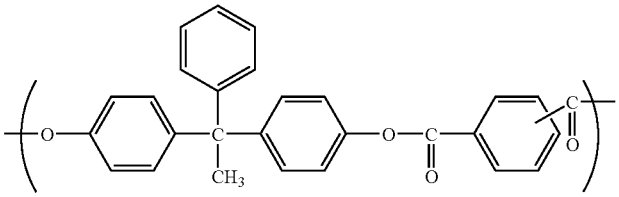 |
| Structual formula (1-10) | 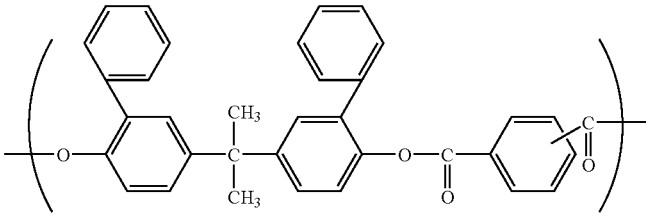 |
TABLE 3-3
| | |
|---|---|
| Structual formula (1-11) | 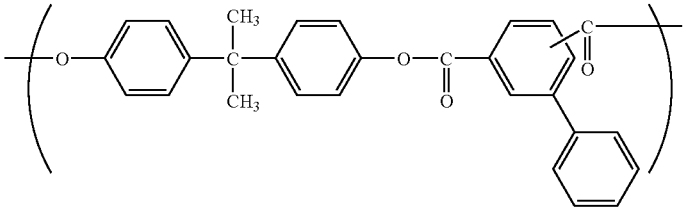 |
| Structual formula (1-12) | 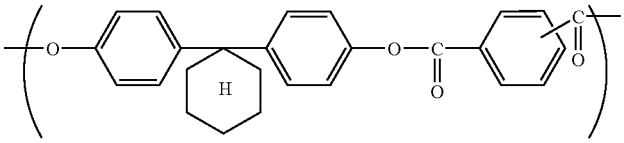 |
| Structual formula (1-13) | 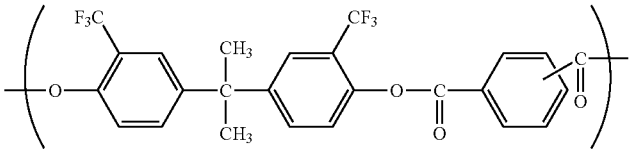 |
| Structual formula (1-14) | 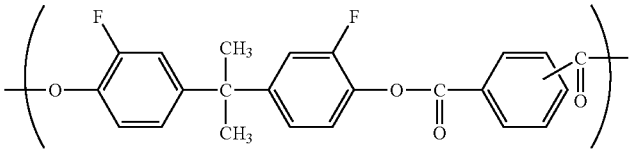 |
| Structual formula (1-15) | 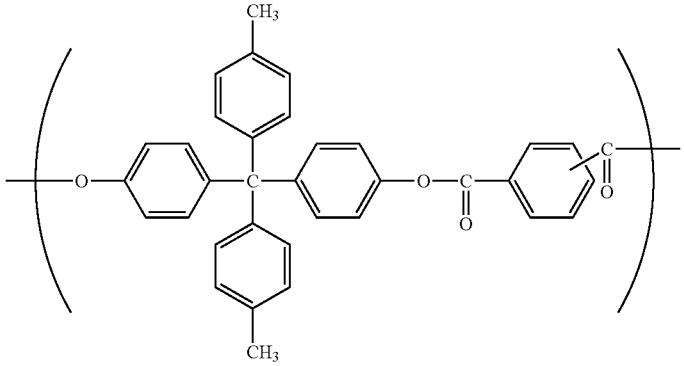 |

TABLE 3-4
| | |
|---|---|
| Structual formula (1-16) | 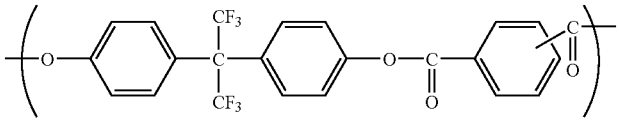 |
| Structual formula (1-17) | 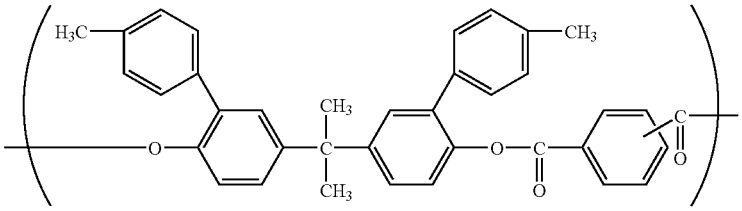 |
| Structual formula (1-18) | 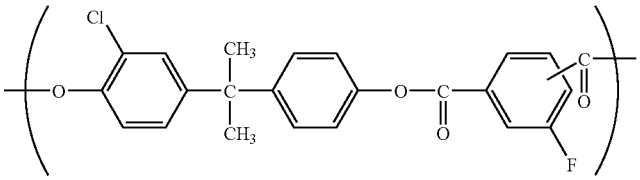 |
| Structual formula (1-19) | 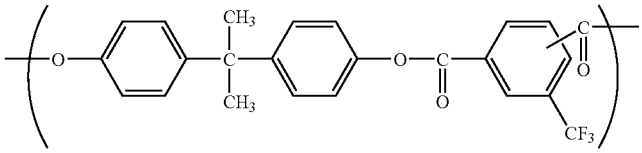 |
| Structual formula (1-20) | 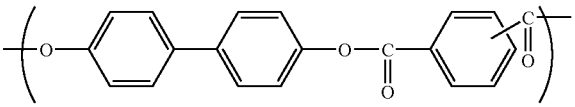 |
TABLE 3-5
| | |
|---|---|
| Structual formula (1-21) | 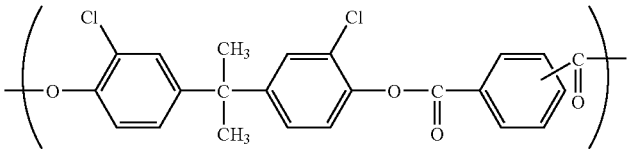 |
| Structual formula (1-22) | 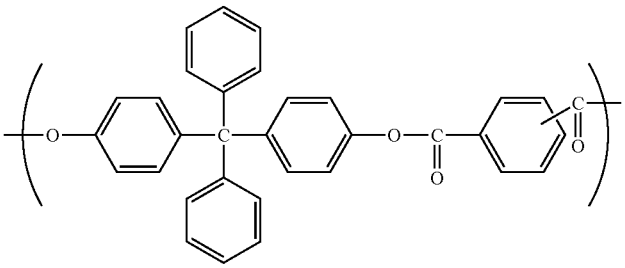 |
| Structual formula (1-23) | 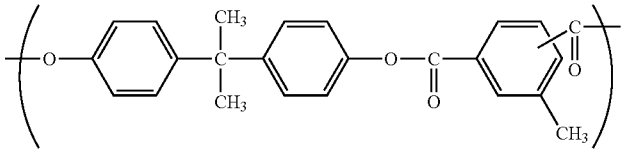 |

TABLE 3-5-continued

| | |
|---|---|
| Structual formula (1-24) | 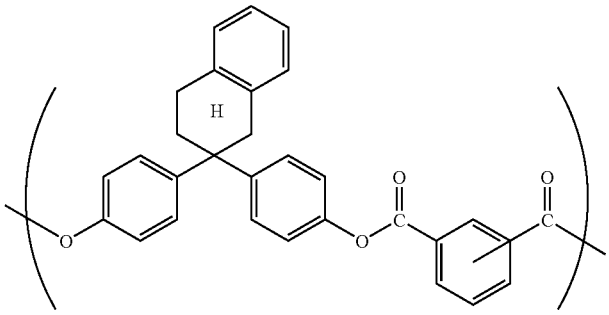 |

The polyarylate resin having the above structural unit may contain two or more of the structural units shown in the above tables in one resin. The polyarylate resin may have known structural units other than those described in the above tables to the extent that the mechanical strength is not impaired.

As the above binder resin, polyarylate resins having the structural units shown in the above tables may be used either singly or in combinations of two or more. Also, known binder resins exemplified below may be used together.

The resin represented by the formula (I) may be produced using a known method. For example, a phthalic acid chloride and various bisphenols may be mixed with stirring in a mixed solvent of water and an organic solvent in the presence of an alkali to undergo interfacial polymerization, thereby producing the resin represented by the formula (I).

As the phthalic acid chloride, a mixture of terephthalic acid chloride and isophthalic acid chloride is used to control the solubility in the polyarylate resin. Therefore, the structural unit represented by the formula (I) is represented by a form produced from a mixture of terephthalic acid chloride and isophthalic acid chloride.

The ratio of the terephthalic acid chloride to isophthalic acid chloride to be mixed is controlled in consideration of the solubility of the polyarylate resin. However, if the amount of either of these chlorides 30 mol % or less based on the total amount of phthalic acid chloride, there is the case where the solubility of the obtained polyarylate resin is significantly deteriorated. Therefore, the ratio of the terephthalic acid chloride to isophthalic acid chloride to be mixed is preferably 1:1 by mol.

The resin represented by the formula (I) has a viscosity average molecular weight of, preferably, 10,000 or more and 300,000 or less and more preferably 15,000 or more and 100,000 or less. When the viscosity average molecular weight of the resin of the formula (I) is less than 10,000, this is undesirable because the coating film becomes fragile so that the surface of the photosensitive layer 214 is easily scratched.

When the viscosity average molecular weight of the resin represented by the formula (I) exceeds 300,000, this is undesirable because the viscosity of the coating solution is high in the case of forming the charge transport layer 216 and there is therefore the case where even coating cannot be attained, causing the film thickness to be more uneven. The viscosity average molecular weight of the resin is more preferably 15000 or more and 50000 or less.

The viscosity average molecular weight was calculated by measuring the flow-down time [t] of a sample solution in a constant-temperature water bath kept at 20.0° C. by using a Ubbelohde's capillary viscometer.

The resin represented by the formula (I) may be mixed with other binder resins to the extent that the mechanical strength is not impaired.

With regard to the ratio (by weight) of the resin represented by the formula (I)/other resins to be mixed, the ratio may be 5/95 to 95/5 and is preferably 20/80 to 80/20 to develop the mechanical strength of the resin of the formula (I) and the effect on productivity and on the stability of the coating solution.

The viscosity average molecular weight is preferably 20000 to 80000 though no particular limitation is imposed on it.

The above other resin is preferably those highly compatible with the resin of the formula (I).

Specific examples of these resins may include vinyl polymer resins such as a polymethylmethacrylate resin, polystyrene resin and polyvinyl chloride resin and copolymer resins of these vinyl polymer resins, polyarylate resins having a structural unit other than the structural unit represented by the formula (I), polycarbonate resins, polyester resins, polyestercarbonate resins, polysulfone resins, phenoxy resins, epoxy resins, silicone resins, polyamide resins, polyether resins, polyurethane resins, polyacrylamide resins and phenol resins.

Also, heatcurable resins obtained by partially crosslinking these resins may be used. Among these resins, particularly polycarbonate resins are preferable.

In the charge transport layer 216, various additives may be added besides the enamine compound represented by the formula (4) as the charge transport material according to the need.

For example, a plasticizer or a leveling agent may be added to the charge transport layer 216 to improve the film forming ability, flexibility and surface smoothness.

Examples of the plasticizer may include biphenyl, biphenyl chloride, benzophenone, o-terphenyl, dibasic acid esters (for example, phthalates), fatty acid esters, phosphates, various fluoro-hydrocarbons, chlorinated paraffin and epoxy-based plasticizers. Examples of surface modifier include silicone-based leveling agents such as silicone oil and fluororesin-based leveling agents.

The charge transport layer 216 may be produced by dissolving or dispersing a charge transport material, a binder resin, silica microparticles and, as required, the above additives in a proper solvent in the same manner as in the case of forming the above charge generation layer 215 by coating, to prepare a charge transport layer coating solution, which is then applied to the charge generation layer 215.

Examples of the solvent for the charge transport layer coating solution may include aromatic hydrocarbons such as benzene, toluene, xylene, mesitylene, tetralin, diphenylmethane, dimethoxybenzene, monoclorobenzene and dichlorobenzene, halogenated hydrocarbons such as dichloromethane and dichloroethane, ethers such as tetrahydrofuran, dioxane, dibenzyl ether and dimethoxymethyl ether, ketones such as cyclohexanone, acetophenone and isophorone, esters such as methyl benzoate and ethyl acetate, sulfur-containing solvents such as diphenyl sulfide, fluorine-based solvents such as hexafluoroisopropanol and aprotic polar solvents such as N,N-dimethylformamide.

These solvents may be used either singly or in combinations of two or more. A mixed solvent obtained by further adding alcohols, acetonitrile or methyl ethyl ketone to the above solvent may be used. Among these solvents, halogen-free-based solvents are preferably used taking global environment into consideration.

Examples of the method of applying the charge transport coating solution may include the spraying method, bar coating method, roll coating method, blade method, ring method and dip coating method. Among these coating methods, particularly, the dip coating method is frequently used also in the case of forming the charge transport layer 216 because various points as mentioned above.

The film thickness of the charge transfer layer 216 is preferably 5 μm or more and 40 μm or less and more preferably 10 μm or more and 30 μm or less. When the film thickness of the charge transfer layer 216 is less than 5 μm, this is not preferable because the charge retentivity is deteriorated. When the film thickness of the charge transfer layer 216 exceeds 40 μm, this is undesirable because the resolution is deteriorated and there is therefore the case where an inferior image is obtained.

Second Embodiment 2

The electrophotographic photoconductor 202 according to the present invention as shown in FIG. 2 is a monolayer type photoconductor in which a photosensitive layer 240 is constituted of a monolayer structure obtained by binding a charge generation material 212, a charge transport material 213 and a diamine compound by using the above binder resin 217.

The monolayer type photoconductor almost functions as a general photoconductor to be positively charged. In this case, as compared with the case where a photoconductor functions as a photoconductor to be negatively charged, the amount of ozone and nitrogen oxide generated from the system is small, it may be said that the diamine compound represented by the formula (1) is reduced in the effect of imparting ozone resistance and oxidizing gas resistance to the photoconductor. Therefore, the effect of the diamine compound represented by the formula (1), that is the effect of imparting oxidizing gas resistance is more developed in the case of using the laminate type photoconductor of the first embodiment of the present invention.

When an enamine compound represented by the formula (4) is used as the charge transport material 213, this is desirable because an electrophotographic photoconductor can be obtained which has a high charging potential and high sensitivity, exhibits high responding ability and is not deteriorated in electric characteristics even in repeated use, since the enamine compound has a high charge mobility.

The charge transport material 213 is not limited to enamine compounds represented by the formula (4) and these charge transport materials may be used either singly or in combinations of two or more.

The photosensitive layer 240 is formed in the same manner as in the case of the charge transport layer 216 provided with the electronic photoconductor according to the first embodiment. For example, the photosensitive layer 240 is formed in the following manner. The above charge generation material 212, the above charge transport material 213, the diamine compound represented by the formula (1) and the binder resin 217 are dissolved or dispersed in the aforementioned appropriate solvent to prepare a photosensitive layer coating solution. This photosensitive layer coating solution is applied to the outside peripheral surface of the conductive support 211 by using the dip coating method or the like.

The ratio (A'/B') of the charge transport material 213 (A') to the binder resin 217 (B') in the photosensitive layer 240 is preferably 10/12 by weight or less like the ratio (A/B) of the charge transport material 213 (A) to the binder resin 217 (B) provided in the electrophotographic photocondutor in the first embodiment. The abrasive resistance of the photosensitive layer 240 can be thereby improved. Also, when the photosensitive layer 240 is formed by the dip coating method, the above ratio A'/B' is preferably 10/30 or more by weight.

The film thickness of the photosensitive layer 240 is preferably 5 μm or more and 100 μm or less and more preferably 10 μm or more and 50 μm or less.

When the film thickness of the photosensitive layer 240 is less than 5 μm, the charge retentivity of the surface of the photoconductor is lowered.

Also, when the film thickness of the photosensitive layer 240 exceeds 100 μm, this brings about low productivity and therefore, the film thickness of the photosensitive layer was made to be 5 μm or more and 100 μm or less.

In the photosensitive 214 or 240 formed on the electrophotographic photoconductor of the first to third embodiments as mentioned above, one or more electron accepting materials or dyes may be added to improve sensitivity and to suppress a rise in residual potential and fatigue in repeated use.

As the electron accepting material, electron attractive materials may be used which include, for example, acid anhydrides such as succinic acid anhydride, maleic acid anhydride, phthalic acid anhydride and 4-chloronaphthalic acid anhydride, cyano compounds such as tetracyanoethylene and terephthalmalondinitrile, aldehydes such as 4-nitrobenzaldehyde, anthraquinones such as anthraquinone and 1-nitroanthraquinone, polycyclic or heterocyclic nitro compounds such as such as 2,4,7-trinitrofluorenone and 2,4,5,7-tetranitrofluorenone and diphenoquinone compounds. Also, materials obtained by polymerizing these electron attractive materials may also be used.

As the dye, organic photoconductive compounds such as xanthene-based dyes, thiazine dyes, triphenylmethane dyes, quinoline-based pigments and copper phthalocyanine may be used. These organic photoconductive compounds function as an optical sensitizer.

Also, an antioxidant or ultraviolet absorber may be added to each layer of the photosensitive layer.

Third Embodiment (Structural Examples of Other Photoconductors)

An electrophotographic photoconductor 203 that is another embodiment of the present invention as shown in FIG. 3 is provided with an undercoat layer 218 between a conductive substrate 211 and a photosensitive layer 214.

When the undercoat layer 218 is not present between the conductive substrate 211 and the photosensitive layer 214, there is the case where charges are injected from the conductive substrate 211 into the photosensitive layer 214.

This charges lowers the charging ability of the photosensitive layer 214 and therefore, the surface charges on a part other than the part of which the surface charges are to be removed are decreased, with the result that there is the case where image defects such as fogging are caused. When, particularly, the reverse developing process is used to form an image, toners are stuck to the part where the surface charges are reduced by exposure to form an image there.

For this, if the surface charges are reduced by a cause other than exposure, there is the case where an image defect and particularly, the fogging called the "black point" phenomenon that toners are stuck, particularly, to the white background occurs, with the result that there is the case where the image quality is significantly deteriorated. In other words, when the undercoat layer 218 is not present between the conductive substrate 211 and the photosensitive layer 214, there is the case where the charging ability in a microregion is deteriorated caused by the defects of the conductive substrate 211 or photosensitive 214, giving rise to image fogging such as black points, causing serious image defects.

Because the undercoat layer 218 is disposed between the conductive substrate 211 and the photosensitive layer 214 in the electrophotographic photoconductor 202 as mentioned above, the injection of charges from the conductive substrate 211 into the photosensitive layer 214 can be prevented. Therefore, a reduction of electrostatic property in the photosensitive layer 214 can be prevented, and thereby a reduction in the surface charges on a part other than the part of which the surface charges are to be removed can be limited, making it possible to prevent the generation of image defects such as fogging.

Also, because the irregularities on the surface of the conductive substrate 211 are coated and therefore, a uniform surface can be obtained by forming the undercoat layer 218, the film-forming ability of the photosensitive layer 214 can be improved. Also, the undercoat layer 218 prevents the photosensitive layer 214 from being peeled from the conductive substrate 211, making possible to improve the adhesion between the conductive substrate 211 and the photosensitive layer 214.

For example, a resin layer made of various resin materials or an alumite layer may be used for the undercoat layer 218.

Examples of the resin material constituting the resin layer may include resins such as a polyethylene resin, polypropylene resin, polystyrene resin, acryl resin, vinyl chloride resin, vinyl acetate resin, polyurethane resin, epoxy resin, polyester resin, melamine resin, silicone resin, polyvinylbutyral resin and polyamide resin, and copolymer resins containing two or more of the repeat units constituting these resins.

Also, examples of the resin material include casein, gelatin, polyvinyl alcohol and ethyl cellulose. Among these resins, a polyamide is preferably used and particularly, an alcohol-soluble nylon resin is preferably used. Preferable examples of the alcohol-soluble nylon resin may include the so-called copolymer nylons obtained by copolymerizing 6-nylon, 6,6-nylon, 6,10-nylon, 11-nylon, 2-nylon and 12-nylon and resins obtained by chemically denaturing nylons such as N-alkoxymethyl-denatured nylon and N-alkoxyethyl-denatured nylon.

The undercoat layer 218 may contain metal oxide particles. Because the volume resistance of the undercoat layer 218 can be controlled by formulating these particles in the undercoat layer 218, it is possible to heighten the effect of preventing the injection of charges into the photosensitive layer 214 from the conductive substrate 211. Besides, the electric characteristics of the photoconductor can be maintained under various environments. The particle diameter of these metal oxide particles is preferably in a range from 0.02 to 0.5 μm.

Examples of the metal oxide particles may include particles of titanium oxide, aluminum oxide, aluminum hydroxide or tin oxide.

The undercoat layer 218 is formed, for example, by dissolving or dispersing the above resin in a proper solvent to prepare an undercoat layer coating solution and by applying the obtained solution to the surface of the conductive substrate 211. In the case of formulating the above metal oxide particles in the undercoat layer 218, these particles are dispersed in a resin solution obtained by dissolving the above resin in an appropriate solvent to prepare an undercoat layer coating solution. Then, this coating solution is applied to the surface of the conductive substrate 211 to form the undercoat layer 218.

Water or various organic solvents or mixtures of these solvents are used as the solvent for the undercoat layer coating solution. For example, a single solvent consisting of water, methanol, ethanol, butanol or the like, or a mixed solvent consisting of water and alcohols; two or more types of alcohols; acetone or dioxolan and alcohols; or a chlorine-based solvent such as dichloroethane, chloroform or trichloroethane and alcohols is used. Among these solvents, a non-halogen-based solvent is preferably used taking global environment into account.

As the method of dispersing the above particles in the resin solution, a usual method using a ball mill, sand mill, attritor, vibration mill, ultrasonic dispersing machine or paint shaker may be used.

The ratio C/D of the total weight C of the resin and metal oxide to the weight D of the solvent to be used in the undercoat coating solution is preferably 1/99 to 40/60 and more preferably 2/98 to 30/70. Also, the ratio E/F of the weight E of the resin to the weight F of the metal oxide is preferably 90/10 to 1/99 and more preferably 70/30 to 5/95.

Examples of the method of applying the undercoat coating solution may include the spraying method, bar coating method, roll coating method, blade method, ring method and dip coating method. Among these coating methods, particularly, the dip coating method is frequently used also in the case of forming the undercoat layer 218 because this method is simple, and is superior in productivity and costs as mentioned above.

The film thickness of the undercoat layer 218 is preferably 0.01 μm or more and 20 μm or less and more preferably 0.05 μm or more and 10 μm or less. When the film thickness of the undercoat layer 218 is less than 0.01 μm, the undercoat layer 218 substantially exhibits its function with difficulty and it is therefore difficult to coat the defects of the conductive substrate 211 to thereby obtain a uniform surface. This resultantly brings about a difficulty in preventing charges from being injected into the photosensitive layer 214 from the conductive substrate 211 and there is therefore the case where the charging ability of the photosensitive layer 214 is deteriorated, which is undesirable. It is undesirable to form the undercoat layer in a thickness higher than 20 μm because it is difficult to form the undercoat layer 218 and also, the photosensitive layer 214 is not formed evenly on the undercoat layer 218, affording opportunity for a reduction in sensitivity when the undercoat layer 218 is formed by the dip coating method.

FIG. 3 shows one example of an embodiment in which the undercoat layer 218 is interposed between the conductive support 211 and the laminate type photosensitive layer 214. However, the undercoat layer may be disposed between the monolayer type photosensitive layer 240 and the conductive support 211.

Fourth Embodiment

An electrophotographic photoconductor 204 in another embodiment of the present invention as shown in FIG. 4 is provided with a surface protective layer 219 laminated on the photosensitive layer 214. The formation of the surface protective layer is known to be a method used to attain the high durability of a photoconductor.

However, there is a problem that oxidizing gases such as ozone and nitrogen oxides originated from the image formation process penetrate through the surface protective layer and chemically change the charge transport material of the photosensitive layer to cause a change in various characteristics. As the method used to solve such a problem, the method in which an antioxidant is added in the surface protective layer is widely known.

Though methods have been disclosed so far in which an antioxidant having a triazine ring or hindered phenol skeleton in its molecule, hindered amine, trialkylamine and aromatic amine are added in the surface protective layer, these methods are not said to be satisfactory. However, when the diamine compound according to the present invention is contained in the surface protective layer, a photoconductor having such durability as to stand against the influence of oxidizing gases even in repeated use can be attained.

The surface protective layer 219 has the function of improving the durability of the photoconductor and contains a binder resin and the diamine compound according to the present invention. As the binder resin, resins which are used for the purpose of improving the mechanical strength and durability, have the binding ability satisfactorily enough to use in the fields concerned and are highly compatible with the diamine compound according to the present invention are preferable.

Specific examples of these resins may include thermoplastic resins, for example, vinyl-based resins such as a polymethylmethacrylate, polystyrene and polyvinyl chloride resin, polycarbonate, polyester, polyestercarbonate, polysulfone, polyarylate, polyamide, methacryl resin, acryl resin, polyether, polyacrylamide and polyphenylene oxide; heatcurable resins such as phenoxy resins, epoxy resins, silicone resins, polyurethane, phenol resins, alkyd resins, melamine resins, phenoxy resins, polyvinylbutyral and polyvinyl formal, partially crosslinked products of these resins and copolymer resins containing two or more structural units contained in these resins (insulation resins such as vinyl chloride/vinyl acetate copolymer resins, vinyl chloride/vinyl acetate/maleic acid anhydride copolymer resins and acrylonitrile/styrene copolymer resins). These binder resins may be used either singly or in combinations of two or more.

Although no particular limitation is imposed on the proportion of the diamine compound to be used, the ratio J/B of the weight J of the diamine compound to the weight B of the above binder resin is preferably 0.1/100 or more and 30.0/100 or less.

When the ratio J/B is less than 0.1/100 parts, there is the case where the effect of the present invention is insufficient. When the ratio J/B exceeds 30.0/100, on the other hand, the relative ratio of the diamine compound to the resin is high and there is therefore the case where phenomena such as a reduction in sensitivity occur.

The surface protective layer 219 may be produced by dissolving or dispersing the diamine compound according to the present invention, a binder resin and the like in an appropriate organic solvent to prepare a surface protective layer forming coating solution and by applying this surface protective layer forming coating solution to the surface of the monolayer type or laminate type photosensitive layer, followed by drying to remove the organic solvent. As the organic solvent used here, the same ones as the organic solvents used in the formation of the photosensitive layer may be used.

The film thickness of the surface protective layer 219 is preferably 0.5 to 10 μm and more preferably 1 to 5 μm, though no particular limitation to it. When the film thickness of the surface protective layer 219 is less than 0.5 μm, the surface of the photoconductor is deteriorated in scratch resistance and there is therefore a fear as to insufficient durability, whereas when the film thickness exceeds 10 μm, on the other hand, there is a fear as to a deterioration in the resolution of the photoconductor.

The surface protective layer 219 is not limited to the case where the laminate type photosensitive layer is used as shown in FIG. 4 but may be formed in the case where the photoconductor is a monolayer type and also, the surface protective layer 219 may be provided or not with the undercoat layer.

(Production Method of the Photoconductor)

In the method of producing the photoconductor, it is preferable to involve a drying process in the formation of each layer including the undercoat layer 218, charge generation layer 215 and charge transport layer 216 or the like. The drying temperature of the photoconductor is appropriately about 50° C. to about 150° C. and preferably about 80° C. to about 130° C. When the drying temperature of the photoconductor is less than about 50° C., this is undesirable because the drying time is prolonged or a solvent is only insufficiently vaporized but left unremoved in the photosensitive layer. Also, when the drying temperature exceeds about 150° C., this is also undesirable because there is the case where the electric characteristics in repeated use are impaired and the image obtained by using the photoconductor is deteriorated.

(Coating Solution)

In the present invention, a coating solution containing the diamine compound represented by the formula (1) for forming the charge transport layer is provided. Because this coating solution contains the diamine compound of the formula (1), the coating solution can be preserved stably for a long period of time (for example, over 100 days) and a charge transport layer having stable qualities can be formed.

Therefore, the present invention provides an image forming apparatus provided with any one of the above electrophotographic photoconductors, a charging means that charges the above electrophotographic photoconductor, an exposure means that exposes the photographic photoconductor, a developing means that develops the electrostatic latent image formed by the exposure and a transfer means that transfers the electrostatic latent image to a transfer material.

To mention in more detail, the present invention provides an image forming apparatus comprising plural electrophotographic photoconductors used separately for white-black use and for color use, a charge means that separately charges the surface of the above plural photoconductors, an exposure means that separately exposes the charged electrophotographic photoconductors, plural developing means that receive developers having colors different from each other and separately develop the electrostatic latent images formed on the surface of the electrophotogaphic photoconductors by the exposure and a transfer means that separately transfers the visible images formed on the electrophotographic photoconductors to a recording medium, wherein the electrophotographic photoconductor is produced by laminating either a monolayer type photosensitive layer containing a charge generation material and a charge transport material or a laminate type photosensitive layer obtained by laminating a charge generation layer containing a charge generation material and a charge transport layer containing a charge transport material in this order, on a conductive support, the image forming apparatus using at least one of the aforementioned electrophotographic photoconductors as the electrophotographic photoconductor consisting of the monolayer type photosensitive layer or laminate type photosensitive layer.

Embodiment 5

(Image Forming Apparatus)

Figure 5:
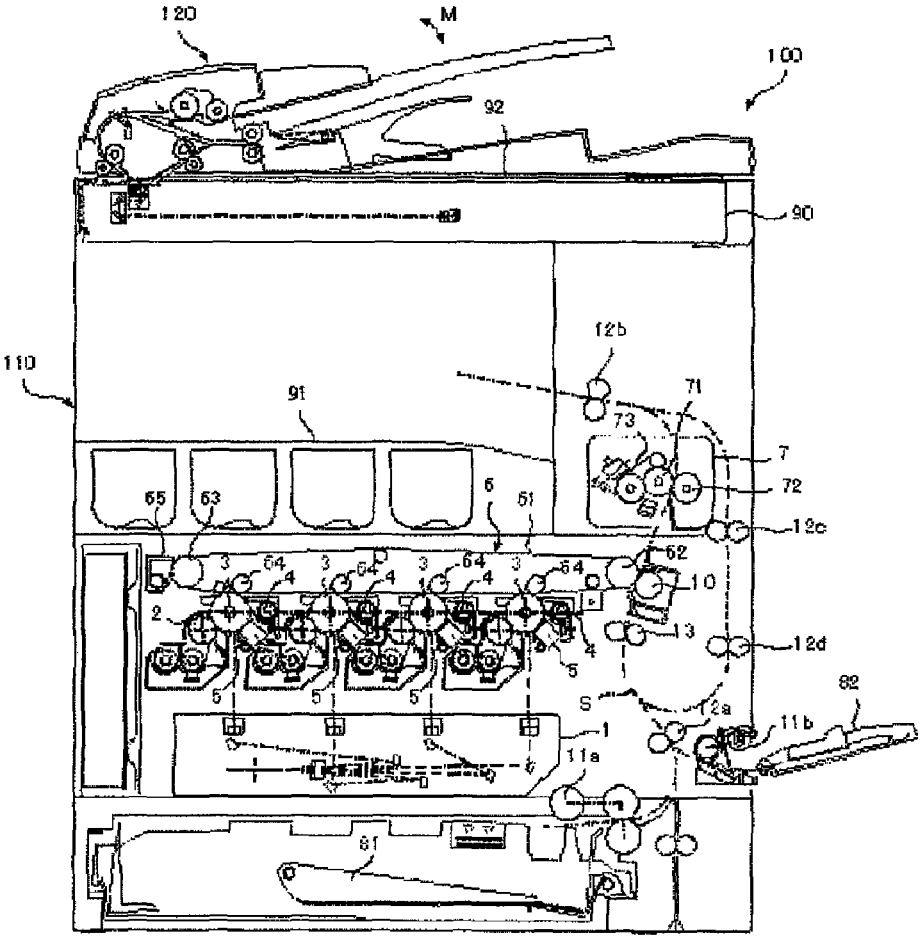
FIG. 5 is a typical side view showing the structure of an image forming apparatus according to the present invention.

FIG. 5 is a view showing a structural example of an image forming apparatus 100 according to the present invention. The image forming apparatus 100 shown in FIG. 5 is a multi function peripheral mounted with a photoconductor 3. The structure and image formation action of the multi function peripheral 100 will be explained with Document to FIG. 5. The multi function peripheral 100 described in FIG. 5 is merely an example of the image forming apparatus of the present invention and the image forming apparatus of the present invention is not limited by the following content.

The image forming apparatus 100 forms a multicolor or monochromatic color image on a given sheet (recording paper) according to image data transferred from the outside and is constituted of an apparatus body 110 and an automatic original processing device 120. The apparatus body 110 is constituted of an exposure unit 1, a developing device 2, a photoconductor drum 3, a cleaner unit 4, a charging device 5, an intermediate transfer belt unit 6, a fuser unit 7, a paper feeder cassette 81 and a paper discharge tray 91.

An original-carrying table 92 made of transparent glass on which an original is mounted is disposed on the upper part of the apparatus body 110 and the automatic original processing device 120 is set to the upper side of the original-carrying table 92. The automatic original processing device 120 conveys the original automatically to the original-carrying table 92. Also, the automatic original processing device 120 is constituted in such a manner as to be freely rotated in the direction of the arrow M and is also so designed that the original can be put by hand by opening the top of the original-carrying table.

The image data handled in this image forming apparatus corresponds to each color image using black (K), cyan (C), magenta (M) and yellow (Y). Therefore, the image forming apparatus is provided four each of the developing device 2, of the photoconductor drum 3, of the charging device 5 and of the cleaner unit 4 to form four types of latent images corresponding to each color and these four units of each process are set to black, cyan, magenta or yellow, whereby four image stations are constituted.

The charging device 5 is a charging means that evenly charges the surface of the photoconductor drum 3 to a given potential and there is the case where, besides a charger type as shown in FIG. 5, a contact type roller type or brush type charging device is used.

The exposure unit 1 corresponds to an image writing device according to the present invention, and is constituted as a laser scanning unit (LSU) provided with, for example, a laser emitting section and a reflection mirror. In the exposure unit 1, a polygon mirror for the scanning of a laser beam and optical elements such as lens and mirrors that guide the laser light reflected on the polygon mirror to the photoconductor drum 3 are arranged. The structure of a light scanning device constituting the exposure unit 1 will be explained in detail later. Besides, a method using EL in which light emitting devices are arranged like an array or a LED writing head may be adopted.

The exposure unit 1 has the ability to expose the charged photoconductor drum 3 corresponding to the input image data to form an electrostatic latent image on the surface of the photoconductor corresponding to the image data. The developing device 2 serves to visualize the electrostatic latent images formed on each photoconductor drum 3 by using four color (YMCK) toners. Also, the cleaner unit 4 serves to remove and recover toners left unremoved on the surface of the photoconductor drum 3 after developing/image transfer operations.

The intermediate transfer belt unit 6 disposed above the photoconductor drum 3 is provided with an intermediate transfer belt 61, an intermediate transfer belt drive roller 62, an intermediate transfer belt driven roller 63, an intermediate transfer roller 64 and intermediate transfer belt cleaning unit 65. The above intermediate transfer roller 64 is provided with four units each corresponding to each color of YMCK.

The intermediate transfer belt drive roller 62, intermediate transfer belt driven roller 63, and intermediate transfer roller 64 are each rotated by a belt hung and stretched over intermediate transfer belt 61. Also, the intermediate transfer roller 64 serves to give a transfer bias to transfer the toner image formed on the photoconductor drum 3 to the surface of the intermediate transfer belt 61.

The intermediate transfer belt 61 is disposed so as to be in contact with each photoconductor drum 3, and has the ability to transfer each color toner image formed on the photoconductor drum 3 to the surface of the intermediate transfer belt 61 in a sequentially overlapped manner to thereby form a color toner image (multicolor toner image) on the intermediate transfer belt 61. The intermediate transfer belt 61 is formed in an endless form by using, for example, a film about 100 μm to 150 μm in thickness.

The transfer of the toner image to the intermediate transfer belt 61 from the photoconductor drum 3 is carried out by the intermediate transfer roller 64 which is in contact with the backside of the intermediate transfer belt 61. A high voltage transfer bias (high voltage having opposite polarity (+) to the toner (−)) for transferring the toner image is applied to the intermediate transfer roller 64. The intermediate transfer roller 64 is a roller in which a metal (for example, stainless) shaft 8 to 10 mm in diameter is used as the base and the surface of the metal is coated with a conductive elastic material (for example, EPDM, foam urethane). High voltage can be uniformly applied to the intermediate transfer belt 61 due to this conductive elastic material. Although an electrode having a roller form is used as the transfer electrode in this embodiment, other materials including a brush may be used.

The electrostatic images visualized corresponding to each color phase on each photoconductor drum 3 are laminated on the intermediate transfer belt 61. The image information laminated in this manner is transferred to a sheet by the rotation of the intermediate transfer belt 61 and by a transfer roller 10 disposed at the position where the sheet is in contact with the intermediate transfer belt 61.

At this time, the intermediate transfer belt 61 and the transfer roller 10 are pressed against each other with a prescribed nip and also, voltage for transferring the toner to the sheet is applied to the transfer roller 10 (high voltage having opposite polarity (+) to the toner (−)). With regard to the transfer roller 10, one of the transfer roller 10 and the intermediate transfer belt drive roller 62 is made of a hard material (metal) and the other is made of a soft material (for example, an elastic rubber roller or form resin roller) such as elastic roller materials to obtain the above nip steadily.

Also, it is so designed that the toner stuck to the intermediate transfer belt 61 by the contact with the photoconductor drum 3 or the toner which is not transferred to the sheet by the transfer roller 10 but left on the intermediate transfer belt 61 is removed and recovered by the intermediate transfer belt cleaning unit 65 because these toners are a cause of the generation of color mixing in the next step. The intermediate transfer belt cleaning unit 65 is provided with, for example, a cleaning blade as the cleaning member which is in contact with the intermediate transfer belt 61 and the intermediate transfer belt 61 with which the cleaning blade is in contact is supported by the driven roller 63 from the backside.

The paper feed cassette 81 is a tray for stacking sheets (recording paper) used for the formation of an image and is disposed on the backside of the exposure unit 1 of the apparatus body 110. Also, a sheet to be used for the formation of an image can be placed on the hand-feed paper cassette 82. Also, the paper discharge tray 91 disposed above the apparatus body 110 is a tray for accumulating the printed sheets in a face-down system.

Also, the apparatus body 110 is provided with a sheet conveying path S having an almost fin form to feed sheets from the paper feed cassette 81 and hand-feed paper cassette 82 to the paper discharge tray 91 through the transfer roller 10 and fuser unit 7. Pickup rollers 11*a* and 11*b*, plural conveying rollers 12*a* to 12*d*, a registration roller 13, the transfer roller 10, the fuser unit 7 and the like are arranged in the vicinity of the sheet conveying path S extending from the paper feed cassette 81 and hand-feed paper cassette 82 to the paper discharge tray 91.

The conveying rollers 12*a* to 12*d* are small rollers that promote and aid the travel of the sheets and are disposed plurally along the paper conveying path S. Also, the pickup roller 11*a* is disposed in the vicinity of the end of the paper feed cassette 81 and picks up these sheets one by one and feeds to the paper conveying path S. Similarly, the pickup roller 11*b* is also disposed in the vicinity of the end of the hand-feed paper cassette 82 and picks up these sheets one by one and feeds to the paper conveying path S.

Also, the registration roller 13 serves to temporarily hold the sheet conveyed on the sheet conveying path S. Then, the registration roller 13 has the ability to convey the sheet to the transfer roller 10 at timing when the top of the toner image on the photoconductor drum 3 is registered with the top of the sheet.

The fuser unit 7 is provided with a heat roller 71 and a pressure roller 72, which are so designed as to be rotated with the sheet being sandwiched therebetween. Also, the heat roller 71 is so designed to be set to a prescribed temperature by a control section based on the signals from a temperature detector (not shown). The heat roller 71 together with the pressure roller 72 thermally presses the toner to the sheet to thereby melt, mix and pressure-bond the multicolor image transferred to the sheet, thereby thermally fixing the image to the sheet. Also, an external heating belt 73 that heats the heat roller 71 from the outside is installed.

Next, the sheet conveying path will be explained in detail. As mentioned above, the image forming apparatus is provided with the paper feed cassette 81 and hand-feed paper cassette 82 which store sheets in advance. In order to feed sheets from these paper feed cassettes 81 and 82, the pickup rollers 11*a*, 11*b* are each installed to guide these sheets one by one to the conveying path S.

The sheets conveyed from each of the paper feed cassettes 81 and 82 to the registration roller 13 by the conveying roller 12*a* of the paper feed conveying path S and then conveyed at timing when the top of the sheet is registered with the top of the image information on the intermediate transfer belt 61, whereby the image information is written on the sheet. Then, the sheet is allowed to pass through the fuser unit 7 to thereby melt and fix unfixed toners on the sheet, and the sheet is then discharged to the paper discharge tray 91 through the conveying roller 12*b* disposed downstream.

The above conveying path is used in the case of simplex printing requirements. In the case of duplex printing requirements on the other hand, the conveying roller 12*b* is reversely rotated when the aforementioned simplex printing is finished and the rear end of the sheet passed through the fuser unit 7 is held by the final conveying roller 12*b*, to thereby guide the sheet to the conveying rollers 12*c* and 12*d*. Then, after printing on the backside of the sheet through registration roller 13, the sheet is discharged to the paper discharge tray 91.

EXAMPLES

The present invention will be explained in detail by way of synthetic examples of the diamine compound represented by the formula (1), examples and comparative examples, which are, however, intended to be limiting of the present invention.

<Synthetic Example of a Diamine Compound>

The chemical structure, molecular weight and elemental analysis of compounds obtained in the following Synthetic Examples were measured by NMR, LC-MS, elemental analysis and FT-IR to confirm that a target compound was obtained.

Synthetic Example 1

Using dibenzylamine as the amine compound represented by the formula (6) or (7) and 4,4'-bis(chloromethyl)phenyl as the dihalogen compound represented by the formula (8) in the above reaction formula, the exemplified compound No. 2 was synthesized according to the following reaction scheme.

Exemplified compound No. 2

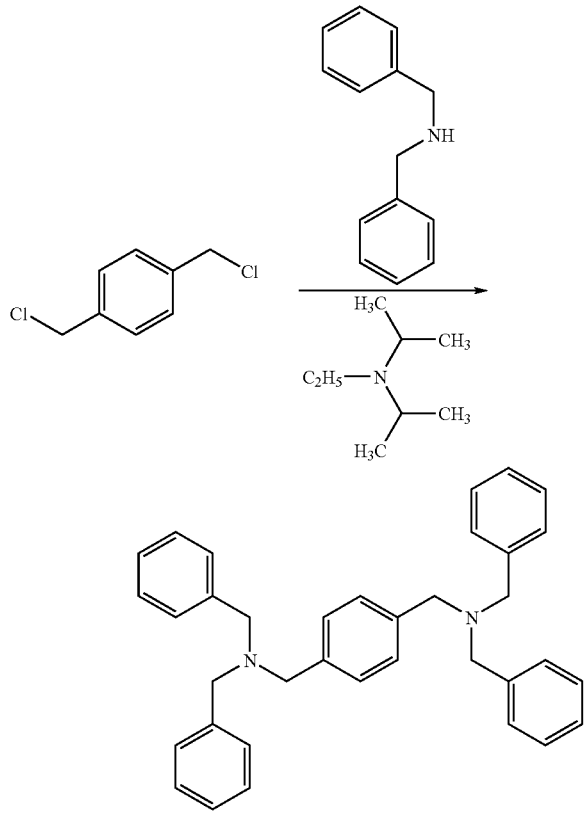

6.06 g (1.0 equivalent) of 4,4'-bis(chloromethyl)-phenyl and 10.0 g (2.1 equivalents) of dibenzylamine were added to 50 ml of 1,4-dioxane anhydride and the mixture was cooled in an ice bath. 6.86 g (2.2 equivalents) of N,N-diisopropylethylamine was gradually added in this solution. Then, the ice bath was removed and the solution was gradually heated to raise the reaction temperature to 100 to 110° C. to agitate the solution for 4 hours under heating so as to keep a temperature of 100 to 110° C.

After the reaction was finished, the reaction solution was allowed to cool, and the generated precipitates were collected by filtration and thoroughly washed with water. Then, the precipitates were recrystallized from a mixed solvent of ethanol and ethyl acetate (ethanol:ethyl acetate=8:2 to 7:3) to obtain 11.9 g of a white powdery compound. The obtained compound was analyzed by NMR, LC-MS, elemental analysis, FT-IR and the like. From these results, the obtained white powdery compound was confirmed to be a diamine compound of the exemplified compound No. 2.

Synthetic Examples 2 to 11

The exemplified compounds No. 1, 4, 8, 14, 22, 29, 38, 50, 53 and 57 were synthesized in the same manner as in Synthetic Example 1 except that each raw material compound shown in the following Table 2 was used as the amine compound represented by the formula (6) or (7) and as the dihalogen compound represented by the formula (8) in the above Synthetic Example 1. The raw compound of the exemplified compound No. 2 is shown together in

TABLE 4

| Compound | Amine compound: Formula (V) | Amine compound: (VI) | Dihalogen compound Formula (VII) |
|---|---|---|---|
| Production Example 1 Exemplified comp. No. 1 | 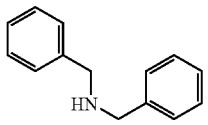 | 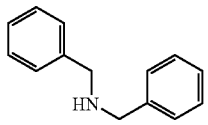 | 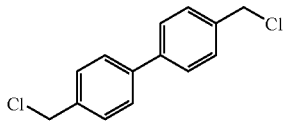 |
| Production Example 2 Exemplified comp. No. 2 | 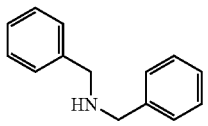 | 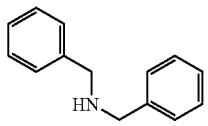 | 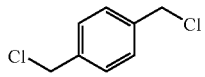 |
| Production Example 3 Exemplified comp. No. 4 | 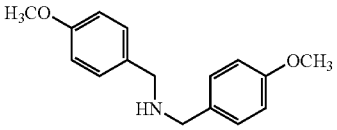 | 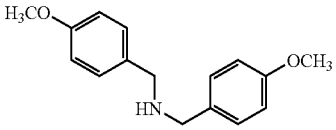 | 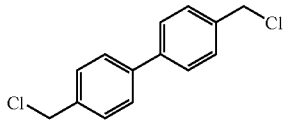 |
| Production Example 4 Exemplified comp. No. 8 | 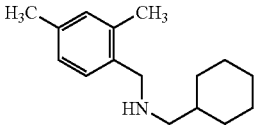 | 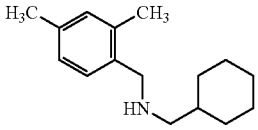 | 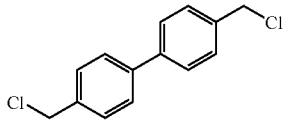 |
| Production Example 5 Exemplified comp. No. 14 | 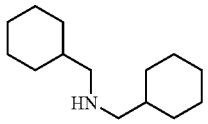 | 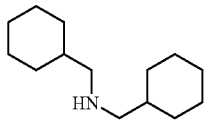 | 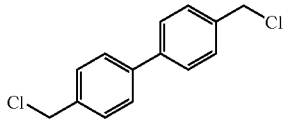 |
| Production Example 6 Exemplified comp. No. 22 | 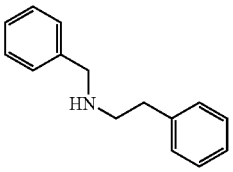 | 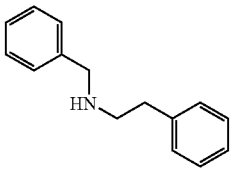 | 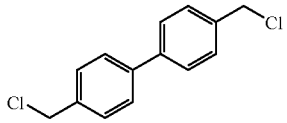 |
| Production Example 7 Exemplified comp. No. 29 | 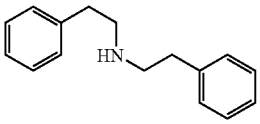 | 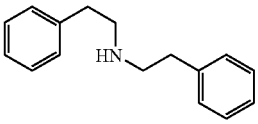 | 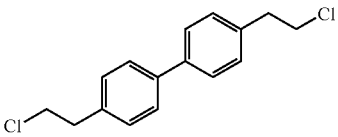 |
| Production Example 8 Exemplified comp. No. 38 | 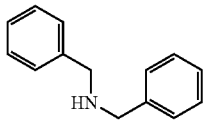 | 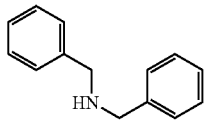 | 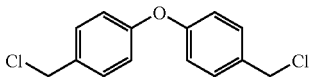 |

TABLE 4-continued

| Compound | Amine compound Formula (V) | (VI) | Dihalogen compound Formula (VII) |
|---|---|---|---|
| Production Example 9 Exemplified comp. No. 50 | 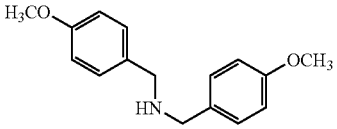 | 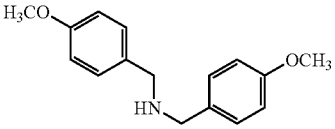 | 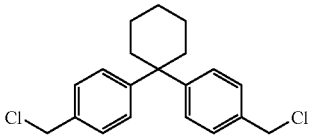 |
| Production Example 10 Exemplified comp. No. 53 | 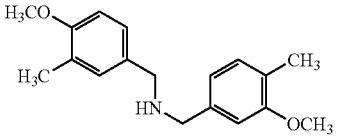 | 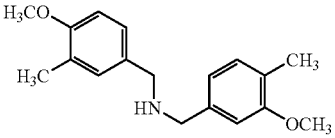 | 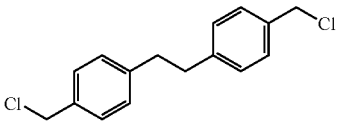 |
| Production Example 11 Exemplified comp. No. 57 | 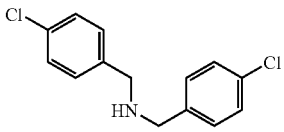 | 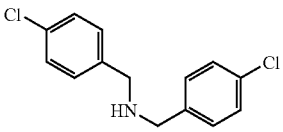 | 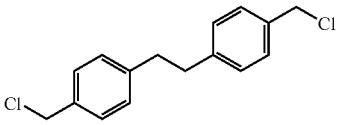 |

Also, with regard to each exemplified compound obtained in the above Synthetic Examples 1 to 11, an elemental analysis value, calculated value of the molecular weight and the actual value [M+H] measured by LC-MS are shown in the following Tables 5-1 and 5-2.

TABLE 5-1

| Compound | Structual formula | Elemental analysis C(%) H(%) N(%) | LC-MS |
|---|---|---|---|
| Production Example 1 Exemplified comp. No. 1 | 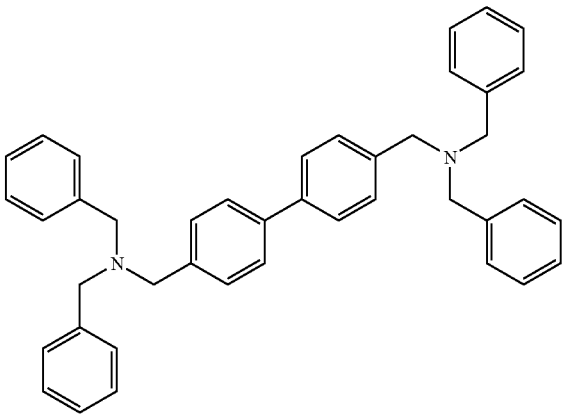 | Theoretical value<br>88.07 7.04 4.89<br>Measured value<br>87.25 6.88 4.42 | Calculated value<br>572.3<br>Measured value $[M + H]^+$<br>573.2 |
| Production Example 2 Exemplified comp. No. 2 | 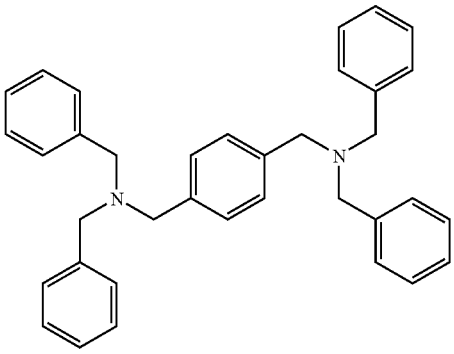 | Theoretical value<br>87.05 7.31 5.64<br>Measured value<br>86.75 6.98 5.35 | Calculated value<br>496.3<br>Measured value $[M + H]^+$<br>497.5 |

TABLE 5-1-continued

| Compound | Structual formula | Elemental analysis C(%) H(%) N(%) | LC-MS |
|---|---|---|---|
| Production Example 3 Exemplified comp. No. 4 | 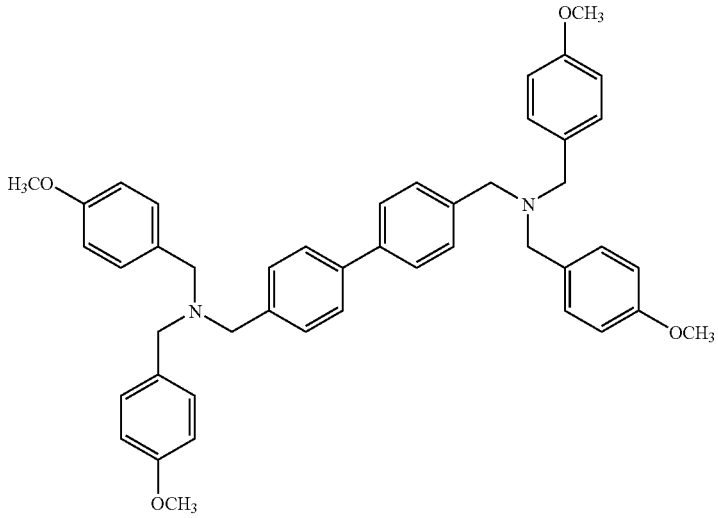 | Theoretical value 79.74 6.98 4.04 Measured value 79.01 6.64 3.75 | Calculated value 692.36 Measured value $[M + H]^+$ 693.7 |
| Production Example 4 Exemplified comp. No. 8 | 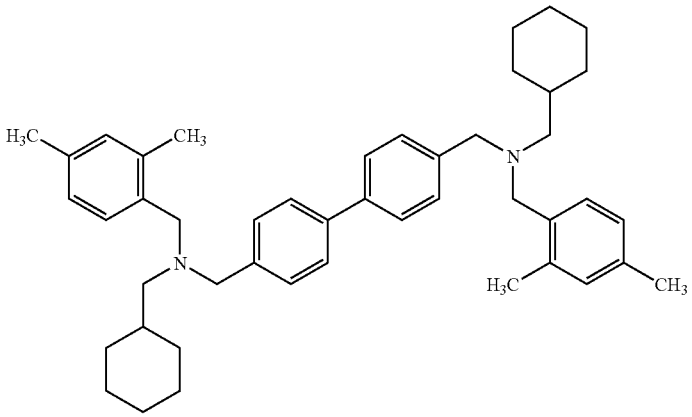 | Theoretical value 86.20 9.43 4.37 Measured value 85.87 9.14 4.05 | Calculated value 640.08 Measured value $[M + H]^+$ 641.5 |
| Production Example 5 Exemplified comp. No. 14 | 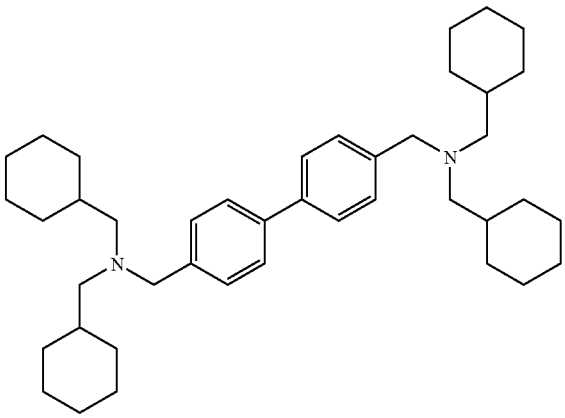 | Theoretical value 84.50 10.81 4.69 Measured value 83.71 10.24 4.31 | Calculated value 596.52 Measured value $[M + H]^+$ 597.3 |

TABLE 5-2

| Compound | Structual formula | Elemental analysis C(%) H(%) N(%) | LC-MS |
|---|---|---|---|
| Production Example 6 Exemplified comp. No. 22 | 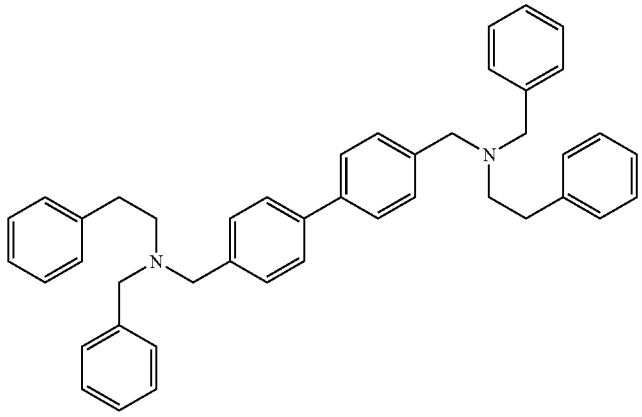 | Theoretical value 87.96 7.38 4.66 Measured value 87.05 6.97 4.21 | Calculated value 600.35 Measured value $[M + H]^+$ 601.6 |
| Production Example 7 Exemplified comp. No. 29 | 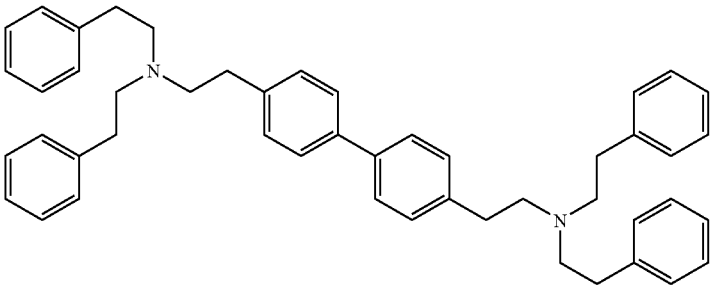 | Theoretical value 87.76 7.98 4.26 Measured value 87.04 7.41 3.97 | Calculated value 656.41 Measured value $[M + H]^+$ 657.5 |
| Production Example 8 Exemplified comp. No. 38 | 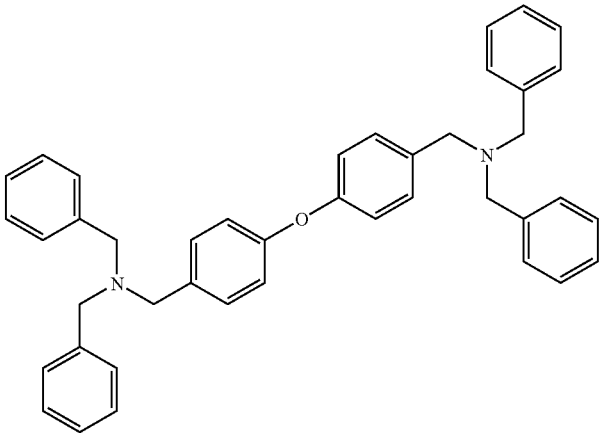 | Theoretical value 85.68 6.85 4.76 Measured value 84.97 6.47 4.28 | Calculated value 588.31 Measured value $[M + H]^+$ 589.7 |
| Production Example 9 Exemplified comp. No. 50 | 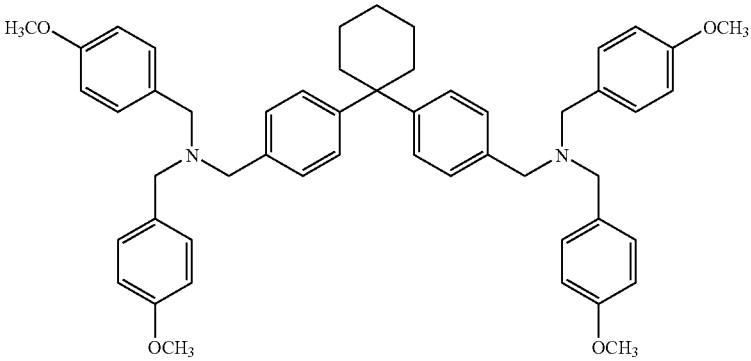 | Theoretical value 80.59 7.54 3.61 Measured value | Calculated value 774.44 Measured value $[M + H]^+$ |

TABLE 5-2-continued

| Compound | Structual formula | Elemental analysis C(%) H(%) N(%) | LC-MS |
|---|---|---|---|
| Production Example 10 Exemplified comp. No. 53 | 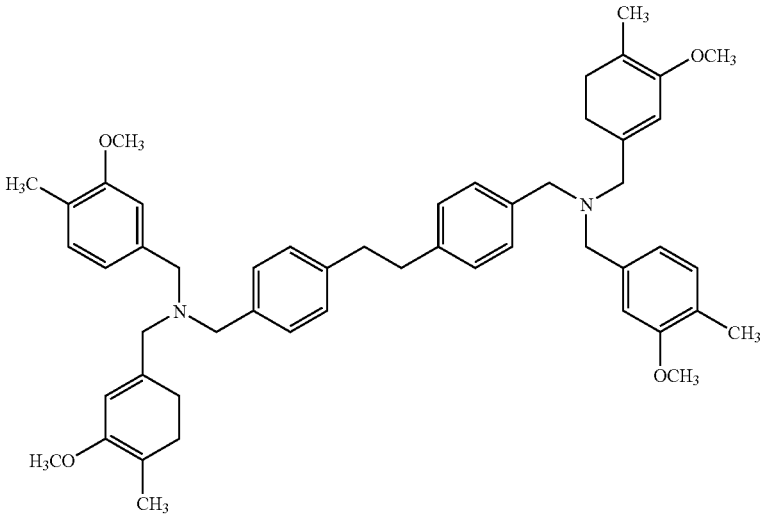 | Theoretical value<br>80.38 7.78 3.61<br>Measured value<br>79.47 7.28 3.27 | Calculated value<br>776.46<br>Measured value<br>$[M + H]^+$<br>777.6 |
| Production Example 11 Exemplified comp. No. 57 | 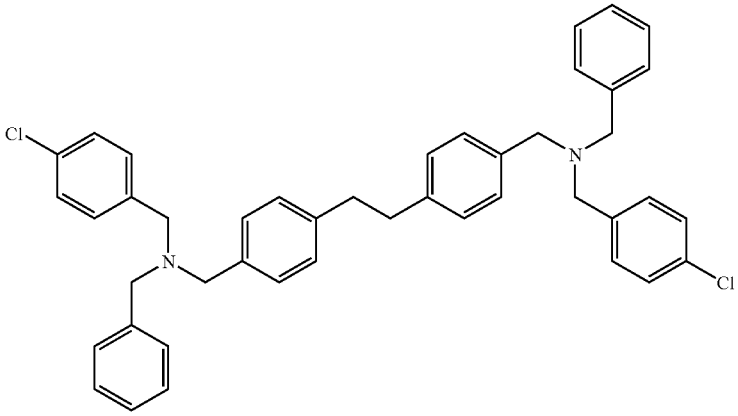 | Theoretical value<br>78.91 6.32 4.18<br>Measured value<br>78.14 5.94 3.87 | Calculated value<br>668.27<br>Measured value<br>$[M + H]^+$<br>669.5 |

<Production Example of a Polyarylate Resin>

Production Example 1

Preparation of a Structural Formula (1-3)

Sodium hydroxide (4.51 g) and $H_2O$ (400 ml) were weighed and put in a 1 L beaker and stirred with bubbling using nitrogen to dissolve sodium hydroxide. p-tert-butylphenol (0.33 g), benzyltriethylammonium chloride (0.0567 g) and 2,2-bis(4-hydroxy-3,5-dimethylphenyl) propane-[tetramethylbisphenol A] (11.99 g) were added in this order to the reaction solution and these components were stirred, and then, this aqueous alkali solution was transferred to a 1 L reaction vessel (polymerization tank).

Separately, terephthalic acid chloride (8.80 g) was dissolved in dichloromethane (200 ml) and the solution was transferred to the inside of a 200 ml dropping funnel.

The external temperature of the polymerization tank was kept at 20° C. and the dichloromethane solution was added dropwise to the aqueous alkali solution with stirring the aqueous alkali solution in the reaction vessel over one hour. The stirring was further continued for 3 hours and then, acetic acid (1.49 ml) and dichloromethane (100 ml) were added to the solution, which was then stirred for 30 minutes. Then, the stirring was terminated to separate the organic layer.

This organic layer was washed twice with an aqueous sodium 0.1 N hydroxide solution (226 ml), then twice with 0.1 N hydrochloric acid (226 ml) and then twice with $H_2O$ (226 ml).

The organic layer obtained after the above washing was finished was poured into methanol (1500 ml) to obtain precipitates. The obtained precipitates were collected by filtration and dried to obtain a target polyarylate resin (1-3). The viscosity average molecular weight of the obtained polyarylate resin (1-3) was 23,200.

The viscosity average molecular weight of the resin obtained in the production examples was measured and calculated by the following methods. The polyarylate resin was dissolved in dichloromethane to prepare a solution having a concentration C of 6.00 g/L. Using a Ubbelohde's capillary viscometer so designed that the down-flow time $t_0$ of a solvent (dichloromethane) was 136.16 sec, the down-flow time t of a sample solution was measured in a constant-temperature water bath kept at 20.0° C. The viscosity average molecular weight Mv was calculated according to the following equation.

$$a=0.438\times\eta_{sp}+1 \quad \eta_{sp}=t/t_0-1$$

$$b=100\times\eta_{sp}/C \quad C=6.00\ (g/L)$$

$$n=b/a$$

$$Mv=3207\times\eta^{1.205}$$

Production Examples 2 to 5

Polyarylate resins having the structural formulae (1-1), (1-2), (1-6) and (1-12) in the above Tables 3-1 to 3-3 were produced in the same manner as in Production Example 1 except that bisphenols, phthalic acid chlorides and isophthalic acid chlorides shown in the following table were used.

TABLE 6

| | Bisphenol |
|---|---|
| Structual formula (1-1) | 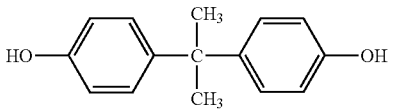 |
| Structual formula (1-2) | 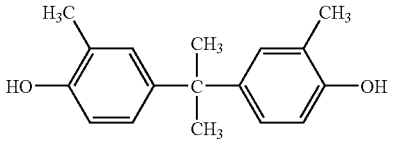 |
| Structual formula (1-3) | 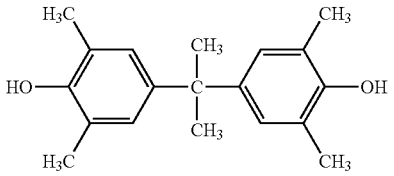 |
| Structual formula (1-6) | 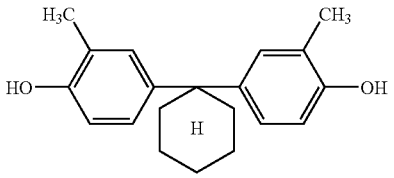 |
| Structual formula (1-12) | 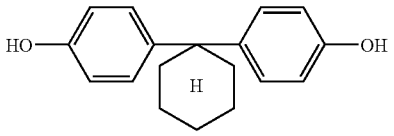 |
| Phthalic acid chloride | 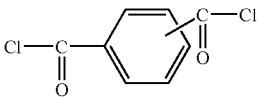 |

First, a photosensitive layer was formed on an aluminum cylindrical support having a diameter of 30 mm and a length of 340 mm in various conditions to prepare photoconductors of examples and comparative examples. These photoconductors were explained below.

Example 1

3 parts by weight of titanium oxide TTO-MI-1 (manufactured by Ishihara Sangyo Kaisha Ltd.), 3 parts by weight of CM-8000 (manufactured by Toray Industries, Ltd., alcohol-soluble nylon resin), 60 parts by weight of methanol, and 40 parts by weight of 1,3-dioxolan were subjected to dispersing treatment performed using a paint shaker for 10 hours to prepare 3 L of an undercoat layer coating solution.

The prepared undercoat layer coating solution was applied to form a film on an aluminum cylindrical support having a diameter of 30 mm and a length of 340 mm by the dip coating method in a film thickness of 0.9 μm to form an undercoat layer.

Next, 10 parts by weight of a butyral resin (trade name: Esreck BM-2, manufactured by Sekisui Chemical Co., Ltd.), 1400 parts by weight of 1,3-dioxolan and 15 parts by weight of titanylphthalocyanine (manufactured by, for example, the known method described in the publication of JP-No. 3569422) represented by the following structural formula (9) by dispersing using a ball mill for 72 hours to produce 3 L of a charge generation layer coating solution.

(9)

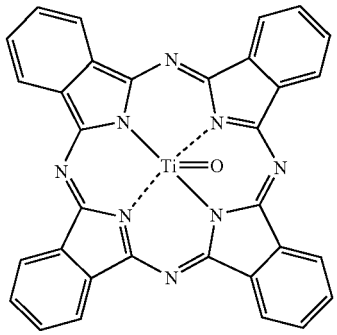

This coating solution was applied to the above aluminum cylindrical support to form a film in a film thickness of 0.2 μm by the dip coating method, thereby forming a charge generation layer.

Next, using 10 parts by weight of an enamine compound of the exemplified compound No. 5 which was represented by the above formula (4) and shown in Table 2 as the charge transport material, 0.1 parts by weight of a diamine compound of the exemplified compound No. 2 which was represented by the above formula (1) and shown in Table 1 as the additive, and 10 parts by weight of a polyarylate resin (viscosity average molecular weight: 23,200) having a structural unit represented by the structural formula (1-3) shown in the above Table 3-1 as the binder resin, these components were dissolved in a mixed solvent containing 40 parts by weight of tetrahydrofuran and 40 parts by weight of toluene to prepare 3 L of a charge transport coating solution.

This charge transport layer coating solution was applied to the previously formed charge generation layer by the dip coating method and then dried at 130° C. for one hour to form a charge transport layer having a film thickness of 25 μm, thereby manufacturing a photoconductor of Example 1. Also, a photoconductor with the charge transport layer having a film thickness of 15 μm was manufactured in the same manner as above to evaluate the ozone gas resistance which will be described later.

Examples 2 to 4

Photoconductors of Examples 2 to 4 were produced in the same manner as in Example 1 except that diamine compounds of the exemplified compounds No. 1, No. 4 and No. 8 which were represented by the above formula (1) and shown in the above Table 1-1 were used as the additive of the charge transport layer coating solution.

Examples 5 to 8

Photoconductors of Examples 5 to 8 were produced in the same manner as in Example 1 except that polyarylate resins having structural units represented by the structural formulae (1-2), (1-6), (1-1) and (1-12) shown in the above Tables 3-1 to 3-3 were used as the binder resin of the charge transport layer coating solution.

Example 9

A photoconductor of Example 9 was produced in the same manner as in Example 1 except that 0.008 parts by weight of a diamine compound of the exemplified compound No. 2 which was represented by the formula (1) and shown in the above Table 1 was used as the additive of the charge transport layer coating solution.

Example 10

A photoconductor of Example 10 was produced in the same manner as in Example 1 except that 1.2 parts by weight of a diamine compound of the exemplified compound No. 2 which was represented by the formula (1) and shown in the above Table 1 was used as the additive of the charge transport layer coating solution.

Example 11

A photoconductor of Example 11 was produced in the same manner as in Example 1 except that 0.0004 parts by weight of a diamine compound of the exemplified compound No. 2 which was represented by the formula (1) and shown in the above Table 1 was used as the additive of the charge transport layer coating solution.

Example 12

A photoconductor of Example 12 was produced in the same manner as in Example 1 except that 2 parts by weight of a diamine compound of the exemplified compound No. 2 which was represented by the formula (1) and shown in the above Table 1 was used as the additive of the charge transport layer coating solution.

Examples 13 and 14

Photoconductors of Examples 13 and 14 were produced in the same manner as in Example 1 except that enamine compounds of the exemplified compounds No. 3 and No. 6 which were represented by the above formula (4) and shown in the above Table 2 were used as the charge transport material of the charge transport layer coating solution.

Example 15

A photoconductor of Example 15 was produced in the same manner as in Example 1 except that a butadiene-based compound (trade name: T-405, manufactured by Takasago Corporation) represented by the following formula (10) was used as the charge transport material of the charge transport layer coating solution.

(10)

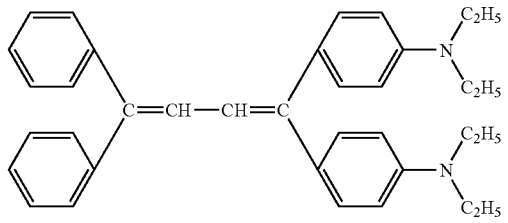

Example 16

A photoconductor of Example 16 was produced in the same manner as in Example 1 except that a styryl-based compound (manufactured by Hodogaya Chemical Co., Ltd.) represented by the following formula (11) was used as the charge transport material of the charge transport layer coating solution.

(11)

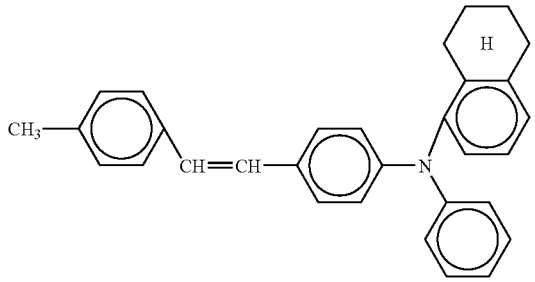

Example 17

A photoconductor of Example 17 was produced in the same manner as in Example 1 except that the undercoat layer was not formed.

Example 18

8 parts by weight of titanylphthalocyanine represented by the above structural formula (9) was mixed as the charge generation material in 100 parts by weight of tetrahydrofuran were subjected to dispersing treatment performed using a paint shaker. Then, 80 parts by weight of an enamine compound of the exemplified compound No. 5 which was represented by the above formula (4) and shown in the above Table 2, 2 parts by weight of a diamine compound of the exemplified compound No. 2 which was represented by the above formula (1) and shown in the above Table 1-1 as the additive, 100 parts by weight of a polyarylate resin (viscosity average molecular weight: 23,200) having a structural unit represented by the structural formula (1-3) shown in the above Table 3-1 as the binder resin, 300 parts by weight of tetrahydrofuran and 400 parts by weight of toluene were mixed in the above dispersed solution and the mixture was stirred to prepare 3 L of a photosensitive layer coating solution.

This coating solution was applied to an aluminum cylindrical support having a diameter of 30 mm and a length of 340 mm by the dip coating method and dried at 130° C. for one hour to form a photosensitive layer having a film thickness of 25 μm. Thus, a monolayer type photoconductor having a structure shown in FIG. 3 was manufactured. Also, a photoconductor with the charge transport layer having a film thickness of 15 μm was manufactured in the same manner as above to evaluate the ozone gas resistance which will be described later.

Example 19

The undercoat layer, the charge generation layer and the charge transport layer were formed in the same manner as in Example 1.

Next, 0.75 parts by weight of a diamine compound of the exemplified compound No. 2 shown in the above Table 1-1 and 30 parts by weight of a polycarbonate resin (trade name: PCZ400, manufactured by Mitsubishi Gas Chemical Company Ltd.) were mixed with each other and cyclohexanone was added as a solvent to the mixture to prepare 3 L of a surface protective layer forming coating solution having a solid content of 10% by weight. This surface protective layer forming coating solution was applied to the surface of the previously formed charge transport layer by the dip coating method and then dried at 150° C. for 30 minutes to form a surface protective layer having a film thickness of 1 μm, thereby manufacturing a photoconductor having the structure shown in FIG. 4.

Comparative Example 1

A photoconductor was manufactured in the same manner as in Example 1 except that the additive was not used for the charge transport layer coating solution.

Comparative Example 2

A photoconductor was manufactured in the same manner as in Example 1 except that a compound (trade name: K-NOX BHT, manufactured by Kyodo Yakuhin (sha)) represented by the following formula (12) was used as the additive for the charge transport layer coating solution.

(12)

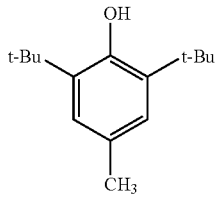

Comparative Example 3

A photoconductor was manufactured in the same manner as in Example 1 except that a known antioxidant (manufactured by Tokyo Kasei Kogyo Co., Ltd.) represented by the following formula (13) was used as the additive for the charge transport layer coating solution.

(13)

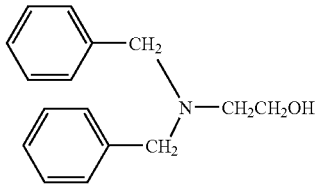

Comparative Example 4

A photoconductor was manufactured in the same manner as in Example 1 except that a polycarbonate resin (trade name: PCZ 400, manufactured by Mitsubishi Gas Chemical Company Ltd.) was used as the binder resin for the charge transport layer coating solution.

Comparative Example 5

A photoconductor was manufactured in the same manner as in Comparative Example 2 except that a polycarbonate resin (trade name: PCZ 400, manufactured by Mitsubishi Gas Chemical Company Ltd.) was used as the binder resin for the charge transport layer coating solution.

Comparative Example 6

A photoconductor was manufactured in the same manner as in Comparative Example 4 except that the additive was not used for the charge transport layer coating solution.

Each photoconductor of Examples 1 to 19 and Comparative Examples 1 to 6 was set every color to a test machine prepared by remodeling a multi-function peripheral MX-2000 (manufactured by Sharp Corporation) such that the developing device could be exchanged for the surface potential measuring device to evaluate the photoconductor.

In Example 19, the charging and transfer polarities were made to be positive by remodeling to evaluate.

(Evaluation of Electric Characteristics)

The developing machine was dismounted from the remodeled machine of MX-2000 (trade name, manufactured by Sharp Corporation) and the surface potential measuring device (trade name: Model 344, manufactured by Treck Japan) was mounted on the developing position instead. Using this multi-function peripheral, the surface potential of the photoconductor when exposure using laser light was not carried out was adjusted to −650 V in the normal temperature/normal humidity (N/N: Normal temperature/Normal humidity) environment of a temperature of 25° C. and a relative humidity of 50%. Under this condition, the photoconductor was exposed (0.4 μJ/cm$^2$) with laser light to measure the initial surface potential of the photoconductor as an exposure potential VL (V). After the following evaluation of scratch resistance, the surface potential after the test was also likewise measured as the exposure potential VL (V). The smaller the difference ΔVL (V) between the exposure potentials before and after the scratch resistance test, the more excellent the repetitive characteristics are evaluated to be.

<Criterion>

⊙: ΔVL<80 (V)

○: 80 (V)≦ΔVL<150 (V)

x: 150 (V)≦ΔVL (Evaluation of Scratch Resistance)

The pressure at which the cleaning blade of the cleaning device provided in the MX-2000 remodel was in contact with the photoconductor, that is, the so-called cleaning blade pressure was adjusted to an initial line pressure of 21 gf/cm ($2.06\times10^{-1}$ N/cm: initial line pressure). The above character test chart was formed on 100000 recording sheets every photoconductor under the N/N environment to make scratch resistance test.

The thickness of the photosensitive layer was measured when the scratch resistance test was started and just after 100000 sheets were printed, by using a film thickness measuring device (trade name: F-20-EXR, manufactured by Fimetrix). The amount of abrasion of the photoconductor per 100000 rotations was found from a difference between the thickness when the scratch resistance test was started and the thickness just after 100000 sheets were printed. The scratch resistance was evaluated from the amount of abrasion according to the following standard. The larger the amount of abrasion is, the more greatly the scratch resistance is evaluated to be inferior.

<Criterion>

⊙: Amount of abrasion d<1.0 μm/100 k rotations

○: 1.0 μm/100 k rotations≦amount d of abrasion<1.6 μm/100 k rotations x: 1.6 μm/100 k rotations≦amount d of abrasion ΔVL (Image Deterioration and Evaluation of Mechanical Durability)

The pressure at which the cleaning blade of the cleaning device provided in the MX-2000 remodel was in contact with the photoconductor, that is, the so-called cleaning blade pressure was adjusted to an initial line pressure of 21 gf/cm ($2.06\times10^{-1}$ N/cm: initial line pressure). A character/photographic test chart was formed on 40000 A4-size sheets under an environment of 25° C. and relative humidity of 50% to make test.

(Evaluation of Image Deterioration)

In order to investigate the level of a deterioration in image quality after the test, it was observed whether a band-shaped unevenness with a difference in image density was present or not in a half-tone image made to have 80/255 gradations by modulating the pulse width of a semiconductor laser after allowed to stand overnight after 40000 sheets were printed. The criterion of an image is as follows.

<Criterion>

⊙: No uneven density is found in the halftone image by visual observation, good image.

○: One or two band-shaped uneven density parts are found in the halftone image by visual observation. However, this is practically no problematic level.

x: Three or more band-shaped uneven density parts are found in the halftone image by visual observation, and this is practically problematic level.

(Evaluation of Ozone Gas Resistance)

Each photoconductor (layer thickness of the charge transport layer, or of the photosensitive layer in the case of a monolayer: 15 μm) was mounted on the above test multifunction peripheral to measure the surface potential $V_1$ (V) just after the photoconductor was charged and the surface potential $V_2$ (V) of the photosensitive layer 3 seconds after the photosensitive layer was charged. The surface potential $V_1$ (V) just after the photoconductor was charged and the surface potential $V_2$ (V) of the photosensitive layer 3 seconds after the photosensitive layer was charged were substituted in the equation (I) to calculate a charge retentivity DD (%), which was defined as an initial charge retentivity $DD_0$.

$$\text{Charge retentivity } DD_0 = \frac{V_2(V)}{V_1(V)} \times 100 \quad (1)$$

Then, using an ozone generation/control instrument (trade name: OES-10A, manufactured by Dairec (k.k.)), each photoconductor was exposed to ozone in a closed container in which the concentration of ozone was adjusted to about 7.5 ppm (confirmed by an ozone densitometer MODEL 1200 (trade name), manufactured by Dairec (k.k.)) for 20 hours. After exposed to ozone, the photoconductor was allowed to stand in an environment of a temperature of 25° C. and a relative humidity of 50% for 2 hours and then, the charge retention rate DD (%) was calculated in the same manner as that before the photoconductor was exposed to ozone and the obtained value was defined as charge retention rate $DD_{02}$ measured after the photoconductor was exposed to ozone.

The charge retention rate $DD_{02}$ after the photoconductor was exposed to ozone was subtracted from the charge retention rate $DD_0$ before the photoconductor was exposed to ozone to obtain charge retention rate variation ΔDD (=$DD_0-DD_{02}$) as the index of evaluation of ozone gas resistance.

<Criterion>

⊙: ΔDD<3.5

○: 3.5≦ΔDD<5.0 x: 5.0≦ΔDD (Overall Evaluation)

Based on the results of the ratings of the above three items, each photoconductor is overall evaluated according to the following standard.

⊙: Four items are all ⊙.

○: Four items are all ⊙ or ○.

x: At least one item is x.

The evaluated results are shown in Table 7 below.

TABLE 7

| | Additive | | | Charge | | Surface | Evaluation of |
|---|---|---|---|---|---|---|---|
| | Compound | Amount to be added | Binder resin | transport material | Undercoat layer | protective layer | image deterioration |
| Ex. 1 | Table 1-No. 2 | 2.5% | Table 3-(1-3) | Table 2-No. 5 | present | absent | ⊙ |
| Ex. 2 | Table 1-No. 1 | 2.5% | Table 3-(1-3) | Table 2-No. 5 | present | absent | ⊙ |
| Ex. 3 | Table 1-No. 4 | 2.5% | Table 3-(1-3) | Table 2-No. 5 | present | absent | ⊙ |
| Ex. 4 | Table 1-No. 8 | 2.5% | Table 3-(1-3) | Table 2-No. 5 | present | absent | ⊙ |
| Ex. 5 | Table 1-No. 2 | 2.5% | Table 3-(1-2) | Table 2-No. 5 | present | absent | ⊙ |
| Ex. 6 | Table 1-No. 2 | 2.5% | Table 3-(1-6) | Table 2-No. 5 | present | absent | ⊙ |
| Ex. 7 | Table 1-No. 2 | 2.5% | Table 3-(1-1) | Table 2-No. 5 | present | absent | ⊙ |
| Ex. 8 | Table 1-No. 2 | 2.5% | Table 3-(1-12) | Table 2-No. 5 | present | absent | ⊙ |
| Ex. 9 | Table 1-No. 2 | 0.1% | Table 3-(1-3) | Table 2-No. 5 | present | absent | ⊙ |
| Ex. 10 | Table 1-No. 2 | 15.0% | Table 3-(1-3) | Table 2-No. 5 | present | absent | ⊙ |
| Ex. 11 | Table 1-No. 2 | 0.005% | Table 3-(1-3) | Table 2-No. 5 | present | absent | ○ |
| Ex. 12 | Table 1-No. 2 | 25.0% | Table 3-(1-3) | Table 2-No. 5 | present | absent | ⊙ |

TABLE 7-continued

| | | | | | | | |
|---|---|---|---|---|---|---|---|
| Ex. 13 | Table 1-No. 2 | 2.5% | Table 3-(1-3) | Table 2-No. 3 | present | absent | ◎ |
| Ex. 14 | Table 1-No. 2 | 2.5% | Table 3-(1-3) | Table 2-No. 6 | present | absent | ◎ |
| Ex. 15 | Table 1-No. 2 | 2.5% | Table 3-(1-3) | Structural formula10 | present | absent | ◎ |
| Ex. 16 | Table 1-No. 2 | 2.5% | Table 3-(1-3) | Structural formula 11 | present | absent | ◎ |
| Ex. 17 | Table 1-No. 2 | 2.5% | Table 3-(1-3) | Table 2-No. 5 | absent | absent | ◎ |
| Ex. 18 | Table 1-No. 2 | 2.5% | Table 3-(1-3) | Table 2-No. 5 | absent (monolayer type) | present | ◎ |
| Ex. 19 | Table 1-No. 2 | 2.5% (based on the binder resin in the surface protective layer) | PCZ400 (binder resin in the surface protective layer) | Table 2-No. 5 | present | present | ◎ |
| Comp. Ex. 1 | absent | — | Table 3-(1-3) | Table 2-No. 5 | present | absent | X |
| Comp. Ex. 2 | Structural formula12 | 2.5% | Table 3-(1-3) | Table 2-No. 5 | present | absent | X |
| Comp. Ex. 3 | Structural formula13 | 2.5% | Table 3-(1-3) | Table 2-No. 5 | present | absent | X |
| Comp. Ex. 4 | Table 1-No. 2 | 2.5% | PCZ400 | Table 2-No. 5 | present | absent | ◎ |
| Comp. Ex. 5 | Structural formula12 | 2.5% | PCZ400 | Table 2-No. 5 | present | absent | X |
| Comp. Ex. 6 | absent | — | PCZ400 | Table 2-No. 5 | present | absent | X |

| | Evaluation of ozone gas resistance | | Scratch resistance | | Exposure potential (−V) | | | | |
|---|---|---|---|---|---|---|---|---|---|
| | ΔDD | Evaluation | Amount of abrasion (μm/100K rotation) | Evaluation | Initial VL | VL after test | ΔDD | Evaluation | Overall evaluation |
| Ex. 1 | 2.7 | ◎ | 0.78 | ◎ | 58 | 73 | 15 | ◎ | ◎ |
| Ex. 2 | 3.3 | ◎ | 0.82 | ◎ | 61 | 98 | 37 | ◎ | ◎ |
| Ex. 3 | 3.1 | ◎ | 0.77 | ◎ | 59 | 84 | 25 | ◎ | ◎ |
| Ex. 4 | 2.8 | ◎ | 0.76 | ◎ | 56 | 92 | 36 | ◎ | ◎ |
| Ex. 5 | 2.9 | ◎ | 0.85 | ◎ | 64 | 88 | 24 | ◎ | ◎ |
| Ex. 6 | 2.7 | ◎ | 0.92 | ◎ | 67 | 91 | 24 | ◎ | ◎ |
| Ex. 7 | 3.0 | ◎ | 0.88 | ◎ | 72 | 94 | 22 | ◎ | ◎ |
| Ex. 8 | 2.8 | ◎ | 0.71 | ◎ | 59 | 88 | 29 | ◎ | ◎ |
| Ex. 9 | 3.4 | ◎ | 0.75 | ◎ | 52 | 87 | 35 | ◎ | ◎ |
| Ex. 10 | 2.2 | ◎ | 0.89 | ◎ | 66 | 123 | 57 | ◎ | ◎ |
| Ex. 11 | 4.3 | ○ | 0.72 | ◎ | 50 | 72 | 22 | ◎ | ○ |
| Ex. 12 | 1.8 | ◎ | 0.91 | ◎ | 59 | 152 | 93 | ○ | ○ |
| Ex. 13 | 3.2 | ◎ | 0.84 | ◎ | 68 | 89 | 21 | ◎ | ◎ |
| Ex. 14 | 2.8 | ◎ | 0.96 | ◎ | 49 | 84 | 35 | ◎ | ◎ |
| Ex. 15 | 3.3 | ◎ | 1.37 | ○ | 45 | 74 | 29 | ◎ | ○ |
| Ex. 16 | 3.1 | ◎ | 1.53 | ○ | 105 | 142 | 37 | ◎ | ○ |
| Ex. 17 | 3.4 | ◎ | 0.79 | ◎ | 38 | 89 | 51 | ◎ | ◎ |
| Ex. 18 | 1.9 | ◎ | 1.13 | ○ | 87 | 110 | 23 | ◎ | ○ |
| Ex. 19 | 3.8 | ◎ | 0.67 | ◎ | 74 | 156 | 82 | ○ | ○ |
| Comp. Ex. 1 | 8.3 | X | 0.77 | ◎ | 83 | 91 | 8 | ◎ | X |
| Comp. Ex. 2 | 5.2 | X | 0.83 | ◎ | 62 | 93 | 31 | ◎ | X |
| Comp. Ex. 3 | 4.5 | ○ | 0.88 | ◎ | 58 | 86 | 28 | ◎ | X |
| Comp. Ex. 4 | 3.0 | ◎ | 1.78 | X | 64 | 88 | 24 | ◎ | X |
| Comp. Ex. 5 | 5.4 | X | 2.06 | X | 55 | 76 | 21 | ◎ | X |
| Comp. Ex. 6 | 9.1 | X | 1.64 | X | 65 | 82 | 17 | ◎ | X |

From the above results, Examples 1 to 19 and Comparative Example 4 using a diamine compound represented by the structural formula (1) in the charge transport layer and surface protective layer have excellent results in the evaluation of image deterioration after the evaluation of scratch resistance is made. However, Comparative Examples 1 to 3, 5 and 6 using other additives cause a blurring of character images and a deterioration in image after the scratch resistance test.

Also, Examples 1 to 18 using a polyarylate resin represented by the structural formula (1) in the charge transport layer, and Example 19 and Comparative Examples 1 to 3 are superior in scratch resistance and Comparative Examples 4 to 6 using a polycarbonate are more deteriorated in scratch resistance than Examples resultantly.

Moreover, Examples 1, and 9 to 12 are compared with each other as to the amounts of a diamine compound represented by the structural formula to be added, Examples 1, 9, 10 and 12 containing a diamine compound in an amount of 0.01% or more each have a high effect in the evaluation of image deterioration after the scratch resistance is evaluated. However, Example 11 containing a diamine compound in an amount less than 0.01%, a character image after the scratch resistance test is slightly blurred, to find that the amount of a diamine is insufficient.

Also, it is found that Example 12 in which the amount of a diamine exceeds 20% has a large exposure potential difference ΔVL and the amount is somewhat excessive. From this fact, the amount of a diamine compound is preferably in a range from 0.01% to 20%.

Also, when Examples 1, 13 to 16 are compared with each other as to a difference in the type of charge transport material contained in the charge transport layer, it is found that Examples 1, 13 and 14 using a charge transport material represented by the formula (4) are superior in scratch resistance and Examples 15 and 16 using a charge transport material except for the charge transport material of the formula (4) are slightly inferior in scratch resistance.

Therefore, it may be said to be desirable to use a charge transport material represented by the formula (4) to manufacture a more excellent photographic photoconductor.

As mentioned above, a photoconductor could be obtained which was superior in mechanical/electrical durability and was free from the generation of abnormal images such as image blurring even if it was used repeatedly for a long period, exhibiting so high durability that it could output a stable image for a long period by formulating a specified diamine compound and a specified polyarylate resin in the photosensitive layer.

The present invention can provide a photoconductor which is superior in mechanical/electrical durability and was free from the generation of abnormal images such as color unevenness even if it is used repeatedly for a long period, exhibiting so high durability that it can output a stable image for a long period, and can also provide a color image forming apparatus provided with the photoconductor.

What is claimed is:

1. An electrophotographic photoconductor containing at least a charge generation material and a charge transport material on a conductive support, the electrophotographic photoconductor being formed by laminating on the conductive support a monolayer type photosensitive layer containing the charge generation material and the charge transport material or a laminate type photosensitive layer in which a charge generation layer containing the charge generation material and a charge transport layer containing the charge transport material are laminated in this order;

the photoconductor comprising a diamine compound represented by the formula (1):

(1)

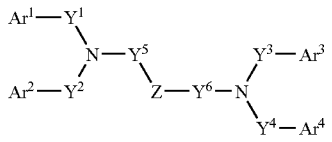

wherein $Ar^1$, $Ar^2$, $Ar^3$ and $Ar^4$ each independently represent an aryl, cycloalkyl or monovalent heterocyclic group which may have substituent(s); $Y^1$, $Y^2$, $Y^3$, $Y^4$, $Y^5$ and $Y^6$ each independently represent a straight chain alkylene group which may have substituent(s); Z is represented by i]] —$Ar^5$—, ii] —$Ar^5$—$Ar^6$— or iii] —$Ar^5$—W—$Ar^6$— wherein $Ar^5$ and $Ar^6$ each independently represent an arylene group or divalent heterocyclic residue which may have substituent(s); and W represents an oxygen atom, a sulfur atom or a straight or branched chain or cyclic alkylene group which may have substituent(s), and also a polyarylate resin having a structural unit represented by the following formula (1):

(I)

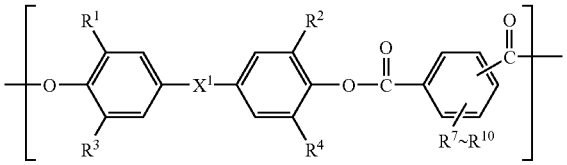

wherein $X^1$ represents a connecting group or —$CR^5R^6$— wherein $R^5$ and $R^6$ each independently represent a hydrogen atom, a halogen atom or an alkyl or aryl group which may have substituent(s) or $R^5$ and $R^6$ may be combined together with the carbon atom with which these groups are connected to form a cyclic structure;

$R^1$, $R^2$, $R^3$ and $R^4$ each independently represent a hydrogen atom, a halogen atom or an alkyl or aryl group which may have substituent(s);

$R^7$, $R^8$, $R^9$ and $R^{10}$ each independently represent a hydrogen atom, a halogen atom or an alkyl or aryl group which may have substituent(s);

wherein the photoconductor contains the charge transport material and the diamine compound in a ratio J/T ranged between 0.01/100 or more and 10.0/100 or less, and wherein J represents a weight of the diamine compound; and T represents a weight of the charge transport material contained in the monolayer type photosensitive layer when the monolayer type photosensitive layer is used; or contained in the charge transport layer when the laminate type photosensitive layer is used.

2. The electrophotographic photoconductor according to claim 1, wherein the diamine compound is represented by the following sub-formula (2):

(2)

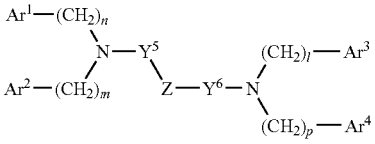

wherein $Ar^1$, $Ar^2$, $Ar^3$, $Ar^4$, $Y^5$, $Y^6$ and Z are the same as those defined in the formula (1); and l, m, n and p, which may be the same or different, denote an integer from 1 to 3.

3. The electrophotographic photoconductor according to claim 1, wherein the diamine compound is represented by the following sub-formula (3):

(3)

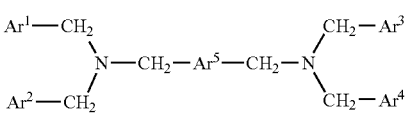

wherein $Ar^1$, $Ar^2$, $Ar^3$, $Ar^4$ and $Ar^5$ are the same as those defined in the formula (1).

4. The electrophotographic photoconductor according to claim 1, wherein the polyarylate resin has a structural unit represented by the formula (1) wherein;

$X^1$ represents a connecting group or —$CR^5R^6$— wherein $R^5$ and $R^6$ each independently represent a hydrogen atom, a halogen atom or a lower alkyl or aryl group which may have substituent(s) or $R^5$ and $R^6$ may be combined together with the carbon atom with which these groups are connected to form a cyclic structure;

$R^1$, $R^2$, $R^3$ and $R^4$ each independently represent a hydrogen atom, a halogen atom or a lower alkyl or aryl group which may have substituent(s); and $R^7$, $R^8$, $R^9$ and $R^{10}$ each independently represent a hydrogen atom, a halogen atom or an alkyl or aryl group which may have substituent(s).

5. The electrophotographic photoconductor according to claim 1, wherein the polyarylate resin has a structural unit represented by the formula (1) wherein;

$X^1$ represents a connecting group or —$CR^5R^6$— wherein $R^5$ and $R^6$ each independently represent a hydrogen atom, or a methyl, trifluoromethyl, phenyl or p-tolyl group, or $R^5$ and $R^6$ may be combined together with the carbon atom with which these groups are connected to form 1,1-cyclohexylene or 5,6,7,8-tetrahydro-6-naphthylidene group;

$R^1$, $R^2$, $R^3$ and $R^4$ each independently represent a hydrogen atom, a fluorine atom, a chlorine atom, or a methyl, ethyl, trifluoromethyl, phenyl or p-tolyl group; and $R^7$, $R^8$, $R^9$ and $R^{10}$ each independently represent a hydrogen atom, a fluorine atom, a chlorine atom, or a methyl, ethyl or trifluoromethyl group.

6. The electrophotographic photoconductor according to claim 1, wherein the photoconductor is further provided with an undercoat layer;

between the conductive support and the photosensitive layer when the photoconductor is provided with the monolayer type photosensitive layer; or between the conductive support and the charge generation layer when the photoconductor is provided with the laminate type photosensitive layer.

7. The electrophotographic photoconductor according to claim 1, wherein the photoconductor is further provided with a surface protective layer on the outside surface of the photosensitive layer in the case of using the monolayer type photosensitive layer or on the outside surface of the laminate type photosensitive layer in the case of using the laminate type photosensitive layer.

8. The electrophotographic photoconductor according to claim 1, wherein the diamine compound is contained in the photosensitive layer in the case of using the monolayer type photosensitive layer or in the charge transport layer in the case of using the laminate type photosensitive layer.

9. The electrophotographic photoconductor according to claim 1, wherein;

the monolayer type photosensitive layer when the monolayer type photosensitive layer is used; or the charge transport layer when the laminate type photosensitive layer is used contains;

an enamine type compound represented by the following formula (4):

(4)

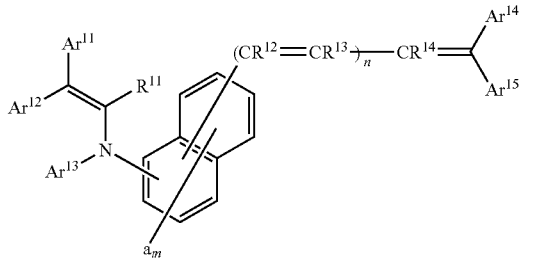

wherein $Ar^{11}$ and $Ar^{12}$ each independently represent an aryl or heterocyclic group which may have substituent(s); $Ar^{13}$ represents an aryl, heterocyclic, aralkyl or alkyl group which may have substituent(s); $Ar^{14}$ and $Ar^{15}$ each independently represent a hydrogen atom or an aryl, heterocyclic, aralkyl or alkyl group which may have substituent(s), provided that; $Ar^{14}$ and $Ar^{15}$ are each not a hydrogen atom at the same time and may be combined together with the carbon atom with which they are connected to form a cyclic structure; "a" represents a hydrogen atom, a halogen atom, or an alkyl, alkoxy, dialkylamino or aryl group which may have substituent(s); "m" denotes an integer from 1 to 6 when "m" is 2 or more, plural "a(s)", which may the same or different, may be combined together with the carbon atom with which they are connected to form a cyclic structure; $R^{11}$ represents a hydrogen atom, a halogen atom or an alkyl group which may have substituent(s); $R^{12}$, $R^{13}$ and $R^{14}$ each independently represent a hydrogen atom or an alkyl, aryl, heterocyclic or aralkyl group which may have substituent(s); "n" denotes an integer from 0 to 3, plural $R^{12}$s may be the same or different and plural $R^{13}$s may be the same or different when "n" is 2 or 3, provided that $Ar^{13}$ represents a heterocyclic group which may have substituent(s) when "n" is 0.

10. The electrophotographic photoconductor according to claim 9, wherein in the formula (4), the following partial structure represented by the following formula:

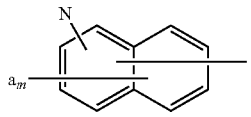

is a substituent selected from a group of substituents represented by the following formula:

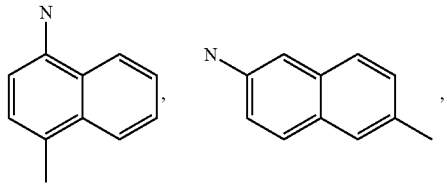

-continued

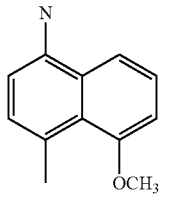

and

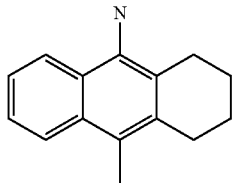

the $Ar^{11}$, $Ar^{12}$, $Ar^{13}$, $Ar^{14}$ and $Ar^{15}$ each independently represent a group selected from a hydrogen atom and methyl, phenyl, 3-methylphenyl, 4-methylphenyl and 4-methoxyphenyl groups;

$R^{11}$, $R^{12}$, $R^{13}$ and $R^{14}$ each independently represent a hydrogen atom; and n is 1.

11. An image forming apparatus comprising: the electrophotographic photoconductor as claimed in claim 1; a charging means that charges the electrophotographic photoconductor; an exposure means that exposes the charged photographic photoconductor; a developing means that develops the electrostatic latent image formed by the exposure: and a transfer means that transfers the electrostatic latent image to a transfer material.

12. The image forming apparatus according to claim 11, comprising plural electrophotographic photoconductors used separately for white-black use and for color use, a charge means that separately charges the surface of the plural photoconductors, an exposure means that separately exposes the charged electrophotographic photoconductors, plural developing means that receive developers having colors different from each other and separately develop the electrostatic latent images formed on the surface of the electrophotographic photoconductors by the exposure and a transfer means that separately transfers the visible images formed on the electrophotographic photoconductors to a recording medium, wherein the electrophotographic photoconductor is produced by laminating either a monolayer type photosensitive layer containing a charge generation material and a charge transport material or a laminate type photosensitive layer obtained by laminating on a conductive support a charge generation layer containing a charge generation material and a charge transport layer containing a charge transport material in this order, the image forming apparatus using the electrophotographic photoconductor as claimed in claim 1 as the electrophotographic photoconductor consisting of the monolayer type photosensitive layer or laminate type photosensitive layer.

* * * * *